US007689139B2

(12) United States Patent
Kamimura

(10) Patent No.: US 7,689,139 B2
(45) Date of Patent: Mar. 30, 2010

(54) ELECTRICAL CONTACT TO PROCESS CARTRIDGE, DEVELOPER CARTRIDGE OR IMAGE FORMING APPARATUS

(75) Inventor: Naoya Kamimura, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 778 days.

(21) Appl. No.: 11/523,632

(22) Filed: Sep. 20, 2006

(65) Prior Publication Data

US 2007/0071481 A1 Mar. 29, 2007

(30) Foreign Application Priority Data

Sep. 26, 2005 (JP) ..... 2005-277470
Dec. 27, 2005 (JP) ..... 2005-376544

(51) Int. Cl.
*G03G 15/00* (2006.01)

(52) U.S. Cl. ..... 399/90; 399/111; 399/112; 399/113; 399/119

(58) Field of Classification Search ..... 399/90, 399/111, 112, 113, 119
See application file for complete search history.

(56) References Cited

U.S. PATENT DOCUMENTS

| | | | | |
|---|---|---|---|---|
| 5,019,867 | A | 5/1991 | Yamakawa et al. | |
| 5,634,175 | A | 5/1997 | Michlin et al. | |
| 5,873,012 | A | 2/1999 | Miyabe et al. | |
| 6,101,350 | A | 8/2000 | Suzuki et al. | |
| 6,128,452 | A | 10/2000 | Miyabe et al. | |
| 6,546,217 | B2 * | 4/2003 | Okabe et al. | 399/113 |
| 2005/0053394 | A1 | 3/2005 | Ishii et al. | |
| 2005/0191090 | A1 * | 9/2005 | Nishimura | 399/113 |
| 2005/0201772 | A1 | 9/2005 | Ishii et al. | |

FOREIGN PATENT DOCUMENTS

| | | | |
|---|---|---|---|
| CN | 1064145 | C | 4/2001 |
| CN | 1591231 | A | 3/2005 |
| EP | 1031891 | A1 | 8/2000 |
| EP | 1515198 | A2 | 3/2005 |
| EP | 1621942 | A2 | 2/2006 |
| JP | 2000-250310 | | 9/2000 |
| JP | 2001-242767 | A | 9/2001 |
| JP | 2005-049524 | | 2/2005 |
| JP | 2005-258344 | | 9/2005 |

OTHER PUBLICATIONS

CN Office Action dtd May 30, 2008, CN Appln. 2006101395757.
EP Search Report dtd Jul. 25, 2008, EP Appln. 06020117.5.

* cited by examiner

*Primary Examiner*—David M Gray
*Assistant Examiner*—Ryan D Walsh
(74) *Attorney, Agent, or Firm*—Banner & Witcoff, Ltd.

(57) ABSTRACT

The pressed area mounted on the developer cartridge case is pressed towards a developer cartridge pressing direction. The developer roller and the photosensitive drum are in contact at a contact position. Electric potential is supplied to the developer cartridge when the electrical connection protrusion connected electrically to the developer roller rotation drive axis and the electrical connection part mounted on the outside of the developer cartridge are pushed together in the electrical connection pressing direction. Here, the electrical connection pressing direction is semi-orthogonal to the pressing action line that connects the pressing position and the contact position. Furthermore, the electrical connection protrusion crosses the pressing action line.

41 Claims, 37 Drawing Sheets

Fig. 3(A)
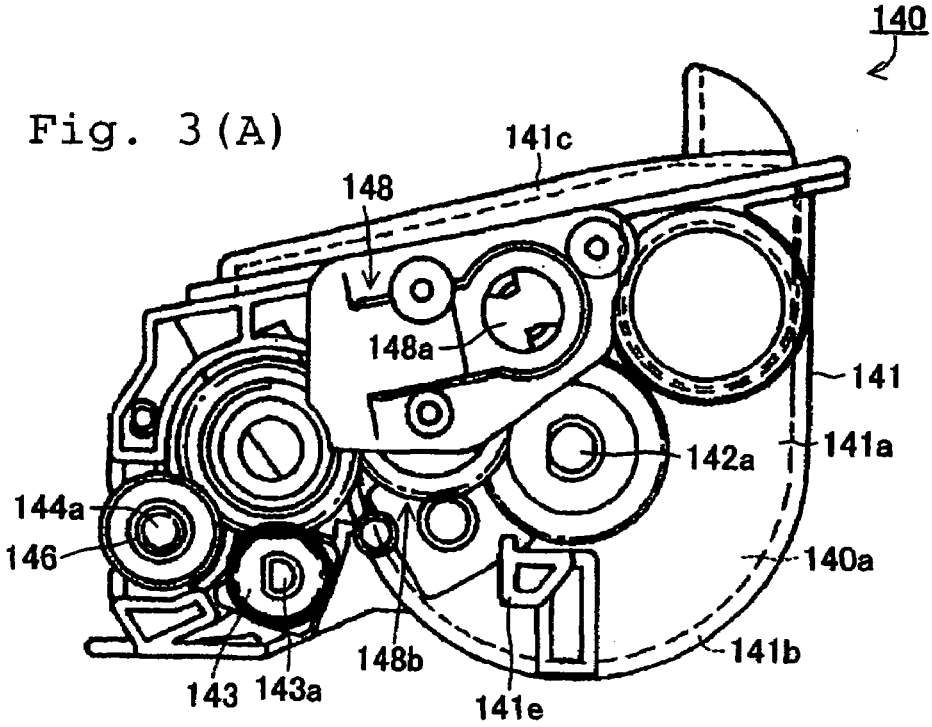
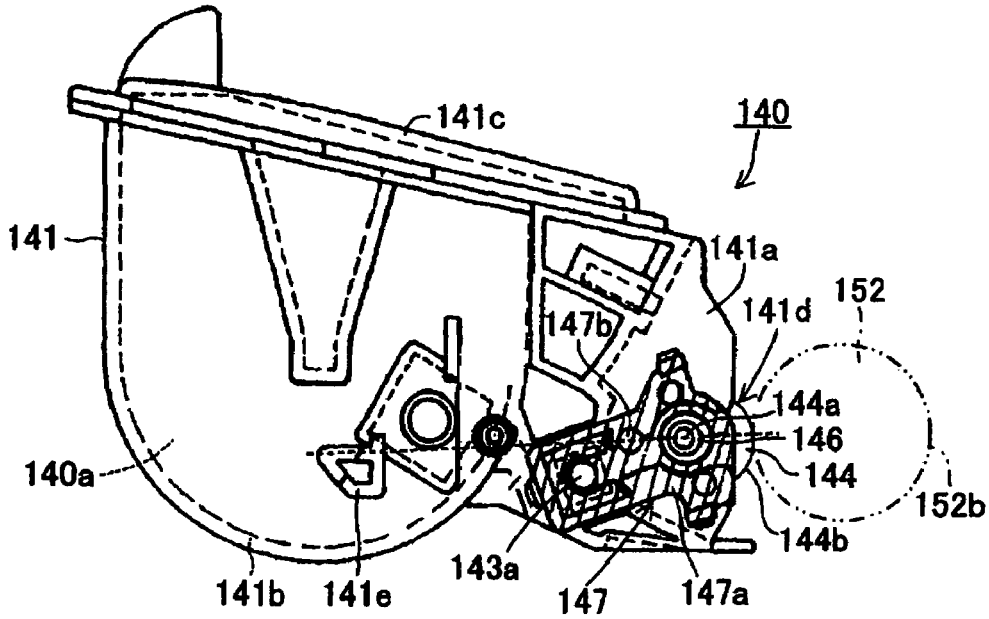
Fig. 3(B)

Fig. 10(A)
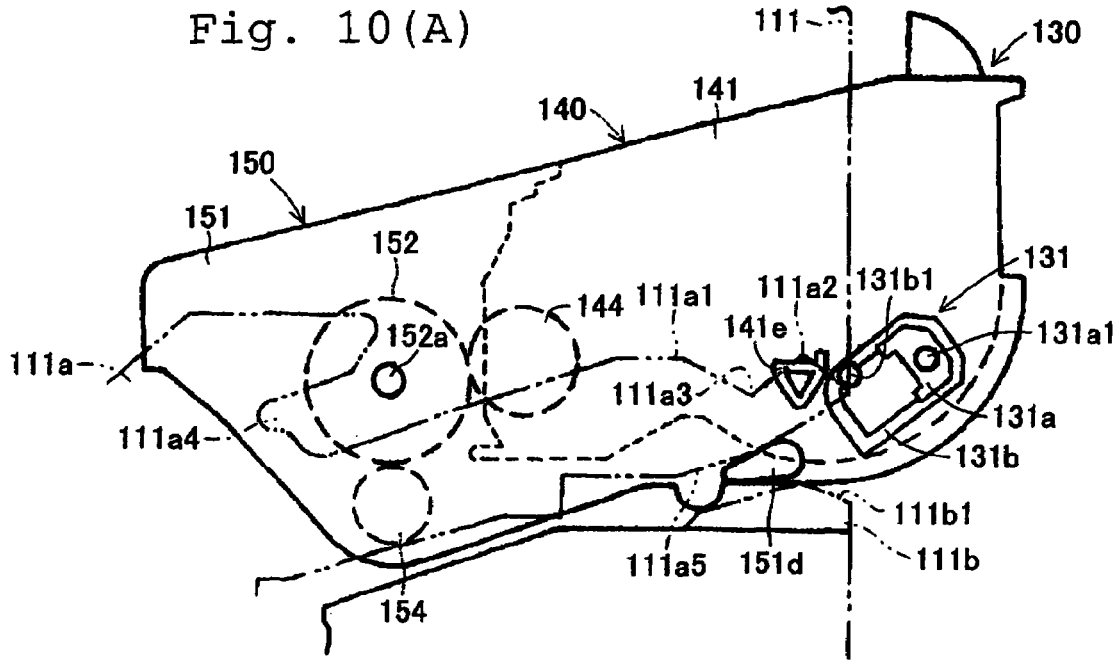
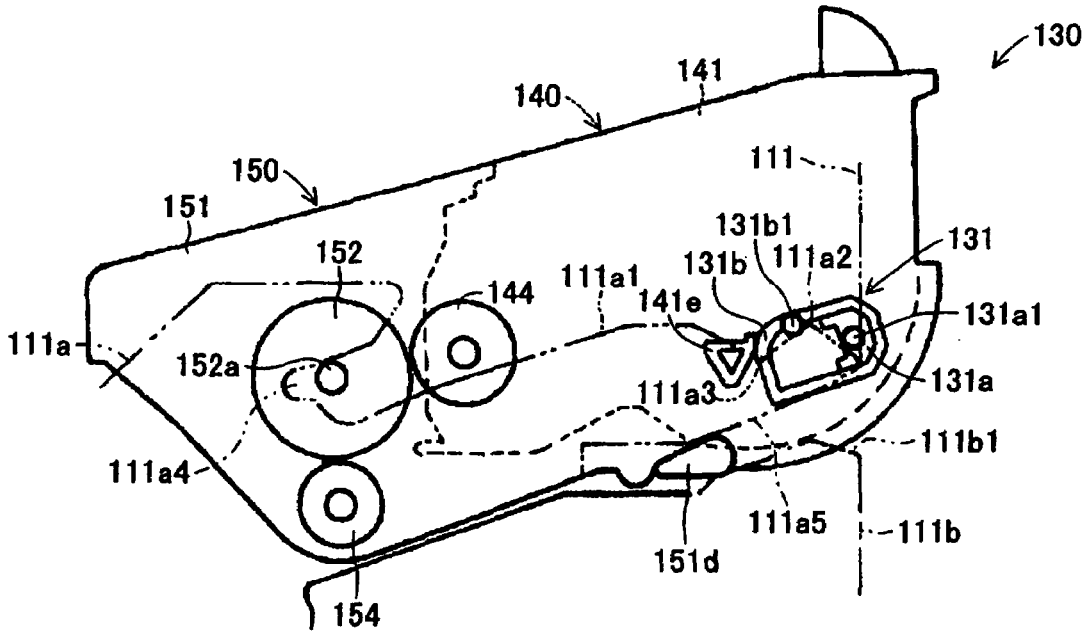
Fig. 10(B)

Fig. 19(A)
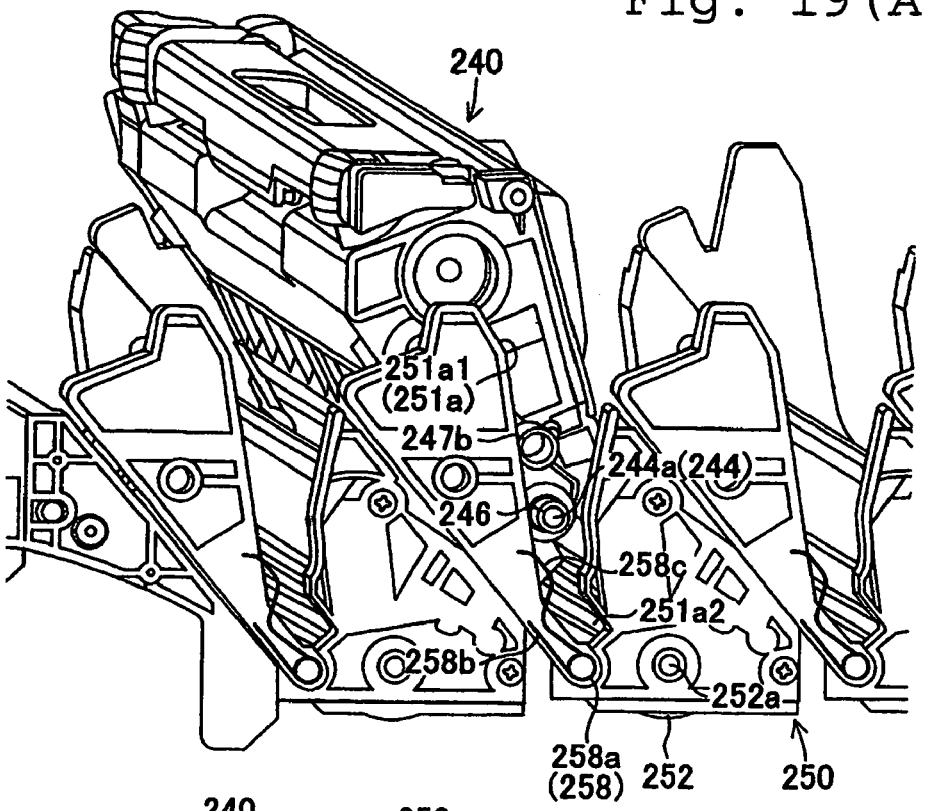
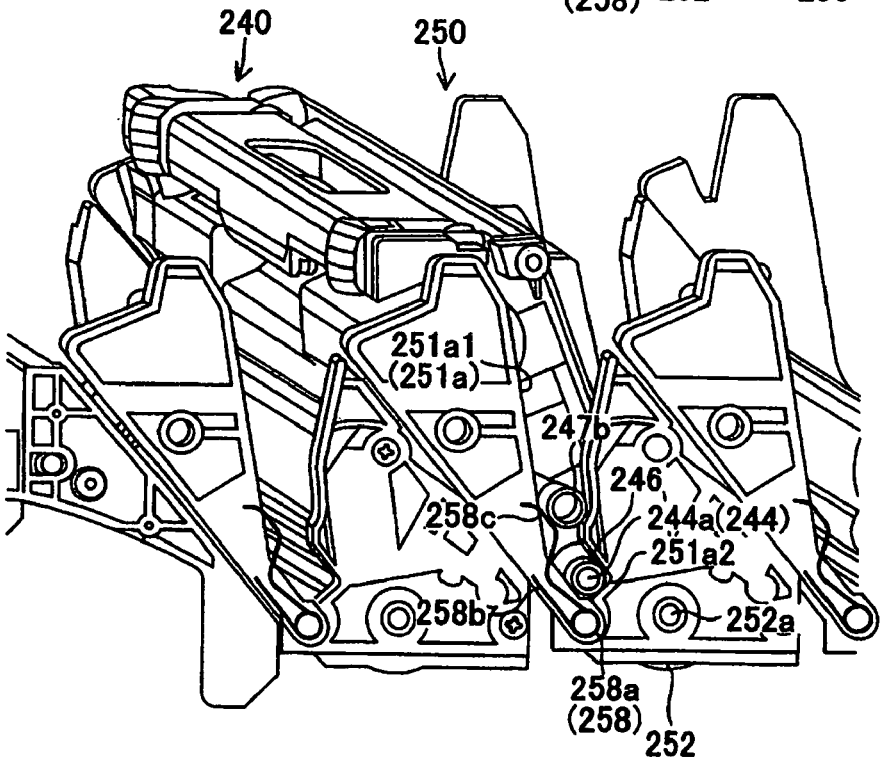
Fig. 19(B)

Fig. 20(A)
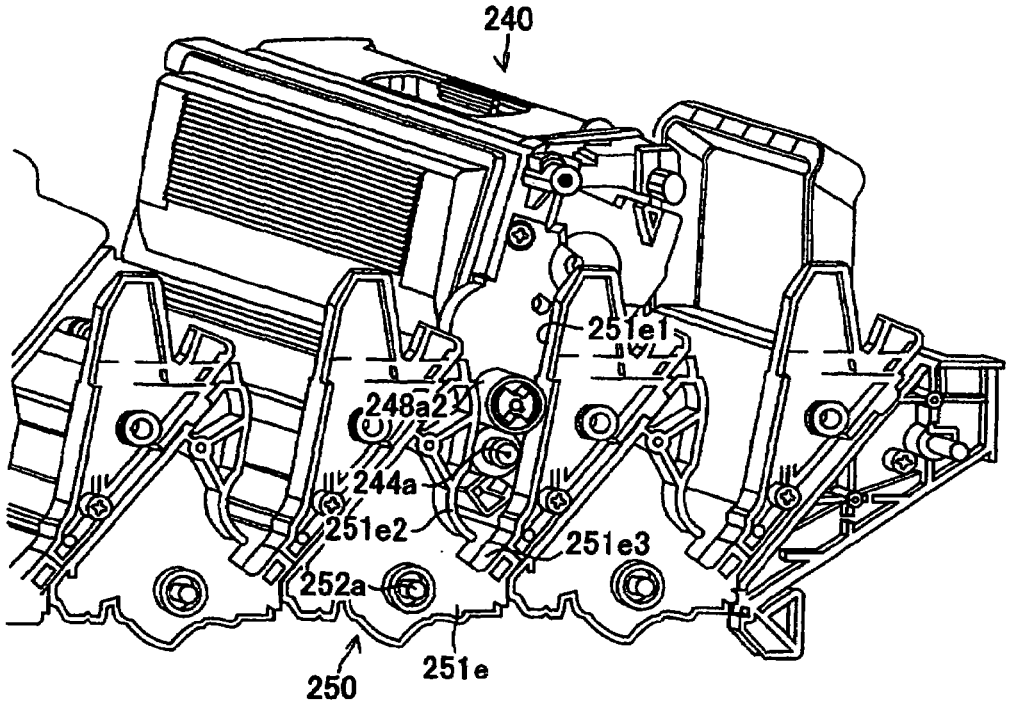
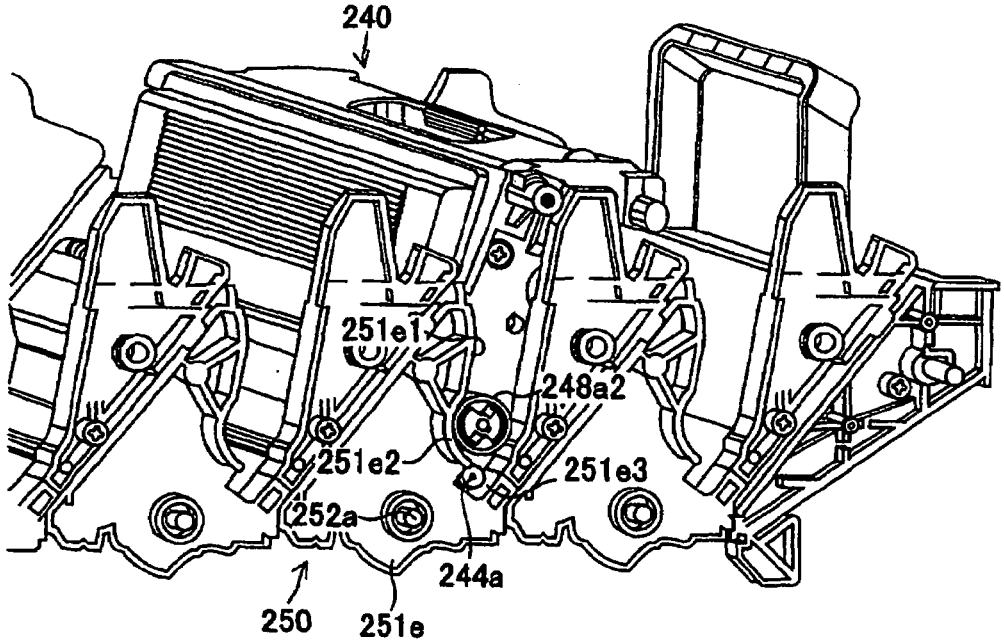
Fig. 20(B)

ELECTRICAL CONTACT TO PROCESS CARTRIDGE, DEVELOPER CARTRIDGE OR IMAGE FORMING APPARATUS

CROSS REFERENCE TO RELATED APPLICATIONS

This application claims priority from Japanese Patent Application Nos. 2005-277470 filed Sep. 26, 2005 and 2005-376544 filed Dec. 27, 2005, the entire contents of which are incorporated herein by reference.

FIELD

Aspects of the present invention relate to an image-forming apparatus wherein a developing cartridge is configured in a freely attachable/removable manner. Aspects also relate to a process cartridge configured in a freely attachable/removable manner with respect to the body frame of the image-forming apparatus. In addition, aspects relate to a developing cartridge configured in a freely attachable/removable manner.

BACKGROUND

Japanese Unexamined Patent Application Publication 2005-258344 describes an image-forming apparatus in which a process cartridge is configured in a freely attachable/removable manner with respect to the unit casing (body frame) of the image-forming apparatus. A drum frame including the casing of the process cartridge is configured in a manner allowing the developing cartridge to be installed in a freely attachable/removable manner. Within the drum frame there are contained a photosensitive drum and a scorotron-type charger.

The photosensitive drum includes a grounded drum unit and a photo-conducting layer formed on the surface of the drum unit. The scorotron-type charger is disposed upward from the photosensitive drum and separated by a predetermined gap. The scorotron-type charger is configured so as to charge uniformly the surface of the photosensitive layer of the photosensitive drum ("surface of the photosensitive drum" hereinafter). After the surface of the photosensitive drum is charged uniformly by the scorotron-type charger, an electrostatic latent image is formed on by exposing the surface based on the image information.

The developing cartridge is equipped with a toner housing which houses a toner serving as a developing agent. In the developing cartridge there are also housed a developing roller, a supply roller, and a toner layer thickness-regulating blade.

The developing roller is configured so as to be able to carry the charged toner at its periphery. The developing roller is configured so as to allow the toner in a pattern corresponding to the electrostatic latent image to be adhered to the surface of the photosensitive drum by being brought into contact with the surface of the photosensitive drum whereon the electrostatic latent image is formed. In other words, the developing roller is configured so as to allow the electrostatic latent image to be developed by the toner carried at the periphery of the developing roller.

The supply roller is configured so as to be able to supply the toner to the developing roller. The toner layer thickness-regulating blade is configured so as to be able to regulate the amount of the toner carried on the periphery of the developing roller to which the toner is supplied by a developing agent supply unit.

The image-forming apparatus is also configured so as to allow a predetermined developing bias voltage to be applied between the developing roller and the grounded, photosensitive drum. Specifically, an electrode electrically connected to the output terminal of a high-voltage circuit is provided in the unit casing. The electrode is configured so as to be able to supply electric potential to the developing roller via a bearing member at the rotation drive central axis of the developing roller by pressing on the bearing when the process cartridge in which the developing cartridge is attached is itself attached to the unit casing.

Image-forming by a conventional image-forming device provided with such a structure is carried out as follows.

First, the surface of the photosensitive drum is charged uniformly by the scorotron-type charger. Next, the electrostatic latent image is formed by exposing the surface of the uniformly charged, photosensitive drum based on the image information.

Then, the surface of the photosensitive drum whereon the electrostatic latent image is formed confronts the periphery of the developing roller whereon the charged toner is carried. The toner in a pattern corresponding to the electrostatic latent image is thereby adhered to the surface of the photosensitive drum. In other words, an image produced by the toner (developing agent image) is formed on the surface of the photosensitive drum. An image is formed on the surface of a recording medium by transferring the developing agent image to the recording medium.

SUMMARY

According to aspects of the invention, an image formation device may include a developer cartridge having a developer carrier configured to carry a developer, a developer cartridge case configured to house the developer carrier, and a conductive member mounted on the developer cartridge case and electrically connected to the developer carrier. The device can further include a developer cartridge mounting frame having an image carrier configured to form an image on a recording medium using the developer carried on the developer carrier by contacting the developer carrier at a designated contact position, wherein the developer cartridge is configured to be installed in and removed from the developer cartridge mounting frame. In addition, the device can include an urging member configured to urge in a pressing direction a portion of the developer cartridge case at a designated pressing position, and wherein in response to the urging member urging the portion of the developer cartridge case, the developer carrier is pressed against the image formation carrier at the contact position. The device may also include an electrical connection member configured to allow the conductive member to receive electric potential when contacting the electrical connection member in a direction perpendicular to a line that connects the contacting position and the pressing position.

According to another aspect of the invention, a process cartridge may be configured to be installed in and removed from a frame of an image forming device. The process cartridge can include a developer cartridge that includes a developer carrier configured to carry a developer, a developer cartridge case configured to house the developer carrier and the developer, and a conductive member provided on the developer cartridge case, the conductive member being electrically connected to the developer carrier, the developer cartridge case including a portion urged in a pressing direction by an urging element at a designated pressing position. Also, the process cartridge may include a process cartridge frame that holds an image carrier to which the developer is carried by contacting the developer carrier at a designated contact position, the developer cartridge being configured to be installed in and removed from the process cartridge frame. The conductive member can be configured to be pressed by an electrical connection member in a direction perpendicular to a line that connects the pressing position and the contacting position.

According to still another aspect, a developer cartridge may be configured for use in an image forming device including an image carrier configured to be supported in a developer cartridge mounting frame, which is configured to be supported inside the image forming device, the developer cartridge being configured to be installed in and removed from the developer cartridge mounting frame. The developer cartridge can include a developer carrier configured to carry the developer, a developer cartridge case configured to house the developer carrier, and a conductive member mounted on the developer cartridge case and electrically connected to the developer carrier. The developer cartridge case may be configured to allow the developer carrier to be pressed, at a designated pressing position, against the image carrier, and the conductive member may be configured to be supplied with electric potential while being pressed by an electrical connection member in a direction perpendicular to a line that connects a contacting position where the developer carrier and the image carrier contact each other, and the designated pressing position.

BRIEF DESCRIPTION OF THE DRAWINGS

FIGS. 3A and 3B are left and right a side views of the developer cartridge of the process cartridge shown in FIG. 2, respectively

FIG. 10 is a schematic side view illustrating an intermediate stage of the mounting of the process cartridge onto the unit frame shown in FIG. 1.

FIG. 19 is a perspective oblique view of the photosensitive unit shown in FIG. 17.

FIG. 20 is a perspective oblique view of the photosensitive unit shown in FIG. 17 seen from the opposite side from FIG. 19.

DETAILED DESCRIPTION

Below, aspects of the present invention are explained with reference to the drawings.

Overall Configuration of a Laser Printer

Figure 1:
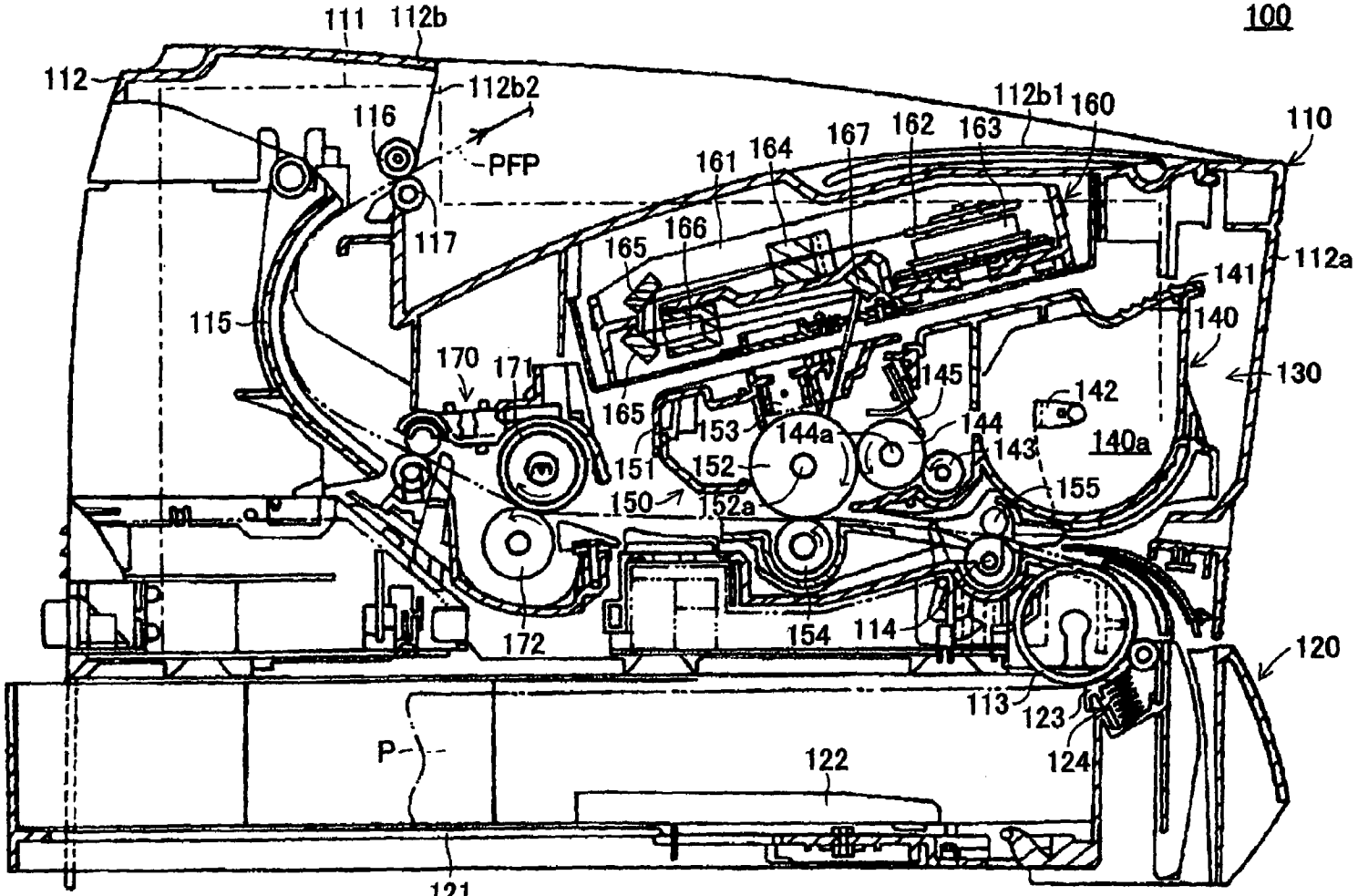
FIG. 1 is a cross-section of a laser printer constituting an image formation device according to aspects of the invention.

FIG. 1 is a side cross-sectional view of a monochrome laser printer 100 that is an image forming device according to aspects of the present invention.

A monochrome laser printer 100 includes a main unit 110 and a feeder unit 120. The main unit 110 is configured to form an image on a paper P while conveying the paper (recording medium) P supplied by the feeder unit 120 along a paper feed path PFP (illustrated by the double-chain line in the drawing).

In the following explanation, the direction in which the paper P is conveyed along the paper feed path PFP in FIG. 1 is called the "paper feed direction." That is, the paper feed direction at a certain position along the paper feed path PFP is parallel to the direction tangent to the paper feed path PFP at that position and is the direction along the direction of movement of the paper P at that position.

In addition, the direction that orthogonally intersects the paper feed path PFP, that is, the direction that orthogonally intersects the paper surface in FIG. 1 is called the "width direction." This "width direction" is the direction that matches the direction of the width of the paper. In addition, this "width direction" is a direction that orthogonally intersects the direction of the thickness of the paper P, the direction of the height of the monochrome laser printer 100, and the paper feed direction.

Furthermore, the right side of the figure of the monochrome laser printer 100 is called the "front side" of the monochrome laser printer 100 and the left side of the figure of the monochrome laser printer 100 is called the "rear side" of the monochrome laser printer 100.

The feeder unit 120 is arranged in the bottom of the main unit 110. The feeder unit 120 is configured to hold the sheet paper P in a stack for feeding to the interior of the main unit 110. In some aspects, the monochrome laser printer 100 and the feeder unit 120 are configured to handle letter size (215.9 mm×279.4 mm) and A4 size (210 mm×297 mm) paper P. The feeder unit 120 is configured to be mounted from the above-mentioned front side in the direction of the above-mentioned rear side of the bottom of the main unit 110.

A process cartridge 130 is accommodated on top of the feeder unit 120 inside the main unit 110. The process cartridge 130 is arranged in the above-mentioned front side and in the approximate center of the above-mentioned width direction inside the main unit 110. In addition, the process cartridge 130 is configured to form an image on the paper P using a toner (a developing agent). The process cartridge 130 is configured to be freely insertable in and removable from the main unit 110.

The process cartridge 130 includes a developer cartridge 140 and a photosensitive unit 150. The developer cartridge 140 is configured to be freely insertable in and removable from the photosensitive unit 150.

In addition, a scanner unit 160 and a fixing unit 170 are provided inside the main unit 110.

The scanner unit 160 is configured to generate a laser beam to accompany the formation of a toner image in the process cartridge 130 and can irradiate the beam toward the process cartridge 130.

The fixing unit 170 is configured to fix a toner image formed on a paper P by the process cartridge 130 onto the paper P.

Specific configurations of a body portion 110, a process cartridge 130, a developing cartridge 140, a photosensitive unit 150, a scanner unit 160, and a fixing unit 170 are described below.

Body Portion

The body portion 110 includes a body frame 111 supporting the process cartridge 130. The body frame 111 is made of a synthetic resin.

Body Cover

The body portion 110 includes a body cover 112. The body cover 112 is formed to cover the outside of the body frame 111. This body cover 112 is made of a synthetic resin plate material.

At the front side of the body cover 112, a front cover 112*a* is set. This front cover 112*a* is capable of being opened and closed. That is, when the front cover 112*a* is opened, an opening is formed for attaching and detaching the process cartridge 130 at the front side of the body cover 112.

A concavity is formed at the back side (the left side in the figure) in the top cover 112*b* including the upper surface of the body cover 112. This concavity is formed in such a shape that it becomes deeper in the direction from the front side (the right side in the figure) to the back side. Then, a sheet delivery tray 112*b*1 is formed by the concavity.

That is, the sheet delivery tray 112*b*1 includes a slope formed diagonally extending downward from the front side (the right side in the figure) of the top cover 112*b* to the back side (the left side in the figure). The sheet delivery tray 112*b*1 is configured such that sheets P on which images are formed can be stacked in a multilayer state.

Also, at the upper side of the lower end portion of the sheet delivery tray 112*b*1 in the body cover 112, a sheet delivery outlet 112*b*2 with an opening portion is formed. The sheet delivery tray 112*b*1 is configured to be capable of receiving sheets P that have been delivered with images from the sheet delivery outlet 112*b*2.

Sheet Conveyor Mechanism in the Body Portion

A sheet supply roller 113 is installed at the bottom at the front side of the body portion 110. The sheet supply roller 113 is made of a rubber roller. This sheet supply roller 113 is capable of feeding the topmost sheet in the paper conveyor direction among the sheets P that have been stacked up in a multilayer state in the feeder unit 120.

A resist roller 114 is installed in the process cartridge 130 at the downstream side of the paper feed passage PFP from the paper feed roller 113. The resist roller 114 is arranged at a position facing the resist facing roller 155 equipped at the bottom of the process cartridge 130 as will be described later. The resist roller 114 working in coordination with the resist facing roller 155 corrects the slope at the tip of the sheet P as well as adjusts the passage timing of the tip of the sheet P.

The sheet supply roller 113 and resist roller 14 are arranged to be rotated via a rotary driving force transmission mechanism which is not shown.

Also, a paper guide 115 is installed to guide conveyance of the sheets P along the paper feed passage PFP inside of the body portion 110.

A sheet delivery roller 116 and a sheet delivery sub-roller 117 are arranged such that the front side is exposed to the outside from the sheet delivery output 112*b*2 in the top cover 112*b*. Also, the sheet delivery roller 116 and the sheet delivery sub-roller 117 are arranged such that the back side is mounted in the inside of the top cover 112*b*.

The sheet delivery roller 116 is configured to rotate counter-clockwise due to the rotation drive force transmission mechanism of which is not shown in the figure. The sheet delivery sub-roller 117 is arranged at the downstream side of the sheet delivery roller 116. The sheet delivery sub-roller 117 is supported such that it can be freely rotated by the top cover 112*b*.

Feeder Unit

A feeder unit 120 includes a feeder case 121, a sheet pressing plate 122, a separation pad 123, and a separation pad urging spring 124.

The feeder case 121 is a member that includes a casing for the feeder unit 120. The feeder case 121 is made of the same synthetic resin plate material as the body cover 112. This feeder unit 120 is configured such that sheets P can be stored in a multilayer state.

A sheet pressing plate 122 is arranged inside of the feeder case 121. This sheet pressing plate 122 is supported such that it can be slid around the edge of the back side.

The separation pad 123 is installed to face the sheet supply roller 113. A friction portion made of a material in which the coefficient of friction with the sheet P is higher than the coefficient of friction among the sheets P is formed on the surface facing the sheet supply roller 113 in this separation pad 123. This friction portion is made of felt and the like. This separation pad 123 is urged towards the upper sheet supply roller 113 due to the separation pad urging spring 124.

Outlined Constitution of a Developing Cartridge

A developing cartridge 140 includes a developing cartridge case 141, an agitator 142, a supply roller 143, a developing roller 144, and a toner layer thickness regulating blade 145.

The developing cartridge case 141 includes a casing for the developing cartridge 140 is made of a synthetic resin plate material. A toner storage chamber 140*a* is formed at the front side of the developing cartridge case 141. This toner storage chamber 140*a* is a space for storing a non-magnetic one component toner as a developer.

A blade-shaped agitator 142 is arranged inside of the toner storage chamber 140*a*. The agitator 142 is supported such that it is rotatable by the developing cartridge case 141. The agitator 142 is capable of agitating the toner stored in the toner storage chamber 140*a* due to its rotary action. Also, this agitator 142 can feed the toner in small portions towards the supply roller 143 due to its rotary action.

The supply roller 143 is arranged inside of the developing cartridge case 141 at the back side of the toner storage chamber 140*a*. The supply roller 143 is configured by forming a sponge layer on the outer surface of the metallic rotary shaft. The supply roller 143 is supported by the developing cartridge case 141 such that it can be rotated. Also, the supply roller 143 is rotated in the direction shown by the arrow in the figure (in a counter-clockwise direction) via a rotary drive-force transmission mechanism that is not shown in the figure while forming images.

A developing roller 144 is arranged at the back side of the supply roller 143 inside of the developing cartridge case 141. The developing roller 144 is arranged in parallel to the supply roller 143. When the supply roller 143 is pressed by the developing roller 144, an inter-axial distance is set between the developing roller 144 and the supply roller 143 such that the supply roller 143 is elastically compressed.

The developing roller 144 includes a developing roller rotary drive shaft 144*a* that is a metallic rotary shaft, and a semi-conductive rubber layer formed on the outer surface of the developing roller rotary drive shaft 144*a*. The semi-conductive rubber layer is formed by uniformly dispersing carbon black into a synthetic rubber.

The developing roller 144 is supported by the developing cartridge case 141 such that it can be rotated. The developing roller 144 is rotated in the direction shown by the arrow in the figure (in a counter-clockwise direction: same direction as the supply roller 143) via the rotary drive force transmission mechanism that is not shown in the figure while forming images. In addition, a charged toner is carried by the rotary drive on the surface of the developing roller 144.

The toner layer thickness regulating blade 145 is configured such that the amount of the toner to be supported on the surface of the developing roller 144 can be adjusted. That is, when the toner layer thickness regulating blade 145 slides against the surface of the developing roller 144, the thickness and density of the thin toner layer carried on the surface can be adjusted.

Outlined Constitution of a Photosensitive Unit

A photosensitive unit 150 includes a photosensitive unit frame 151, a photosensitive drum 152, a charger 153, a transfer roller 154, and a resist facing roller 155.

The photosensitive unit frame 151 is a member including a casing for the photosensitive unit 150, and is formed of a synthetic resin plate material. This photosensitive unit frame 151 is configured to be freely attachable to and detachable from the developing cartridge 140.

The photosensitive drum 152 is installed inside of the photosensitive unit frame 151. The photosensitive drum 152 includes a metallic cylindrical member and a photosensitive layer made of a photoconductive material installed on the outer surface of the cylindrical member. The drum shaft 152*a* is a rotary shaft of the photosensitive drum 152 that is supported by the photosensitive unit frame 151 in a rotatable manner. Also, this drum shaft 152*a* and the cylindrical member are electrically connected. This drum shaft 152*a* is also grounded.

The photosensitive drum 152 is arranged parallel to the developing roller 144 in the state when the developing cartridge 140 is installed in the photosensitive unit 150. An inter-axial distance is set between the photosensitive drum 152 and the developing roller 144 such that the surface of the photosensitive drum 152 and the surface of the developing roller 144 are in contact with each other via a thin toner layer carried on the surface of the developing roller 144.

A process cartridge 130 is configured such that a toner image is formed on the surface of the photosensitive drum 152 when the electrostatic latent images formed on the surface of the photosensitive drum 152 are developed by the toner carried on the surface of the developing roller 144.

A charger 153 is arranged in the upper portion of the photosensitive drum 152. The charger 153 is supported by the photosensitive unit frame 151. This charger 153 is made of a known scorotron type charger such that the surface of the photosensitive drum 152 is uniformly charged.

The transfer roller 154 is disposed at the lower side of the photosensitive drum 152 inside of the photosensitive unit frame 151. The transfer roller 154 is disposed in parallel to the photosensitive drum 152 such that it faces the surface of the photosensitive drum 152 having the paper feed passage PFP in between.

The transfer roller 154 is supported in a rotatable manner by the photosensitive unit frame 151. The transfer roller 154 is made by forming a semi-conductive rubber layer on the outer surface of the metallic rotary shaft. A high voltage side output terminal (not shown) is connected to the rotary shaft.

That is, a specified transfer voltage is applied between the transfer roller 154 and the photosensitive drum 152 at the transfer position where the transfer roller 154 and the photosensitive drum 152 face each other.

That is, the transfer roller 154 is configured such that it is rotated in the direction shown by the arrow in the figure (in a counter-clockwise direction) synchronous to the rotation in the direction shown by the arrow in the photosensitive drum 152 (in a clockwise direction) while forming images. Also, while the transfer roller 154 is rotated as described above and the transfer voltage is applied in the gap with the photosensitive drum 152, the toner is carried in such a way that images are orientated on the surface of the photosensitive drum 152 and transferred to a sheet P at the transfer position.

A resist facing roller 155 is provided upstream in the paper feed direction from the transfer position outside the bottom of the photosensitive unit frame 151. This resist roller 114 is supported in a freely rotatable manner by the photosensitive unit frame 151.

The resist facing roller 155 is arranged in parallel to the resist roller 114. Also, the resist facing roller 155 is arranged to face the resist roller 114. When the resist facing roller 155 is in contact with the resist roller 114, it is rotated in accordance with the resist roller 114.

Scanner Unit

A scanner unit 160 is arranged in the lower part of the sheet delivery tray 112*b*1. This scanner unit 160 is supported in the upper part of the process cartridge 130 via the body frame 111. The scanner unit 160 includes a scanner frame 161, a polygon mirror 162, a polygon motor 163, an f-θ lens, a folded mirror 165, a cylindrical lens 166, and an illumination mirror 167.

The scanner frame 161 supports the polygon mirror 162, polygon motor 163, f-θ lens 164, folded mirror, cylindrical lens 166 and illumination mirror 167. The scanner frame 161 is made of a synthetic resin plate material.

The polygon mirror 162 is supported by the rotary drive shaft of the polygon motor 163 fixed in the scanner frame 161. This polygon mirror 162 is configured such that while rotating a specific number of rotations by the polygon motor 163, it reflects the laser beam that is generated in the laser emission unit based on the image data in order to scan in the lateral direction.

The f-θ lens 164 is a lens for correcting the scanning gap of the laser beam reflected from the polygon mirror 162, and is configured such that it has a longitudinal direction along the rotary direction of the polygon mirror 162.

The cylindrical lens 166 is a surface inclination correction lens and is arranged in the moving direction of the laser beam reflected from the folded mirror 165 via the f-θ lens 164. The illumination mirror 167 is arranged such that the laser beam passing the cylindrical lens 166 is irradiated facing the surface of the photosensitive drum 152.

Fixing Unit

A fixing unit 170 is arranged at the downstream side in the paper feeding direction from the transfer position. The fixing unit 170 includes a heat roller 171 and a pressure roller 172.

The heat roller 171 contains a heater within the metallic thin wall cylinder that has been surface treated for releasing mold. The heat roller 171 is arranged in parallel to the lateral direction.

The pressure roller 172 is a silicone rubber roller and is arranged in parallel to the heat roller 171. The pressure roller 172 is pressed against the heat roller 171 using a spring.

This fixing unit 170 is configured such that while a sheet P is inserted between the heat roller 171 and the pressure roller 172 which rotate in the directions shown by the arrows in the figure, toner images adhering on the surface of the sheet P are fixed on the surface and the sheet P is fed in the paper feed direction.

Detailed Configuration of the Process Cartridge

Figure 2:
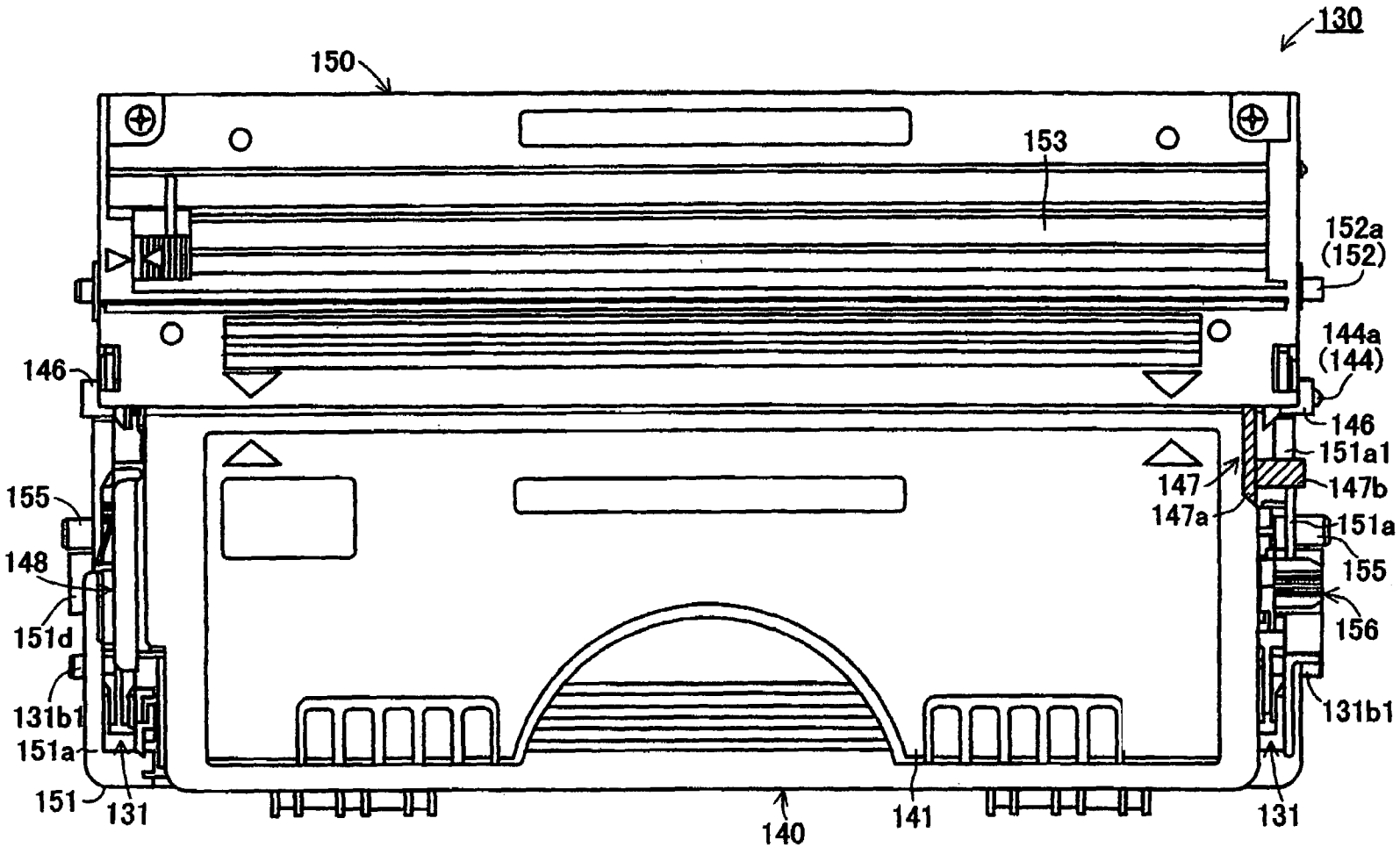
FIG. 2 is a plan view of a process cartridge of the laser printer shown in FIG. 1.

FIG. 2 is a plane view of the process cartridge 130 shown in FIG. 1. With reference to FIG. 2, the process cartridge 130 is contained in the space wherein the developing cartridge 140 is enclosed by a pair of side wall portions 151*a* in the photosensitive unit frame 151.

This process cartridge 130 contains a pair of urging mechanisms 131. The urging mechanisms 131 are installed between the outer side of the developing cartridge case 141 and the internal side of the pair of the side wall portions 151*a*. The urging mechanism 131 is provided such that the surface of the developing roller 144 and the surface of the photosensitive drum 152 are in contact with each other in an urged state by urging the developing cartridge case 141 against the photosensitive drum 152. In this aspect, the urging mechanisms 131 are provided inside of the pair of side wall portions 151*a*. The urging mechanism 131 will be described in detail later.

Detailed Configuration of the Developing Cartridge

FIGS. 3A and 3B are side views of the developing cartridge 140 shown in FIG. 2. FIG. 3A is a side view when viewed from the same direction as in FIG. 1, namely a left side view. FIG. 3B is a right side view.

Figure 4:
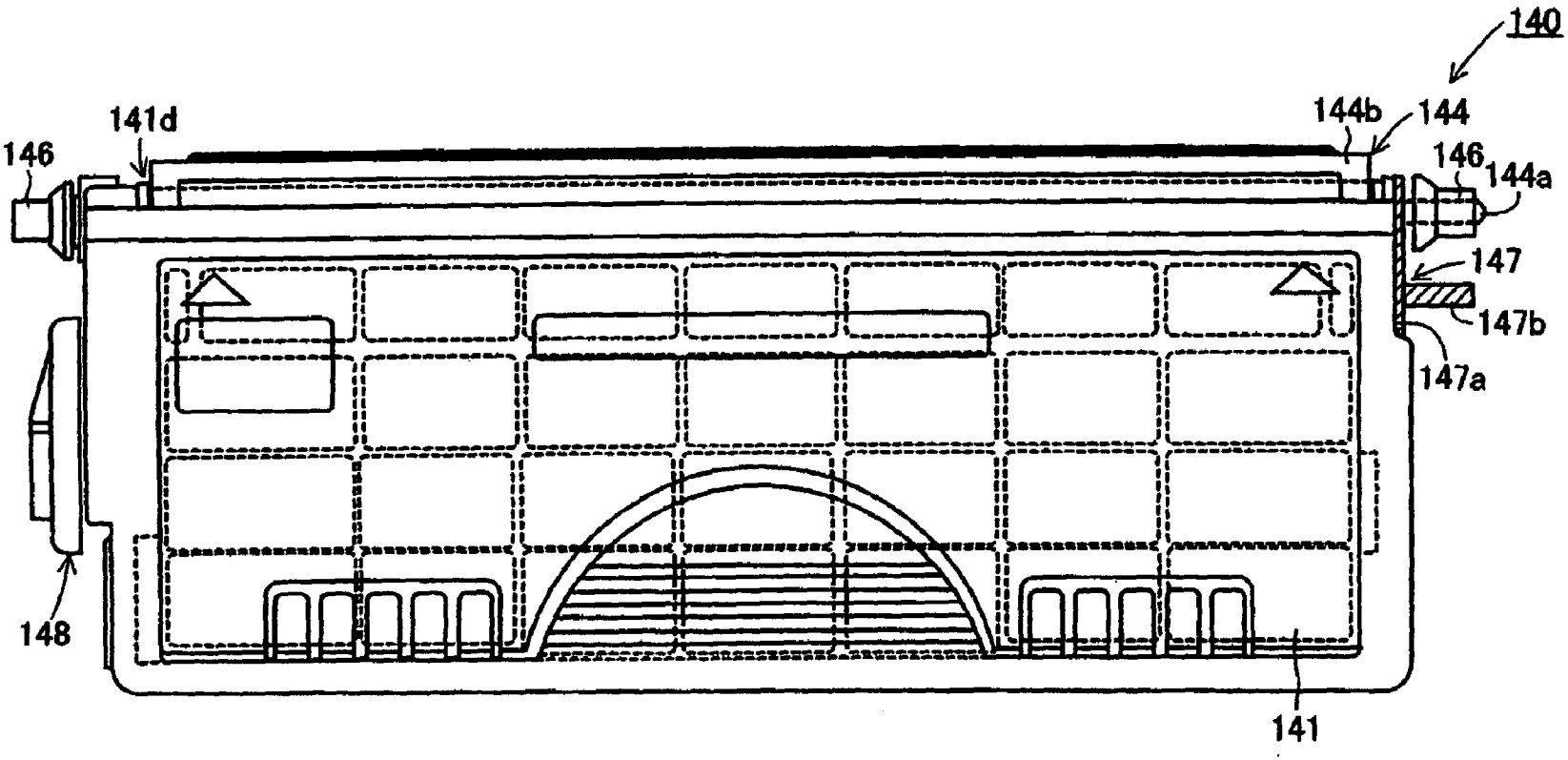
FIG. 4 is a plan view of the developer cartridge shown in FIG. 2 and FIGS. 3A and 3B.

FIG. 4 is a plane view of the developing cartridge 140 shown in FIG. 2 and FIGS. 3A and 3B. That is, FIG. 4 is the developing cartridge 140 when it is detached from the photosensitive unit 150 (photosensitive unit frame 151) in the process cartridge 130 shown in FIG. 2.

With reference to FIGS. 3A and 3B, the developing cartridge case 141 includes a pair of side plates 141*a*, a bottom plate 141*b*, and a ceiling plate 141*c*. A toner storage chamber 140*a* is formed by the space enclosed by the pair of side plates 141*a*, the bottom plate 141*b* and the ceiling plate 141*c*.

A developing opening portion 141*d* is formed at the edge, farthest away from the toner storage chamber 140*a* (at the edge of the downstream side in the paper feed direction) in the developing cartridge case 141. The developing opening portion 141*d* is formed such that a portion of the toner carrying surface 144*b*, which is the surface of the developing roller 144, is exposed. That is, with reference to FIG. 3B, the developing cartridge case 141 is provided such that the toner carrying surface 144*b* of the developing roller 144 is exposed to the image carrying surface 152*b* of the photosensitive drum 152 via the developing opening portion 144*d*.

A projecting portion 141*e* of the developer cartridge case 141 protrudes to away from the pair of the side plates 141*a*. The projecting portion 141*e* is configured to be pressed by the urging mechanism when it is in contact with the urging mechanism 131 (See FIG. 2).

With reference to FIGS. 3A and 3B, an almost cylindrical alignment collar (bearing) 146 is installed at and projects from both ends of the developing roller driving shaft 144*a*. The alignment collar 146 is formed of a material with a small coefficient of friction such as polyacetal resin, etc. The outer surface of the alignment collar 146 is formed to provide a smooth surface in order to achieve smooth sliding on the outer surface that is in contact with other members.

The alignment collar 146 is configured such that it can rotate relative to the developing roller driving shaft 144*a*. That is, the alignment collar 146 can function as a bearing by sliding the outer surface at both edges of the developing roller driving shaft 144*a* against the internal surface of the alignment collar 146.

With reference to FIG. 2, the pair of alignment collars 146 is configured such that the developing cartridge 140 and the photosensitive unit 150 are aligned by coupling with the pair of side wall portions 151*a* of the photosensitive unit frame 151. That is, when the pair of alignment collars 146 is coupled with the pair of side wall portions 151*a*, the dimensional relationships between the developing roller driving shaft 144*a* and the drum shaft 152*a* are set in a specified state so that the dimensional relationships between the surface of the developing roller 144 and the surface of the photosensitive drum 152 are set in a specified state.

With reference to FIG. 3B, a conductive member 147 is installed on the outside of one side plate 141*a* (right side). The conductive member 147 includes a flat plate base plate 147*a* and a columnar electrical connection protrusion 147*b*. This conductive member 147 is integrally formed of a conductive synthetic resin.

The base plate 147*a* is attached to the outside of the other side plate 141*a* (right side). Two through-holes are formed in the base plate 147*a*. The supply roller driving shaft 143*a* is inserted into one of the through-holes. The developing roller driving shaft 144*a* is inserted through the other through-holes. Additionally, the supply roller driving shaft 143*a*, the developing roller driving shaft 144*a*, and the base plate 147*a* are electrically connected by being in contact with each other. That is, the suppler roller 143 and the developing roller 144 are electrically connected via the conductive member 147.

The electrical connection protrusion 147*b* is built outwardly from the base plate 147*a*. With reference to FIG. 2, the electrical connection protrusion 147*b* is configured such that when it protrudes from one of the side wall portions 151*a* in the photosensitive unit frame 151 in such a state that the developing cartridge 140 is installed in the photosensitive unit 150 (photosensitive unit frame 151), electric potential is supplied from the specific electrical connection member installed outside of the process cartridge 130.

Again with reference to FIGS. 3A and 3B, a driving force input unit 148 is installed on the side plate 141*a* at an opposite side (left side) relative to the side where the conductive member 147 is installed. The driving force input unit 148 includes a coupling unit 148*a* and a gear mechanism 148*b*.

When the coupling unit 148*a* is coupled with the driving rotor equipped at the side of the body frame 111 (See FIG. 1), it can receive the driving force from the driving rotor. The gear mechanism 148*b* includes multiple gears that are configured and arranged such that the driving force received by the coupling unit 148*a* can be transmitted to an agitator driving shaft 142*a*, a supply roller driving shaft 143*a*, and the developing roller driving shaft 144*a*.

Detailed Configuration of the Photosensitive Unit

Figure 5:
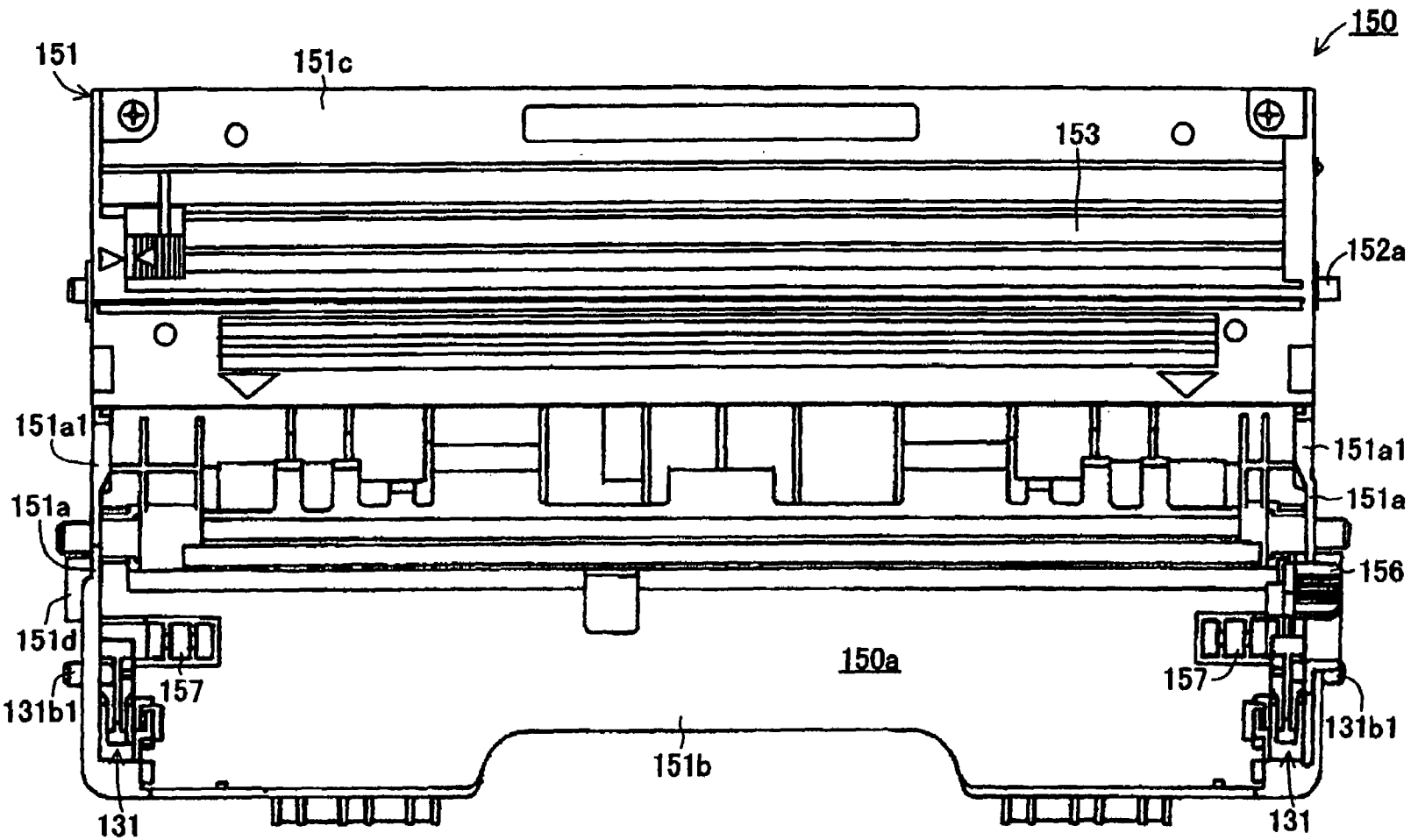
FIG. 5 is a plan view of a photosensitive unit of the process cartridge shown in FIG. 2.
Figure 6:
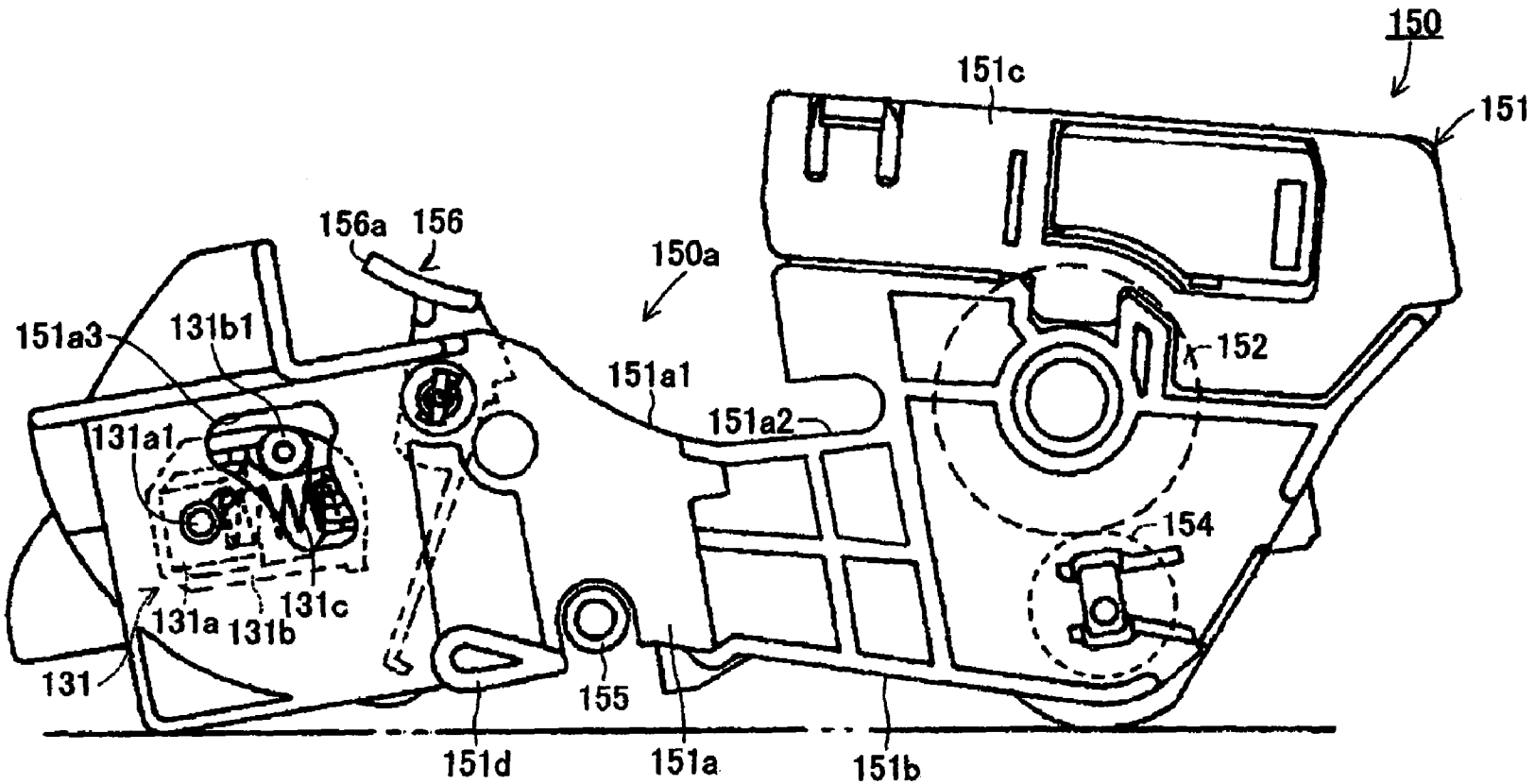
FIG. 6 is a side view of the photosensitive unit shown in FIG. 5.

FIG. 5 is a plane view of the photosensitive unit 150 shown in FIG. 2. That is, FIG. 5 is a diagram showing the photosensitive unit 150 in a state that the developing cartridge 140 is detached from the process cartridge 130. Also, FIG. 6 is a side view of the photosensitive unit 150 shown in FIG. 5. FIG. 5 is a side view corresponding to FIG. 3B (right side view).

With reference to FIG. 5 and FIG. 6, the photosensitive unit frame 151 includes a pair of side wall portions 151*a*, a bottom wall unit 151*b*, and an upper wall unit 151*c*.

The bottom wall unit 151*b* and the upper wall unit 151*c* are arranged such that they are bridged between the pair of side wall units 151*a*. In the space enclosed by the pair of side wall units 151*a* and the bottom wall unit 151*b*, a developing cartridge storage unit 150*a* is formed by the portion at the front of the upper wall unit 151*c* (upstream side in the paper feed direction; lower side in FIG. 5, and left side in FIG. 6). This developing cartridge storage unit 150*a* is formed such that it is opened upwards at the front side of the photosensitive unit frame 151. Also, the photosensitive drum 152 and the transfer roller 154 are stored in the space enclosed by the bottom wall unit 151*b* and the upper wall unit 151*c*.

A guide groove 151*a*1 is formed at the pair of side wall units 151*a*. With reference to FIG. 2, this guide groove 151*a*1 is configured such that it can contain the alignment collar 146 that is installed at both edges of the developing roller rotary driving shaft 144*a*. This guide groove 151*a*1 is configured so that when the developing cartridge 140 is installed in the photosensitive unit 150, the installation direction of the developing cartridge 140 can be guided by guiding the movement of the alignment collar 146. Also, the guide groove 151 al is configured so that when it is engaged with the alignment collar 146, the developing cartridge 140 and the photosensitive unit 150 can be aligned. With reference to FIG. 6, an edge portion 151*a*2 at the deepest side of the guide groove 151*a*1 is formed to be almost straight in order to perform the alignment.

With reference to FIG. 5 and FIG. 6, an urging mechanism 131 is installed inside of the pair of side wall units 151*a*. Guide holes 151*a*3 that are relatively large through holes are formed respectively at the pair of side wall units 151*a* so that a part of the urging mechanism 131 (a moving active unit 131*b*1 as will be explained later) is exposed to the outside.

A guide protrusion 151*d* protrudes from outside of the pair of side wall units 151*a*. The protrusion 151*d* is formed such that when the photosensitive unit 150 is attached to and detached from the body frame 111 (See FIG. 1) in the body portion 110 in the monochrome laser printer 100, it can be guided on the guiding surface formed on the internal surface at both sides of the body frame 111.

At the bottom of the photosensitive unit frame 151, the resist facing roller 155 is supported in a freely rotatable manner almost at the center portion in the paper feed direction.

A lock mechanism 156 is provided on the internal side of one of the side wall units 151*a* (right side in FIG. 5) in the photosensitive unit frame 151. As shown in FIG. 6, the lock mechanism 156 is supported in a freely rotatable manner by the side wall unit 151*a*.

With reference to FIG. 2, the lock mechanism 156 is configured such that the upper end of the projecting portion 141*e* (See FIGS. 3A and 3B) in the developing cartridge case 141 is stopped from the upper side when the developing cartridge 140 is installed in the photosensitive unit 150. That is, the lock mechanism 156 is used to maintain the developing cartridge case 141 within the photosensitive unit frame 151 in order to prevent the developing cartridge case 141 from dissociating upwards from the photosensitive unit frame 151. Also, the lock mechanism 156 is configured such that the lock of the developing cartridge 140 relative to the photosensitive unit 150 can be released by pressing the lever operating unit 156*a*.

Again with reference to FIG. 5, multiple rollers 157 are disposed at the positions facing the developing cartridge storage unit 150*a* on the upper wall surface at the front side in the bottom wall unit 151*b* (lower side in the figure). The rollers 157 are installed at two positions at both the right and left sides of the developing cartridge storage unit 150*a* in this aspect. The rollers 157 are supported by the bottom wall unit 151*b* in a freely rotatable manner.

These rollers 157 are configured such that when storing the developing cartridge 140 (See FIGS. 3A and 3B) in the developing cartridge storage unit 150*a*, the bottom plate 141*b* of the developing cartridge case 141 is received and rotated so that a portion of the weight of the developing cartridge 140 can be received as well as guiding the attachment and detachment of the developing cartridge 140.

Detailed Configuration of the Urging Mechanism

Figure 7:
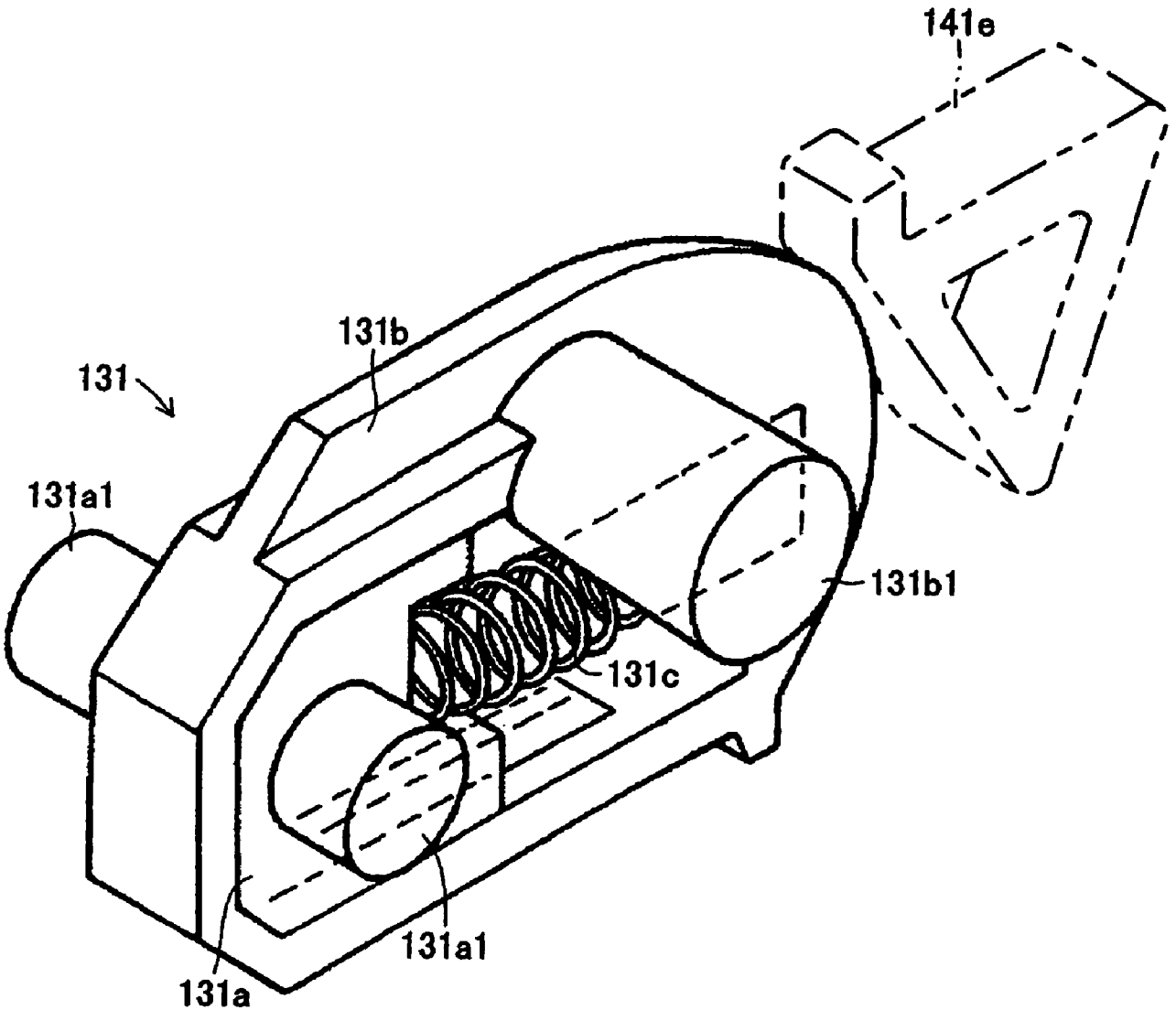
FIG. 7 is a magnified perspective view of a pressing mechanism of the photosensitive unit shown in FIG. 6.

FIG. 7 is an enlarged perspective view of the urging mechanism 131 shown in FIG. 6.

With reference to FIG. 6 and FIG. 7, the urging mechanism 131 includes a rotation fulcrum member 131*a*, a slide supporting member 131*b*, and an urging spring 131*c*.

At the side of the rotation fulcrum member 131*a* is a rotation axis 131*a*1. The rotation axis 131*a*1 is supported by the side wall unit 151*a* in a freely rotatable manner. The rotation fulcrum member 131*a* is supported in a freely sliding manner inside of the slide supporting member 131*b*.

The slide supporting member 131*b* is formed in a frame shape having a space inside. In this inner space, the rotation fulcrum member 131*a* and the urging spring 131*a* are stored. Also, a columnar moving action unit 131*b*1 is integrally formed extending in the side direction from the slide supporting member 131*b*. The moving action unit 131*b* protrudes outside of the side wall unit 151*a* in the photosensitive unit frame 151 via the guide holes 151*a*3.

The urging spring 131*c* includes coil springs. The urging spring 131*c* is arranged to bridge one end in the space inside of the slide supporting member 131*b* and the rotation fulcrum member 131*a*. The urging spring 131*c* is configured and arranged such that the one end of the slide supporting member 131*b* can be urged in a direction away from the rotation fulcrum member 131*a*, that is in a direction towards the projecting portion 141*e*.

Figure 8:
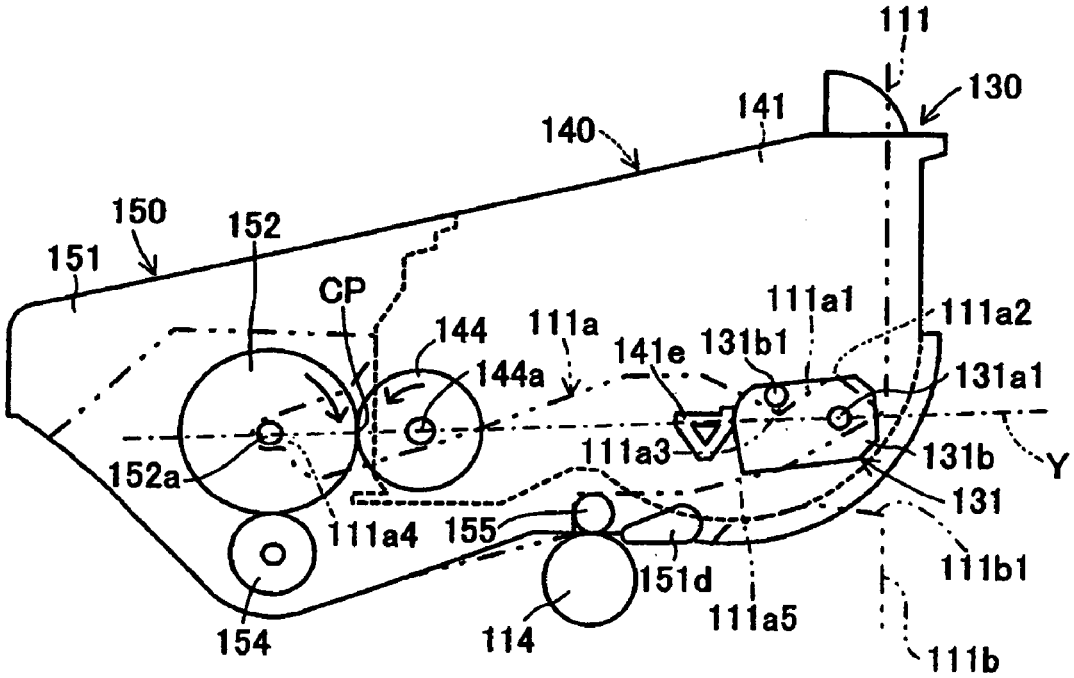
FIG. 8 is a schematic side view illustrating mounting and removal of the process cartridge from a unit frame of the image formation apparatus shown in FIG. 1.
Figure 9:
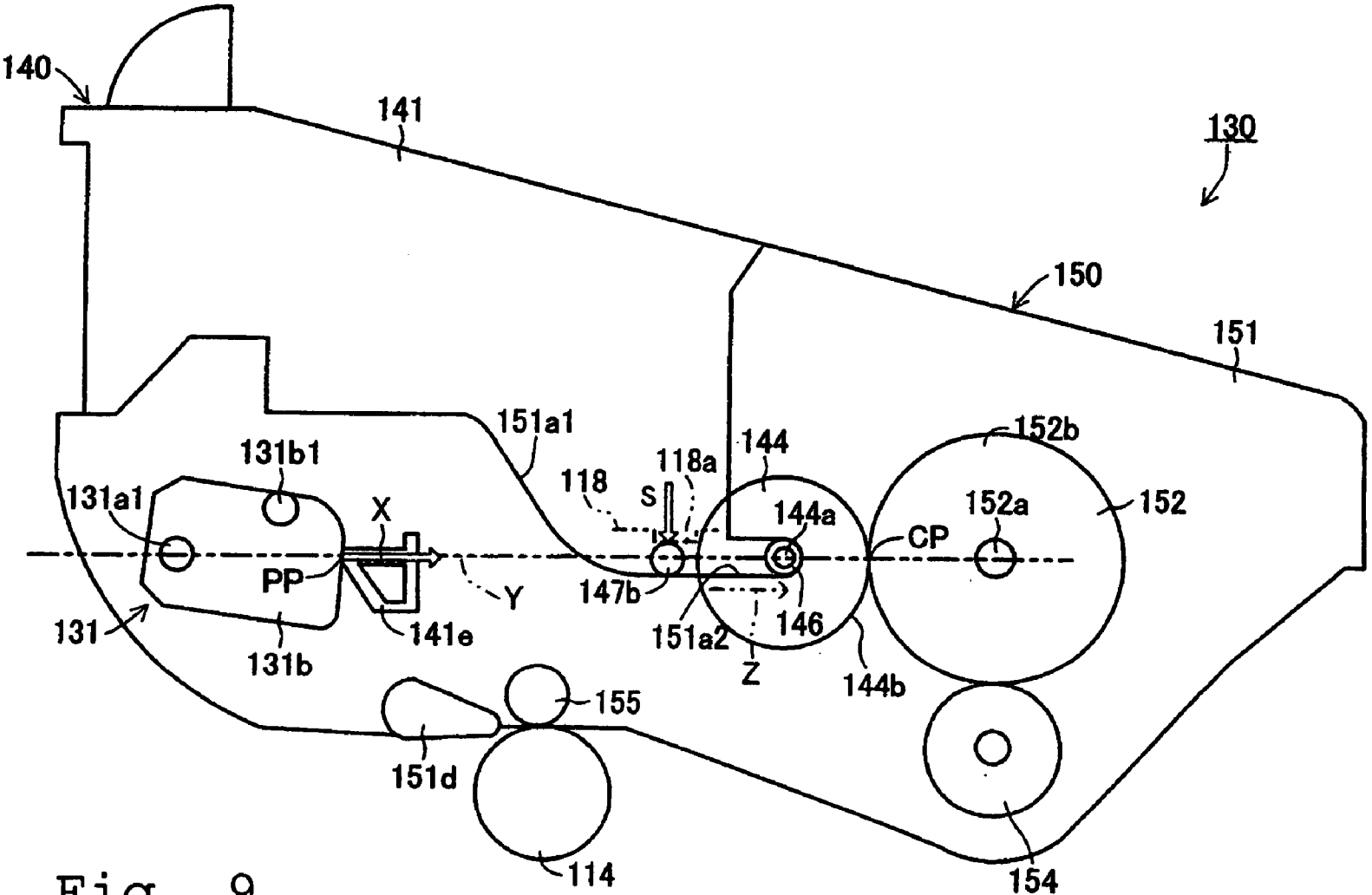
FIG. 9 is a magnified view of the process cartridge shown in FIG. 8.

Detailed Configuration Regarding Pressing and Supplying Electric Potential to the Development Cartridge FIG. 8 is a schematic view from the side in order to explain the status of installations of the body frame 111 and the process cartridge 130 shown in FIG. 1. FIG. 9 is an enlarged view of the process cartridge 130 shown in FIG. 8. That is, it shows how the process cartridge 130 is installed in the body frame 111 in order to start an image forming operation.

With reference to FIG. 8, in the body frame 111, an upper guide protrusion 111*a* and a lower guide protrusion 111*b* are provided to be protruded in the lateral direction and inside.

The upper side guide surface 111*a*1 in the upper guide protrusion 111*a* is formed such that the drum shaft 152*a* in the photosensitive drum 152 and the moving action unit 131*b* in the urging mechanism 131 can be guided. That is, the edge of the front side in the upper side guide surface 111*a*1 is formed when installing the process cartridge 130 in the body frame 111 to perform specific pressing operations to the urging mechanism 131 by guiding the moving action unit 131*b*. Also, the edge of the back side in the upper side guide surface 111*a*1 is formed when installing the process cartridge 130 in the body frame 111 such that the photosensitive drum 152 is arranged at a specific position in the body frame 111 by guiding the drum shaft 152*a*.

Specifically, in the upper side guide surface 111*a*1, an upper side guide peak 111*a*2, an upper side guide concavity 111*a*3, and a drum shaft storage unit 111*a*4 are formed.

The upper side guide peak 111*a*2 and the upper side guide concavity 111*a*3 are formed at an edge of the front side in the upper side guide surface 111*a*1. The upper side guide concavity 111*a*3 is formed to contain the moving action unit 131*b*1 advancing to the back side beyond the upper guide peak 111*a*2. Since the moving action unit 131*b*1 is contained in the upper side guide concavity 111*a*3, the urging mechanism 131 can press the projecting portion 141*e* installed in the developing cartridge case 141 in a specific direction. The drum shaft storage unit 111*a*4 is in contact with the drum shaft 152*a* at the edge of the back side in the upper guide surface 111*a*1 that is formed in order to contain the drum shaft 152*a*.

A guide groove that can guide the guide protrusion 151*d* in the photosensitive unit frame 151 is formed between the mid guide surface 111*a*5, which is the surface at the opposite side (lower side) to the upper side guide surface 111*a*1 in the upper guide protrusion 111*a*, and the lower side guide surface 111*b*1 that is the upper side surface in the lower side guide protrusion 111*b*.

With reference to FIG. 9, in the state that the developing cartridge 140 is installed in the photosensitive unit 150 so that image forming operation can be performed, the projecting portion 141*e* installed in the developing cartridge case 141 is urged in the developing cartridge pressing direction X as indicated by the arrow in the figure at the pressing position PP by the slide supporting member 131*b* of the urging mechanism 131 installed in the photosensitive unit frame 151. The developing cartridge pressing direction X is specifically a direction towards the pressing position PP from the rotation axis 131*a*1. The alignment collar 146 installed at both ends of the developing roller driving shaft 144*a* is in contact with the edge portion 151*a*2 in the guide groove 151*a*1 formed at the side wall unit 151*a* of the photosensitive unit frame 151 due to this force.

By bringing the alignment collar 146 in contact with the edge portion 151*a*2, an alignment is made between the developing roller driving shaft 144*a* and the drum shaft 152*a*. That is, the toner carrying surface 144*b* of the developing roller 144 is in contact with the image carrying surface 152*b* of the photosensitive drum 152 at the contact point CP in a specific mode (pressure). The contact point CP is formed on the line drawn by connecting the center of the developing driving shaft 144*a* and the center of the drum shaft 152*a*. The contact point CP is also called a "developing position."

As shown in FIG. 9, the pressing action line Y that connects the pressing point PP and the contact point CP is formed parallel to the guiding direction Z wherein the alignment collar 146 (developing roller driving shaft 144*a*) moves along the edge portion 151*a*2 in the guide groove 151*a*1 in this aspect. Also, in this aspect, the electrical connection protrusion 147*b* is arranged to cross with the pressing action line Y.

An electrical connection member 118 is arranged to be in contact with the electrical connection protrusion 147*b*. The electrical connection member 118 is formed by bending a conductive material such as wire in a rectangular shape in this illustrative aspect. In the electrical connection member 118, a electrical connection facing portion 118*a* that faces the electrical connection protrusion 147*b* is formed in a flat shape. The electrical connection member 118 is installed at the body frame 111 of the monochrome laser printer 100 (See FIG. 1) or in the photosensitive unit frame 151.

When the electrical connection facing portion 118*a* and the electrical connection protrusion 147*b* are in contact with each other while the electrical connection facing portion 118*a* in the electrical connection member 118 presses the electrical connection protrusion 147*b*, the electrical connection member 118 and the electrical connection protrusion 147*b* are electrically connected. That is, a specific developing bias voltage is applied between the developing roller 144 and the photosensitive drum 152 via the electrical connection member 118 and the electrical connection protrusion 147*b*.

In this aspect, the process cartridge 130 and the electrical connection member 118 are configured such that the electrical connection pressing direction S, which is the direction in which the electrical connection member 118 presses the electrical connection protrusion 147*b*, is perpendicular to the pressing action line Y and the longitudinal direction of the developing roller driving shaft 144*a*. Also, in this aspect, the process cartridge 130 and the electrical connection member 118 are configured such that the electrical connection pressing direction S is perpendicular to the guiding direction Z. Furthermore, in this aspect, the electrical connection member 118 is configured such that the electrical connection facing portion 118*a* becomes parallel to the guiding direction Z.

Overview of the Image Forming Operation Using a Laser Printer

An overview of the image forming operation using a monochrome laser printer 100 having the aforementioned configuration is explained below with reference to FIG. 1.

Operation of Paper Supply

Sheets of paper are stored in a stacked state in a feeder case 121. Sheets are urged upward to the sheet supply roller 113 by the sheet pressing plate 122. As a result, the top sheet in the feeder case 121 is in contact with the surface of the sheet supply roller 113.

When the sheet supply roller 113 is rotated in a counter-clockwise direction in FIG. 1, the tip of the top sheet moves towards the right side. Of course, due to friction among the sheets, not only the top sheet, but also several sheets underneath may also move towards the right side along with the top sheet. In this case, the tips of the several sheets from the top sheet in the feeder case 121 are pinched between the sheet supply roller 113 and the separation pad 123.

When the sheet supply roller 113 is further rotated in a counter-clockwise in the figure, only the top sheet P is separated due to the difference between the friction force among the sheets P and the friction force between the sheet P and the separation pad 123 that is supplied in the paper feed direction. Subsequently, the top sheet is conveyed towards the resist position where the resist facing roller 155 and the resist roller 114 are in contact with each other.

When the tip of the sheet is pushed to the resist position, the inclination of the sheet is corrected. Subsequently, the resist roller 114 is rotated at a specific timing. Along with the rotation of the resist roller 114, a resist facing roller 155 is rotated. As a result, the sheet is conveyed towards the transfer position, which is the position at which the photosensitive drum 152 faces with the transfer roller 154. In this manner, the inclination of the sheet is corrected and the conveyance timing is adjusted.

Subsequently, the sheet enters the process cartridge 130. A toner image is formed (transferred) on the upper surface of the sheet at the transfer position in the process cartridge 130.

Formation of Electrostatic Latent Images

While the sheet is conveyed to the transfer position as mentioned above, a toner image is carried as described below on the surface of the photosensitive drum 152.

The surface of the photosensitive drum 152 is initially charged uniformly by the charger 153. The surface of the photosensitive drum 152 charged by the charger 153 is rotated in the direction shown by the arrow in figure showing the photosensitive drum 152 (clockwise direction). During this rotation, a laser beam is emitted by the scanner unit 160 to the surface. This laser beam is scanned along the lateral direction by the rotation of the polygon mirror 162. Also, the laser beam is produced based on the image data. That is, the emission status of the laser beam (ON/OFF pulse shape) is modulated according to the image data.

When the modulated laser beam is scanned on the surface of the photosensitive drum 152, electrostatic latent images are formed on the surface. The surface of the photosensitive drum 152 wherein electrostatic latent images are formed is rotated in the direction indicated by the arrows in the figure (clockwise direction) and carried to the position of which it is in contact with or closely in contact with the surface of the developing roller 144.

Developing the Electrostatic Latent Images and Transferring the Toner Images

As mentioned above, the developing roller 144 and supply roller 143 are rotated in the direction indicated by the arrows in the figure (counterclockwise direction). At the point when the surface of the developing roller 144 is in contact with the supply roller 143, there is friction between the two rollers. Due to this friction, charged toners are carried on the surface of the developing roller 144. Subsequently, when the toner layer thickness regulating blade 145 is in contact with the developing roller surface, an amount of toner to be carried on the surface is set at a specified value.

The surface of the developing roller 144 on which a specific amount of toner is carried is rotated in the direction indicated by the arrow (counterclockwise direction) in the figure to reach such a position that it faces the photosensitive drum 152.

When the surface of the photosensitive drum 152 on which electrostatic latent images are formed is brought into contact with the surface of the developing roller 144 carrying the charged toner, the toner adheres to the surface in the pattern corresponding to the electrostatic latent images formed on the surface of the photosensitive drum 152. That is, the electrostatic latent images on the surface of the photosensitive drum 152 are developed by the toner and the toner images are transferred to the surface.

As described above, the toner images carried on the surface of the photosensitive drum 152 are conveyed towards the transfer position by rotating the surface in a clockwise direction in the figure. Subsequently, the toner images are transferred at the transfer position from the surface of the photosensitive drum 152 to a sheet of paper.

Fixing/Sheet Delivery

The sheet on which the toner images are formed (transferred) at the transfer position as described above is discharged from the process cartridge 130. Subsequently, the sheet on which the toner images have been transferred is carried along the paper feed passage PFP to a fixing unit 170. The sheet on which the toner images have been transferred is heated while being pressed when it is inserted into the space between the heat roller 171 and the pressure roller 172. As a result, toner images are fixed on the surface of the sheet.

Subsequently, the sheet after completing the fixing process is carried in the paper feed direction by rotating the heat roller 171 and the pressure roller 172 in the direction indicated by the arrow in the figure. While guided with the paper guide 115, the sheet is sent towards the space between the paper exit roller 116 and the paper exit sub-roller 117.

Subsequently, when the paper exit roller 116 is rotated in a counterclockwise direction in the figure, the fixed paper is discharged from the paper exit outlet 112*b*2 to the paper exit tray 112*b*1.

Installation of a Developing Cartridge in the Photosensitive Unit

Installation of the developing cartridge 140 in the photosensitive unit 150 is described below with reference to FIG. 4 through FIG. 6.

A developing cartridge 140 is inserted from the side of the developing roller 144 relative to the developing cartridge storage unit 150*a* that is formed to open towards the upper side at the front side of the photosensitive unit frame 151. That is, the developing cartridge 140 is inserted into the developing cartridge storage unit 150*a* such that the alignment collar 146 is inserted into the groove 151*a*1. While the alignment collar 146 slides with the guide groove 151*a*, it is guided towards the drum shaft 152*a* due to the guide groove 151*a*. Also, the bottom surface of the developing cartridge case 141 is in contact with the roller 157.

The developing roller driving shaft 144*a* can be rotated smoothly within the alignment collar 146. When the alignment collar 146 reaches the edge portion 151*a*2 at the deepest section in the guide groove 151*a*1, the developing cartridge 141 is stored in the developing cartridge storage unit 150*a* by rotating downwards around the developing roller driving shaft 144*a* and the alignment collar 146 as the center.

As mentioned above, the movement of the developing cartridge case 141 in the developing cartridge storage unit 150*a* can be guided smoothly in such a direction that the developing roller 144 approaches the photosensitive drum 152. Subsequently, the alignment collar 146 is guided along the specific guiding direction (guiding direction Z in FIG. 9) by the edge portion 151*a*2 in the guide groove 151*a*.

When the alignment collar 146 is in contact with the edge portion 151*a*2, the developing roller 144 and the photosensitive drum 152 are aligned. As a result, the toner carrying surface 144*b* in the developing roller 144 and the image carrying surface 152*b* in the photosensitive drum 152 are brought into contact in a specific mode. Also, when the alignment collar 146 is in contact with the edge portion 151*a*2, the developing cartridge case 141 is locked by the lock mechanism so that it is not thrown out from the developing cartridge storage unit 150*a*.

In contrast, when detaching the developing cartridge 140 from the photosensitive unit 150, the lever operation unit 156*a* is pressed down in the lock mechanism 156. As a result, the lock for the developing cartridge case 141 due to the lock mechanism 156 is released. Subsequently, due to relative rotation between the developing roller driving shaft 144*a* and the alignment collar 146 and smooth sliding between the alignment collar 146 and the guide groove 151*a*, the movement of the developing cartridge 140 is smoothly guided into the photosensitive unit 150. As a result, the developing cartridge 140 can be easily detached from the photosensitive unit 150.

Installation of the Process Cartridge in the Body Frame

Subsequently, installation of the process cartridge 130 assembled by installing the developing cartridge 140 in the photosensitive unit 150 in the body frame 111 is described below with reference to FIG. 8 through FIG. 10.

With reference to FIG. 10A, at the initial period when installing the process cartridge 130 in the body frame 111, the slide supporting member 131*b* in the urging mechanism 131 rotates downwards due to its own weight around the rotary axis 131*a*1 in the rotary fulcrum member 131*a* in order to be in a hung down state.

Also, the guide protrusion 151*d* in the photosensitive unit frame 151 is inserted into the opening portion (right side end in the figure) of the guide groove formed between the mid guide surface 111*a*5 in the upper side guide protrusion 111*a* and the lower side guide surface 111*b*1 in the lower side guide protrusion 111*b*. As a result, the ascending position of the process cartridge 130 is regulated by the mid guide surface 111*a*5. The process cartridge 130 is inserted downwards diagonally to the left along the mid guide surface 111*a*5 and the lower side guide surface 111*b*1 in such a state that passing upwards in the figure is prevented.

When the process cartridge 130 is moved to the left in FIGS. 10A and 10B and inserted into the inside of the body frame 111, as shown in FIG. 10A, the movement action unit 131*b* in the urging mechanism 131 is in contact with the starting inclined surface at the front side of the upper guide peak 111*a*2 in the upper side guide surface 111*a*1. As a result, the slide supporting member 131*b* in the urging mechanism 131 starts rotating upwards in the figure around the rotary axis 131*a*1. Due to this rotation, the slide supporting member 131*b* comes in contact with the projecting portion 141*e* in the developing cartridge case 141 in order to start urging the projecting portion 141*e*.

When the process cartridge 130 is further inserted in the body frame 111, the slide supporting member 131*b* further moves upwards, and the projecting portion 141*e* in the developing cartridge case 141 is further pressed by a greater force due to the slide supporting member 131*b* than that in the state shown in FIG. 10A. Then, the movement action unit 131*b*1 reaches right above the upper side guide peak 111*a*2 in the upper side guide surface 111*a*1. In this state, the projecting portion 141*e* pressed by the slide supporting member 131*b* becomes the maximum. In this case, the slide supporting member 131*b* is in such a state that it is slightly inclined downwards from the horizontal level (the free end side of the slide supporting member 131*b* is slightly lower than the rotary axis 131*a*1).

Subsequently, as shown in FIG. 10B, the movement action unit 131*b*1 crosses over the upper guide peak 111*a*2. In this state, the movement action unit 131*b*1 is elastically urged in the direction away from the rotary fulcrum member 131*a* so that the slide supporting member 131*b* rotates downwards due to this urging force around the rotary axis 131*a*1. Also, the force between the slide supporting member 131*b* and the projecting portion 141*e* is slightly more relaxed than that in the state when the movement action unit 131*b*1 is immediately above the upper guide peak 111*a*2. Therefore, the movement action unit 131*b*1 crosses the upper guide peak 111*a*2 so that the force in the direction contained in the upper guide concavity 111*a*3 is generated in a stable manner.

In the aspect, as mentioned above, as the process cartridge 130 is inserted (movement by pushing downwards in a diagonal direction) the movement action unit 131*b*1 is pushed up by the upper guide surface 111*a*. Subsequently, the slide supporting member 131*b* rotates upwards around the rotary axis 131*a*1. In this case, the process cartridge 130 is regulated for elevation due to the mid guide surface 111*a*5. As a result, while the process cartridge 130 is inserted, the operation, of which the projecting portion 141*e* in the developing cartridge 141 is pressed by the slide supporting member 131*b*, is maintained without being cancelled.

When the process cartridge 130 is further pushed and the operator releases the hands from the process cartridge 130 in such a state that the drum shaft 152*a* is in contact with the drum shaft storage unit 111*a*4, as shown in FIG. 8, the operation of installation of the process cartridge 130 into the body frame 111 is completed. In this state, due to the weight of the process cartridge 130, the resist facing roller 155 supported at the bottom of the photosensitive unit frame 151 is placed on the resist roller 114. Also, the movement action unit 131*b*1 is maintained at the lowest position of the upper guide concavity 111*a*3. Moreover, the guide protrusion 151*d* is supported at the specific location in the guide groove formed between the mid guide surface 111*a*5 and the lower side guide surface 111*b*1. Therefore, the state wherein the developing cartridge 140 is pressed against the photosensitive drum 152 is maintained while the process cartridge 130 can be stably supported by the body frame 111.

As explained above, in the state wherein the process cartridge 130 is installed in the body frame 111, as shown in FIG. 9, the developing cartridge case 141 is pressed in the developing cartridge pressing direction as indicated by the arrow X in FIG. 9 against the photosensitive drum 152 by the urging mechanism 131 and the projecting portion 141*e*. As a result, the toner carrying surface 144*b* on the developing roller 144 and the image carrying surface 152*c* on the photosensitive drum 152 are in contact in a specified mode at the contact point CP.

The developing cartridge pressing direction X shares the same axis as the pressing action line Y. Also, the developing cartridge pressing direction S and the pressing action line Y are parallel to the guiding direction Z.

Also, the electrical connection protrusion 147*b* is pressed in the electrical connection pressing direction S by the electrical connection member 118. As a result, electric potential is supplied from the electrical connection member 118 via the electrical connection protrusion 147*b* to the developing cartridge 140. In addition, a specific developing bias voltage is applied at the contact point CP (developing position). In this case, the electrical connection pressing direction S, in which the electrical connection member 118 presses the electrical connection protrusion 147*b*, is almost perpendicular to the developing cartridge pressing direction X, the pressing action line Y, and the guiding direction Z.

Actions and Effects of the Configuration of Aspects

Next, the actions and effects of the configuration of the aforementioned aspects are described below with references to the drawings.

In some aspects, the conductive member 147 is configured such that the electrical connection member 118 for applying a developing bias to the developing roller 144 and the developing roller driving shaft 144*a* are electrically connected. The electrical connection protrusion 147*b* in the conductive member 147 is configured to be exposed to the outside from the photosensitive unit frame 151. When the developing cartridge 140 is installed in the body frame 111, the electrical connection protrusion 147*b* is perpendicular to the longitudinal direction of the developing roller driving shaft 144*a* of the developing roller 144 (rotary axial line) by the electrical connection member 118, and it is arranged to be pressed in a direction perpendicular to the developing cartridge pressing direction X.

Therefore, the force from the electrical connection member 118 to the electrical connection protrusion 147*b* does not act in the developing cartridge pressing direction X. Thus, the developing cartridge 140 is stable without being damaged and is maintained in the photosensitive unit 150. Therefore, this can prevent the contact state between the photosensitive drum 152 and the developing roller 144 from becoming unstable, maintaining high image quality.

Also, the electrical connection protrusion 147*b* is arranged to be perpendicular to the rotary axial line of the developing roller 144 by the electrical connection member 118, and to be pressed in the direction perpendicular to the pressing action line Y (pressing action direction) connecting the pressing position PP and the contact position CP.

The force applied by the electrical connection member 118 to the electrical connection protrusion 147*b* does not act in the pressing action direction. Therefore, the contact state between the photosensitive drum 152 and the developing roller 144 is stabilized, achieving high image quality.

The electrical connection protrusion 147*b* is arranged to be pressed by the electrical connection member 118 on the pressing action line. Therefore, damage to the developing cartridge 140 can be prevented. Thus, the contact state between the photosensitive drum 152 and the developing roller 144 becomes more stable and further improvement in image quality is assured.

In some aspects, at the upper edge of both left and right side wall units 151*a* of the photosensitive unit frame 151, when installing the developing cartridge 140 in the photosensitive unit 150, a guide groove 151*a*1 is formed in order to guide the developing roller driving shaft 144*a* (alignment collar 146). When the developing cartridge 140 installed in the body frame 111 is pressed by the urging mechanism 131, the developing roller 144 is pressed in contact with the photosensitive drum 152 while the developing roller driving shaft 144*a* moves along the edge portion 151*a*2 at the deepest part of the guide groove 151*a*1.

In these aspects, the electrical connection protrusion 147*b* of the conductive member 147 is perpendicular to the rotary axial line of the developing roller 144 by the electrical connection member 118, and the guide groove 151*a*1 at the deepest side (edge portion 151*a*2) is pressed in the direction perpendicular to the guiding direction Z for guiding the developing roller driving shaft 144*a*. Thus, the force applied by the electrical connection member 118 to the electrical connection protrusion 147*b* does not have any effect on the guiding direction Z at the deepest side. Therefore, the effects of the pressure by the electrical connection member 118 to the electrical connection protrusion 147*b* on the contact of the developing roller 144 to the photosensitive drum 152 at the contact position CP can be absolutely minimized. As a result, while damage to the developing cartridge 140 is depressed, a specific contact state of the developing roller 144 with the photosensitive drum 152 at the contact position CP can be absolutely maintained in a stable manner so that higher image quality can be maintained.

According to these aspects, the electrical connection facing portion 118*a* in the electrical connection member 118 is parallel to the guiding direction Z. As a result, a satisfactory electrical contact state between the electrical connection facing portion 118*a* and the electrical connection protrusion 147*b* can be formed at an early stage, while force can be applied to the contact position CP of the developing roller 144.

Example of Modified Case of the Above Aspects

According to certain aspects, the electrical connection protrusion 147*b* of the conductive member 147 can be arranged on the pressing action line connecting the pressing position PP and the contact position CP as shown in FIG. 9. Of course, the positions where the conductive member 147 and the electrical connection protrusion 147*b* are arranged are not limited by these examples. That is, any pressing positions are applicable as long as they are perpendicular to the axial line of the developing roller 144 by the specified electrical connection member, in the direction perpendicular to the developing cartridge pressing direction X of the urging mechanism 131, and in the direction perpendicular to the pressing action line Y (pressing action direction) connecting the pressing positions PP and the contact position CP.

Figure 11:
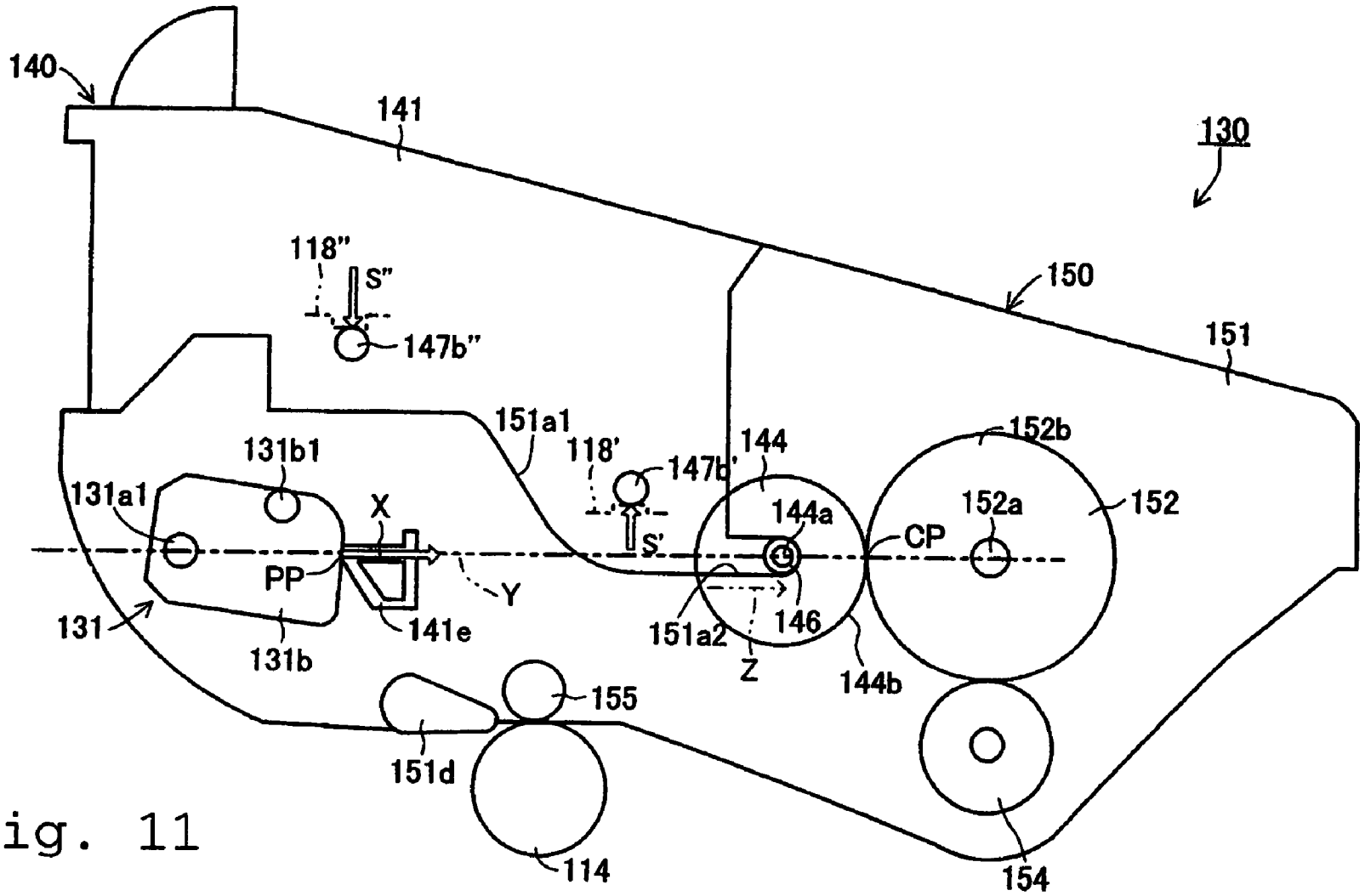
FIG. 11 is a schematic side view illustrating another possible formation of the process cartridge in the aspects shown in FIG. 9.

For example, as shown in FIG. 11, the electrical connection protrusion 147*b*' and the electrical connection protrusion 147*b*" can be arranged at positions that are away from the pressing action line Y.

The electrical connection protrusion 147*b* can be arranged perpendicular to the axial line of the developing roller 144, or can be arranged in the direction perpendicular to one of the following directions: developing cartridge pressing direction X or the pressing action line Y connecting the pressing position PP and the contact position CP (pressing action direction). In this case, the contact of the electrical connection member 118 to the conductive member 147 has little effect on the developing cartridge pressing direction X or pressing action direction. Thus, damage to the developing cartridge 140 can be prevented. Therefore, the contact of the developing roller 144 with the photosensitive drum 152 at the contact position CP can be maintained in a stable manner, keeping the high image quality.

According to some aspects, the electrical connection pressing direction S by the electrical connection member 118 to the electrical connection protrusion 147*b* is set in an up and down direction. Of course, as shown in FIG. 11, the electrical connection member 118' can press the lower side of the electrical connection protrusion 147*b*. That is, the electrical connection pressing direction S' can be the up and down direction. Moreover, as shown in FIG. 11, an upward electrical connection pressing direction S' by the electrical connection member 118' and the downward electrical connection pressing direction S" by the electrical connection member 118" can be both present.

The electrical connection member 118 can be formed by bending a conductive line material such as wire into a rectangular shape. The electrical connection protrusion 147*b* can be pressed by the electrical connection facing portion 118*a*, which includes a flat portion. Of course, the electrical connection member 118 can be formed in any shape other than that mentioned above as long as it can press against the electrical connection protrusion 147*b* in a stable manner.

According to some aspects, the urging mechanism 131 can be provided in the photosensitive unit 150. Also, when the photosensitive unit 150 is inserted in the body frame 111, the moving action unit 131*b*1 of the urging mechanism 131 can be guided on the guiding surface formed on the interior surface at both left and right sides of the body frame 111. In addition, when the tip of the slide supporting member 131*b* presses the projecting portion 141*e* in the developing cartridge 140, the developing roller 144 presses against the photosensitive drum 152 via the developing cartridge 140.

Of course, the configuration for pressing the developing cartridge 140 is not limited by these examples. For example, an urging mechanism can be provided at the side of the body frame 111 rather than the photosensitive unit 150, and the developing roller 144 can be urged against the photosensitive drum 152 by the urging mechanism directly pressing the developing cartridge 140.

Moreover, the electrical connection member 118 for applying a developing bias to the developing roller 144 can be installed in the body frame 111. Alternatively, a cable electrode that is in contact with the specific output electrode installed in the body frame 111 can be installed in the photosensitive cartridge. In this case, this cable electrode functions as a electrical connection member.

The monochrome laser printer 100 according to some aspects can be configured such that after forming the process cartridge 130 by pre-installing the developing cartridge 140 in the photosensitive unit 150, the process cartridge 130 can be attached to and detached from the body frame 111. Of course, instead of this configuration, the developing cartridge 140 and the photosensitive unit 150 can be individually installed in a freely attachable and detachable manner to the body frame 111. In this case, the guide groove 151*a*1 for guiding the alignment collar 146 in a freely sliding matter has bearings at both ends of the developing driving shaft 144*a* protruding outwards at both sides of the developing cartridge 140 that can be formed in the body frame 111.

Overall Configuration of a Laser Printer According to an Illustrative Aspect

Figure 12:
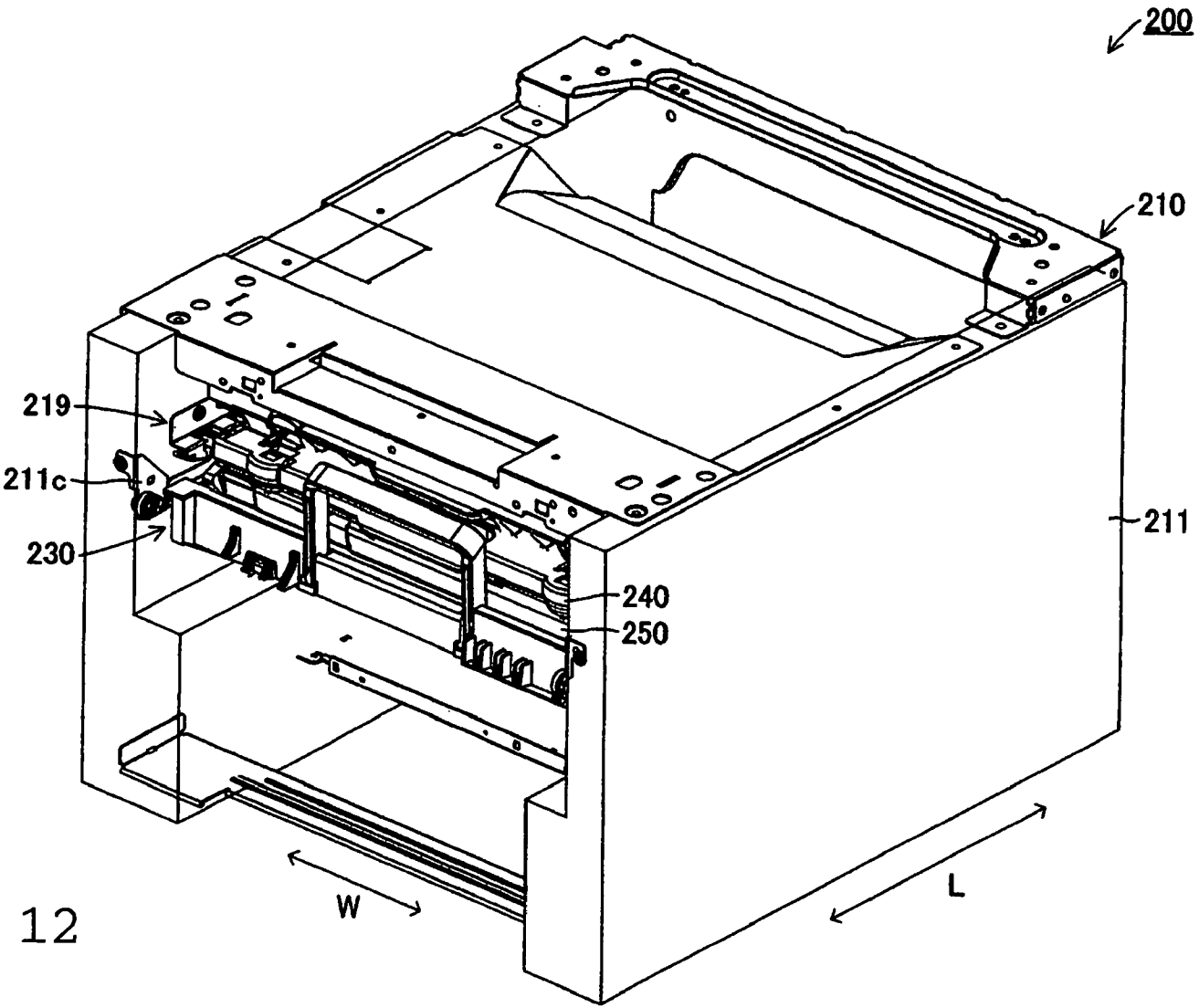
FIG. 12 is a perspective view of the color laser printer according to aspects of the present invention.

FIG. 12 is a perspective view of a color laser printer 200 of the image forming apparatus according to aspects of the present invention. FIG. 12 shows a state when the body cover is omitted as the external cover of the color laser printer. In the following explanation, the members having the similar structures and functions as in the aspects previously described have been expressed by the same symbols. For descriptions of the structures, actions and functions of these members, they can be appropriately employed in the range that the descriptions provided in previously described aspects are not technically redundant.

With reference to FIG. 12, the body frame 211 in the body portion 210 of the color laser printer 200 can contain the process unit 230 in a freely attachable and detachable manner. The process unit 230 may include multiple developing cartridges 240 and photosensitive units 250. The developing cartridge 240 is installed in the process unit 230 such that the longitudinal direction is parallel to the lateral direction of the color laser printer 200 (indicated by the arrow W in the figure). Multiple developing cartridges 240 and photosensitive units 250 are arranged along the front and back direction L.

A pair of slide guide frames 211*c* is installed on the wall surface inside of the body frame 211. The pair of slide guide frames 211*c* is configured to support the process unit 230 within the body frame 211. Also, the slide guide frame 211*c* is configured such that the process unit 230 can be attached to and detached from the body frame 211 by guiding along the front to back direction of the color laser printer 200 (indicated by the arrow L in the figure). The details of the configuration of the slide guide frame 211*c* will be discussed later.

On the wall surface inside of the body frame 211, a pair of linear cam mechanisms 219 is installed. Each linear cam mechanism 219 is configured such that multiple developing cartridges 240 that are oriented along the front to back direction L can be selectively pressed downward. The details of the configuration of a linear cam mechanism 219 will be discussed later.

The color laser printer 200 is configured such that using multiple developing cartridges 240 containing different types (colors) of toners, multiple types of toner images adhere on the surface of a recording medium (paper) and full color images are formed by fixing the images.

Overview of the Configuration of the Developing Cartridge

Figure 13:
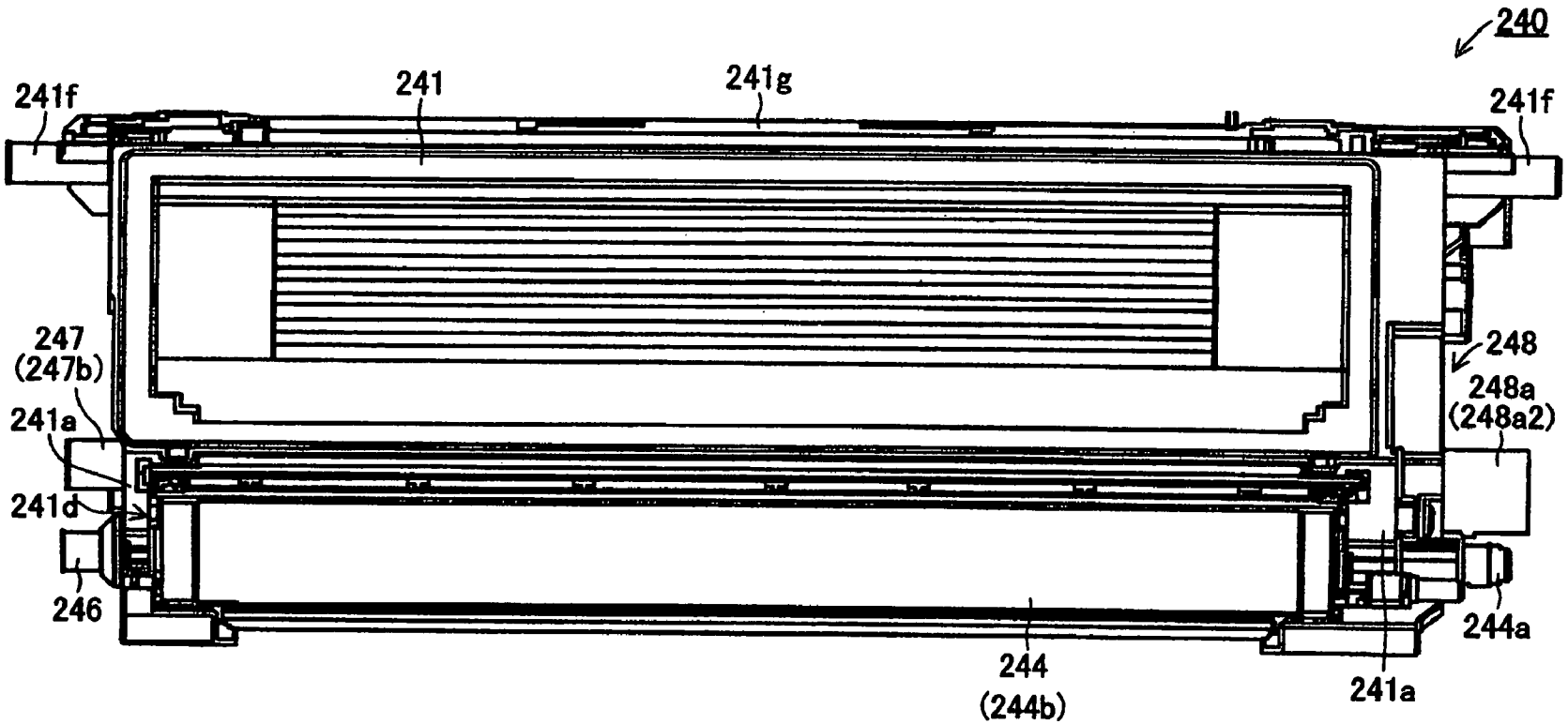
FIG. 13 is a front view of a developer cartridge of the color laser printer shown in FIG. 12.
Figure 14:
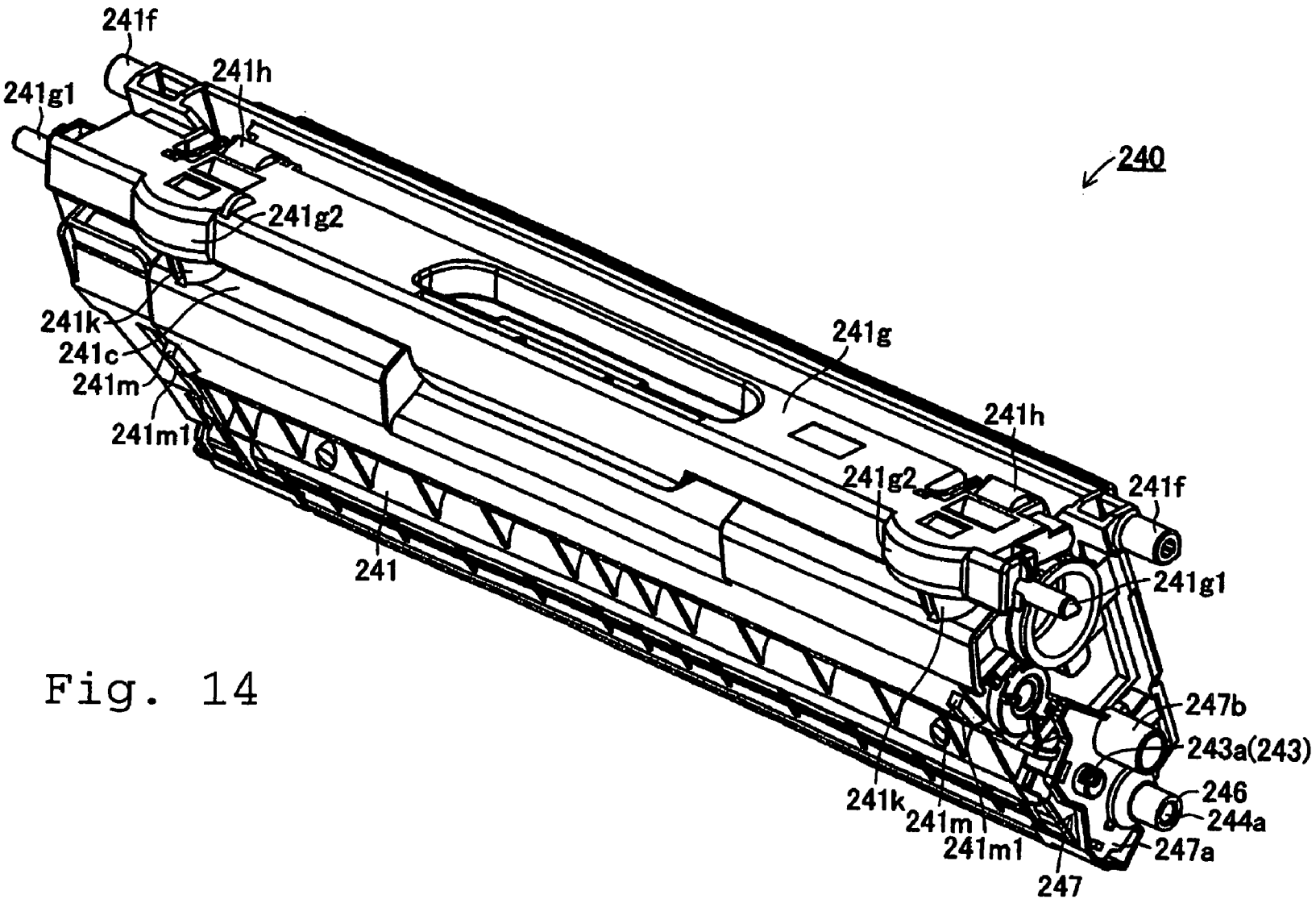
FIG. 14 is a perspective rear view of the developer cartridge shown in FIG. 13.
Figure 15:
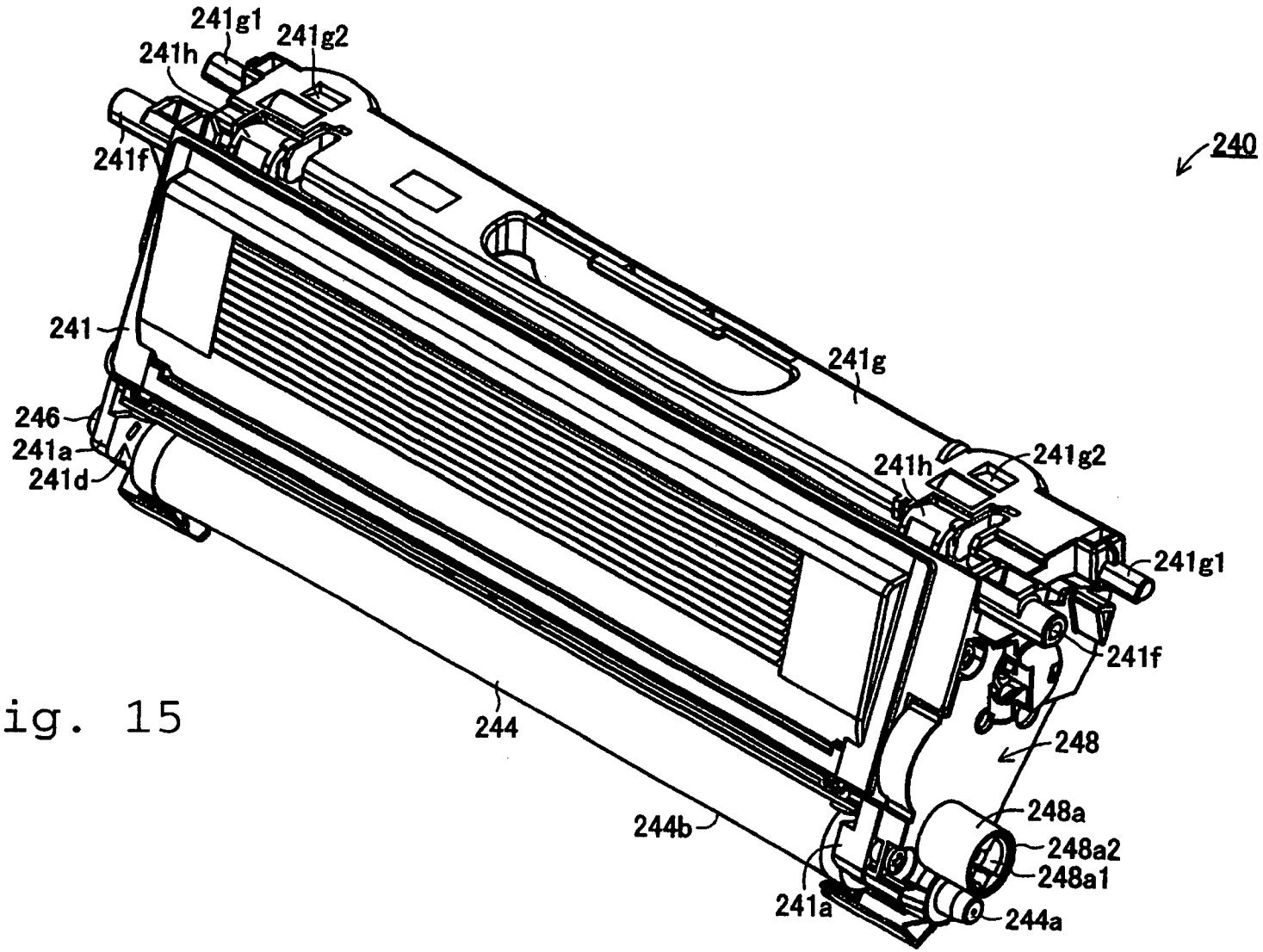
FIG. 15 is a perspective front view of the developer cartridge shown in FIG. 14.
Figure 16:
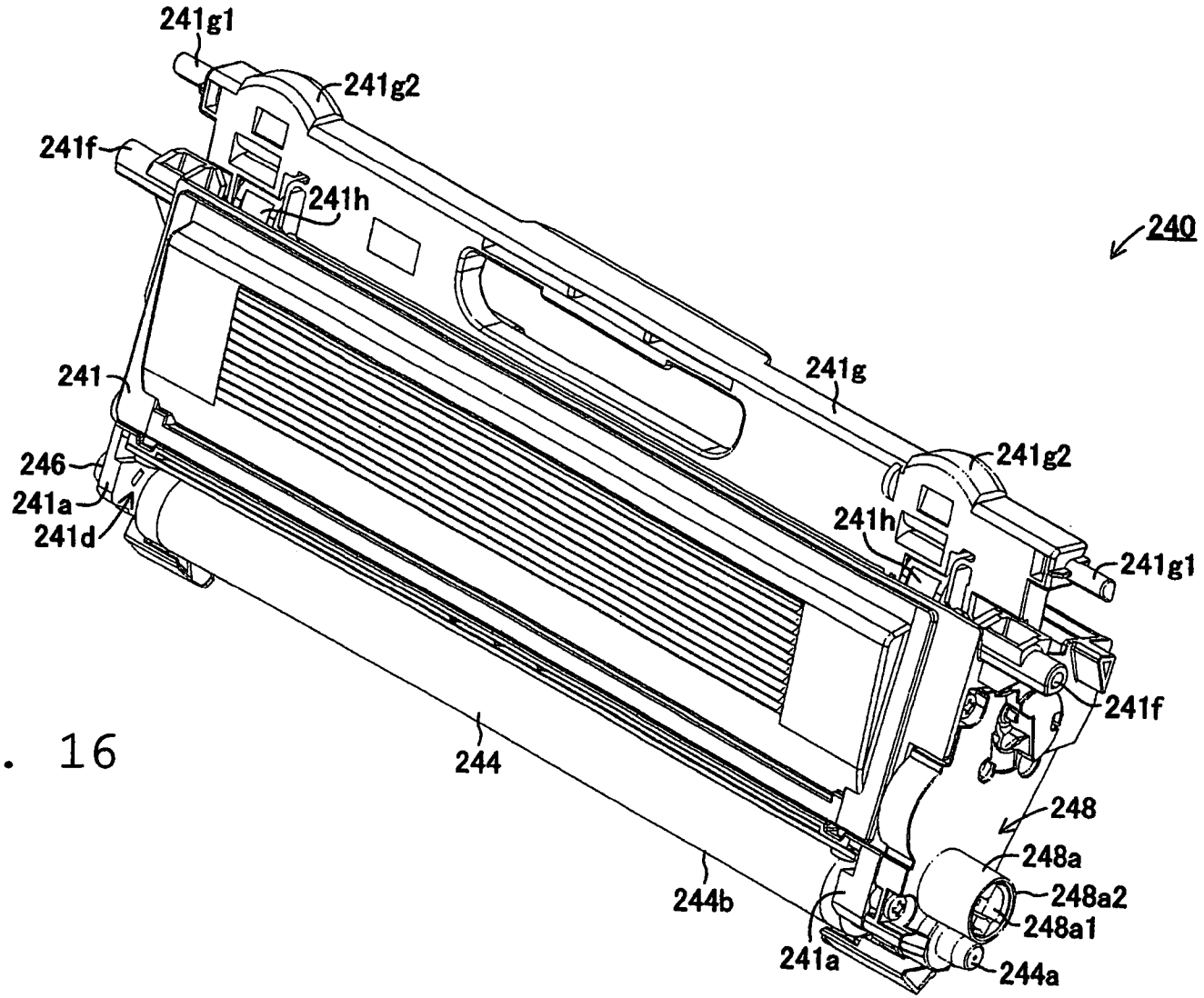
FIG. 16 is a perspective front view of the developer cartridge shown in FIG. 14.

FIG. 13 is a front view of the developing cartridge 240 shown in FIG. 12 (view from the back side of FIG. 12). FIG. 14 is a perspective view seen from the rear side of the developing cartridge 240 shown in FIG. 13 (viewed from the front side in FIG. 12). FIG. 15 and FIG. 16 are perspective views seen from the front side of the developing cartridge 240 shown in FIG. 13 (viewed from the back side in FIG. 12).

With reference to FIG. 13, a developing roller 244 is stored in the developing cartridge case 241. The developing cartridge case 241 is configured such that a portion of the toner carrying surface 244*b* on the developing roller 244 is exposed to the outside via the developing opening 241*d* formed at the lower end portion. The developing roller driving shaft 244*a* including the central axis of the developing roller 244 is supported in a freely rotatable manner by the pair of side plates 241*a* in the developing cartridge case 241.

Configuration of the Conductive Member and the Driving Force Input Unit

At the end of the developing roller driving shaft 244*a* corresponding to one side plate 241*a* (left side in the figure), an alignment collar 246 is installed. A conductive member 247 is installed at the side plate 241*a* at the side where the alignment collar 246 is installed. A driving force input unit 248 is installed at the other side plate 241*a* (right side in the figure).

With reference to FIG. 14, the conductive member 247 includes a base plate 247*a* and a electrical connection protrusion 247*b*. The base plate 247*a* is configured in a flat plate form. In the base plate 247*a*, through-holes are formed such that the supply roller driving shaft 243*a* and developing roller driving shaft 244*a* are inserted. The base plate 247*a* is electrically connected by bringing the base plate in contact with the supply roller driving shaft 243*a* and developing roller driving shaft 244*a*.

The electrical connection protrusion 247*b* is installed such that it protrudes outwardly from the base plate 247*a*. The outer surface of the electrical connection protrusion 247*b* is formed in a cylindrical shape. That is, the outer shape of the electrical connection protrusion 247*b* is almost circular when viewed from the side along the lateral direction. The outer surface of the electrical connection protrusion 247*b* is made of a specific electrical connection member configured to be able to supply electric potential and has a smooth cylindrical surface.

With reference to FIG. 15, the driving force input unit 248 includes a coupling unit 248*a*. The coupling unit 248*a* includes a coupling interlocking unit 248*a*1 and a coupling covering sleeve 248*a*2.

The coupling interlocking unit 248*a*1 is configured to interlock with a driving rotor installed at the side of the body frame 211 (See FIG. 12) to receive the driving force via the driving rotor. The coupling covering sleeve 248*a*2 is a thin film cylindrical member formed to protrude from the driving force input unit 248. The coupling interlocking unit 248*a*1 is included in a freely rotatable manner in the space inside of the coupling covering sleeve 248*a*2.

The outer shape of the coupling interlocking unit 248*a*1 is formed to be a circle having an outer diameter greater than the alignment collar 246 and the electrical connection protrusion 247*b* in the conductive member 247 when viewed from the side along the lateral direction. Specifically, the coupling interlocking unit 248*a*1 has an outer diameter that interlocks with the drum unit 250 (See FIG. 27) via the alignment collar 246 and an outer diameter that is approximately 1.5 times the outer diameter of the terminal unit 247*b*. Also, the outer shape of the coupling interlocking unit 248*a*1 is formed to include the outer diameter of the electrical connection protrusion 247*b* when viewed from the side along the lateral direction. That is, the outer shape of the coupling interlocking unit 248*a*1 is formed to include the electrical connection pressing position where the electrical connection protrusion 247*b* and the specific electrical connection member are in contact with each other when viewed from the side along the lateral direction.

Overview of the Configuration of the Developing Cartridge

Again, with reference to FIG. 14, in the ceiling plate 241*c* of the developing cartridge case 241, a pair of separation bosses 241*f* is formed in order to urge the developing cartridge 240 upwards when not forming images. The pair of separation bosses 241*f* is installed to protrude outside along the lateral direction at the front end in the ceiling plate 241*c*.

A handle 241*g* is installed in the ceiling plate 241*c* of the developing cartridge case 241. The handle 241*g* is supported in a freely rotatable manner by the hinge unit 241*h* installed at the front edge of the ceiling plate 241*c*. The handle 241*g* is turned to the standing state shown in FIG. 16 when attaching and detaching the developing cartridge 240 such that the operator can grip the handle portion. Also, the handle 241*g* is provided to urge the developing cartridge 241 downwards in a stored state as shown in FIG. 14 and FIG. 15 during the image forming operation.

With reference to FIG. 14, the handle 241*g* forms a pair of pressing bosses 241*g*1 in order to urge the developing cartridge case 241 downwards during the image forming operation. The pair of pressing bosses 241*g*1 is installed to protrude outside along the lateral direction at both ends at the free ends of the handle 241*g*. The pressing member 241*g*2 that is located inside in the lateral direction from the pressing bosses 241*g*1 is urged towards the urging mechanism 241*k* below the pressing member 241*g*2 by pressing the pressing bosses 241*g*1 from the above.

The pair of urging mechanisms 241*k* is installed at the ceiling plate 241*c* of the developing cartridge case 241. In response to the pair of pressing members 241*g*2, the urging mechanism 241*k* is arranged at both ends in the lateral direction of the ceiling plate 241*c*. The urging member 241*k* urges the developing cartridge case 241 downwards to press the pressing member 241*g*2 downwards. The specific configuration of the urging 241*k* will be discussed later.

Above the back side of the developing cartridge case 241, a pair of guide protrusions 241 is formed. The guide surface 241*m*1 at the tip of the guide protrusions 241*m* is formed to be a flat surface.

Figure 17:
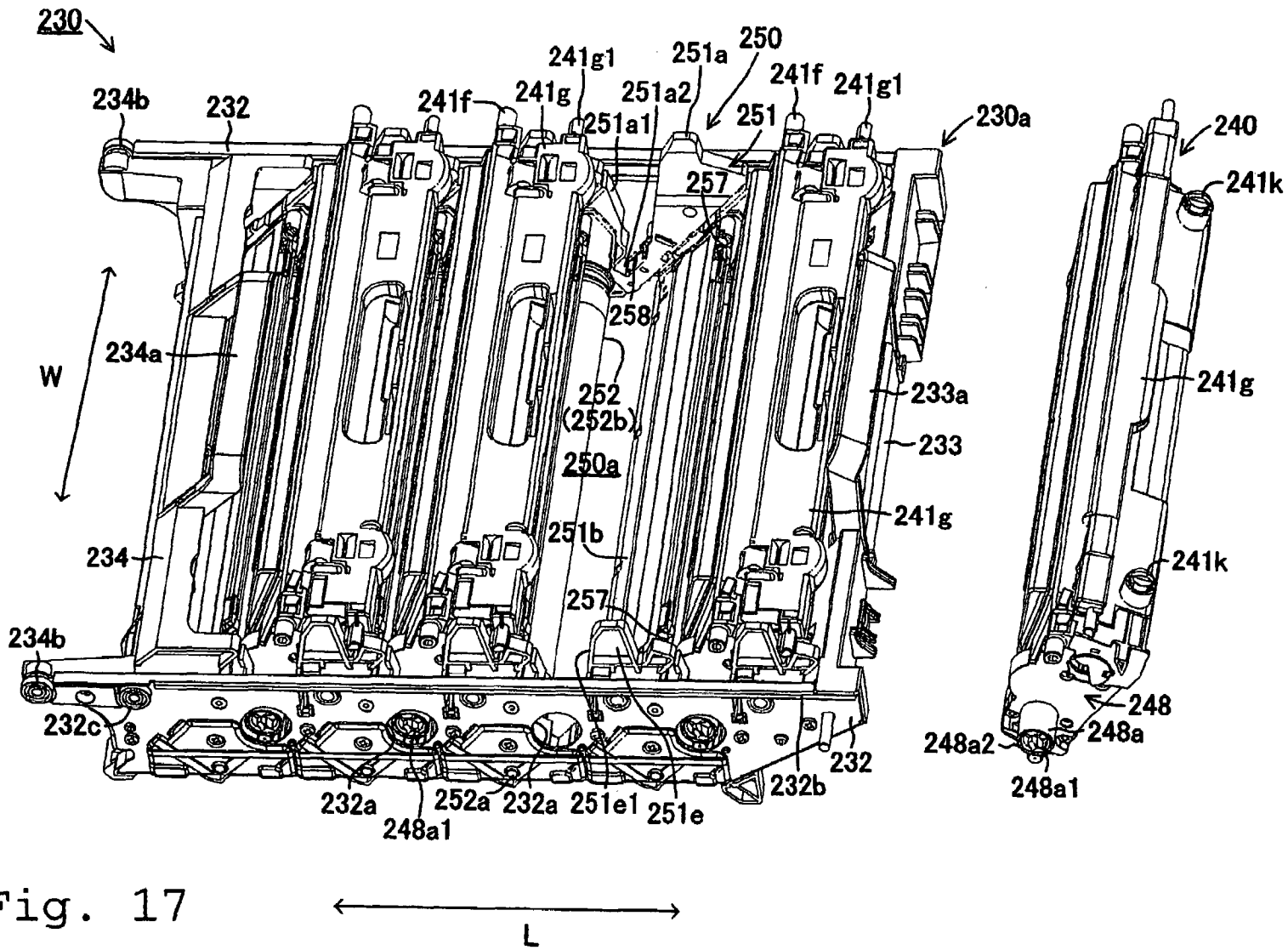
FIG. 17 is a perspective birds-eye view of a process unit of the color laser printer shown in FIG. 12.
Figure 18:
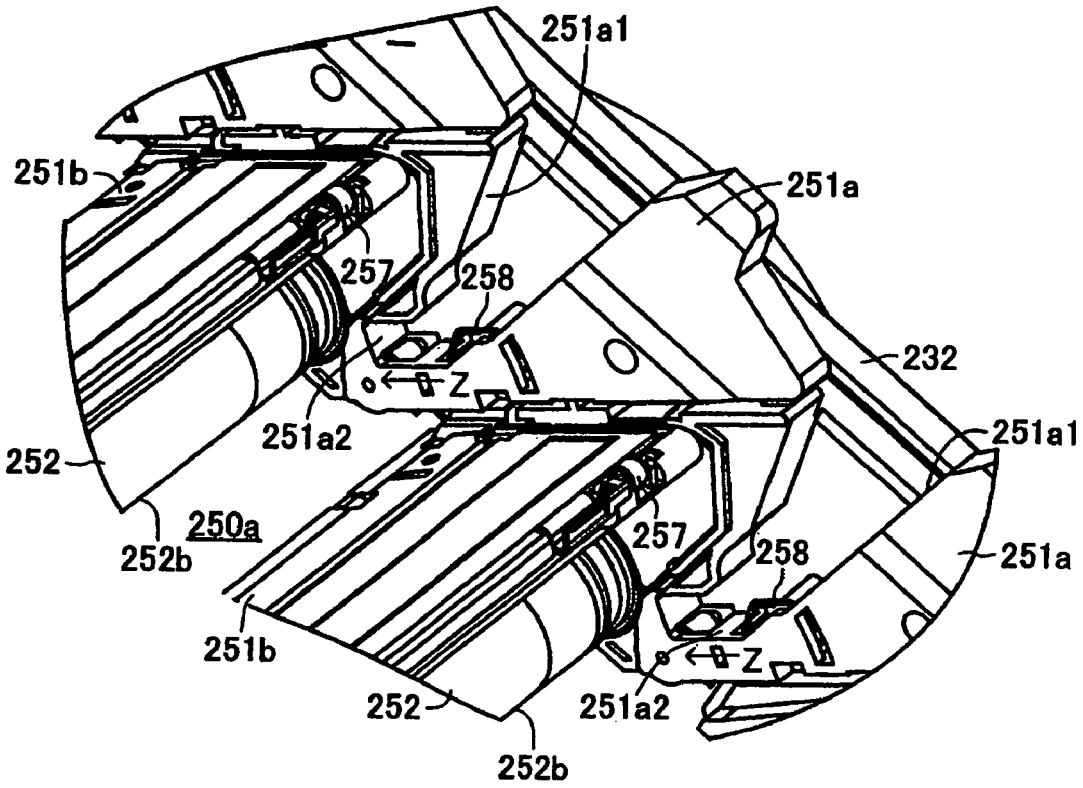
FIG. 18 is a magnified perspective view of the elements of a photosensitive unit of the process unit shown in FIG. 17.

Configuration for Detaching and Attaching the Developing Cartridge and the Photosensitive Unit FIG. 17 is a perspective view showing the process unit 230 shown in FIG. 12. FIG. 17 shows a state when one of the four developing cartridges 240 is attached and detached. FIG. 18 is an enlarged perspective view for the key portion of the photosensitive unit 250 shown in FIG. 17. That is, FIG. 18 is a perspective view of one enlarged end in the lateral direction of the photosensitive unit 250 wherein a developing cartridge 240 is attached and detached in FIG. 17. FIG. 19 is a perspective view of the photosensitive unit 250 shown in FIG. 17 when viewed from the side. FIG. 20 is a perspective view of the photosensitive unit 250 shown in FIG. 17 when viewed from the opposite side from the case shown in FIG. 19. FIG. 19 and FIG. 20 show the state when the side frame 232 in FIG. 17 is seen.

With reference to FIG. 17, in the process unit 230, four sets of cartridges 240 and photosensitive units 250 are oriented along the front-to-back direction L. These developing cartridges 240 and the photosensitive units 250 are installed in the process unit frame 230*a*.

The process unit frame 230*a* includes a pair of side frames 232, a front beam 233, and a rear beam 234. The front beam 233 is arranged to cover the end of the front side (right side in the figure) in the pair of side frames 232. The rear beam 234 is arranged to cover the end of the back side (left side in the figure) in the pair of side frames 232. Four sets of photosensitive units 250 are fixed in the interior of the rectangular space enclosed by the pair of side frames 232, the front beam 233 and the rear beam 234. The developing cartridges 240 are installed in the process unit frame 230*a* via these photosensitive units 250.

In the almost central portion in the direction of height of the side frame 232, coupling exposure opening 232*a* is formed as a through-hole. The coupling exposure opening 232*a* is configured such that when the developing cartridge 240 is installed, the coupling unit 248*a* is exposed towards the side of the process unit frame 230*a*.

A guide rib 232*b* is formed at the upper end of the side frame 232. The guide rib 232*b* is installed to protrude towards the outside in the lateral direction W. This guide rib 232*b* is formed to have a longitudinal direction that is parallel to the front-to-back direction L. Immediately below the guide rib 232*b* and at the edge at the back side of the side frame 232, a side frame guide roller 232*c* is supported in a freely rotatable manner.

The side frame 232 is configured such that the process unit 230 can be attached and detached along the front-to-back direction L by sliding the guide rib 232*b* and the side frame guide roller 232*c* with the slide guide frame 211*c* (see FIG. 12) installed in the body frame 211.

A front beam grip 233*a* is formed at the upper end of the front beam 233 and at the center of the lateral direction W. Also a rear beam grip 234*a* is formed at the upper end of the rear beam 234 and at the center of the lateral direction W. The front beam grip 233*a* and the rear beam grip 234*a* are members including grips when the operator holds the process unit 230 attached and detached from the body frame 211 (See FIG. 12), and they are formed in a reverse U-letter shape protruding upwards.

A pair of rear beam guide rollers 234*b* is supported in a freely rotatable manner at both ends of the rear beam 234. The rear beam guide roller 234*b* and the side frame guide roller 232*c* are oriented along the front-to-back direction L. The rear beam guide roller 234*b* is configured such that it can be operated similarly to the side frame guide roller 232*c*.

Detailed Configuration of the Photosensitive Unit 250

A photosensitive unit frame 251 is supported by a pair of side frames 232. This photosensitive unit frame 251 includes a first side wall unit 251*a*, a bottom wall unit 251*b*, and a second side wall unit 251*e*. A developing cartridge storage unit 250*a* that is a space for storing the developing cartridge 240 is formed by the space enclosed by the first side wall unit 251*a*, the bottom wall unit 251*b*, and the second side wall unit 251*e*. Also, between the first side wall unit 251*a* and the bottom wall unit 251*b*, a photosensitive drum 252 is supported in a rotatable manner below the developing cartridge storage unit 250*a*.

With reference to FIGS. 17 and 18, the first side wall unit 251*a* is fixed with a screw and the like relative to one of the side frames 232 (upper portion in FIG. 17). An alignment collar guide groove 251*a*1 is formed in the first side wall unit 251*a* to have an upward opening. The alignment collar storage base end 251*a*2 at the lower end of the alignment collar guide groove 251*a*1 is formed almost straight towards the photosensitive drum 252 along the direction indicated by the arrow Z in FIG. 18 (guiding direction). The end of the drum shaft 252*a* in the photosensitive drum 252 is exposed to the outside of the side frame 232 to be grounded.

The alignment collar guide groove 251*a*1 is formed as shown in FIG. 19, such that the alignment collar 246 installed at one of the edges of the developing cartridge 240 can be guided along the vertical direction. Also, the alignment collar storage base end 251*a*2 is formed such that the developing cartridge 240 and the photosensitive unit 250 can be aligned by being brought into contact with the alignment collar 246 as shown in FIG. 19B. That is, if the alignment collar 246 is guided in the alignment collar storage base end 251*a*2 along the guiding direction and is brought into contact with the lower end of the alignment collar storage base end 251*a*2, the dimensional relationships between the developing roller driving shaft 244*a* and the drum shaft 252*a* are set in a specified state and as a result, the dimensional relationships between the developing roller 244 and the photosensitive drum 252 are set in a specified state.

Again, with reference to FIG. 17 and FIG. 18, a developing cartridge insertion guide roller 257 is supported in freely rotatable manner at the upper end of the bottom wall unit 251*b* and at the both ends in the lateral direction W. If this developing cartridge insertion guide roller 257 is brought into contact with the guide surface 241*m*1 (See FIG. 14) in the guide protrusion 241*m* installed in the developing cartridge 240, the installation of the developing cartridge 240 to the developing cartridge storage unit 250*a* can be guided along the guiding direction Z as shown in FIG. 18.

With reference to FIG. 17, the second side wall unit 251*e* is fixed with a screw relative to the other side frame 232 (lower part in FIG. 17). A coupling covering sleeve guide groove 251*e*1 is formed in the second side wall unit 251*e* to have an upward opening. This coupling covering sleeve guide groove 251*e*1 is formed to be able to guide the coupling covering sleeve 248*a*2 in the coupling unit 248*a* installed at the other edge of the developing cartridge 240 along the up-and-down direction.

With reference to FIG. 20, a coupling storage base end 251*e*2 is formed at the lower end of the coupling covering sleeve guide groove 251*e*1. If the coupling storage base end 251*e*2 is brought into contact with the coupling covering sleeve 248*a*2 as shown in FIG. 20B, the developing cartridge 240 and the photosensitive unit 250 can be aligned. That is, when the coupling covering sleeve 248*a*2 is stored in the coupling storage base end 251*e*2, the dimensional relationships between the developing roller driving shaft 244*a* and the drum shaft 252*a* can be set in a specified state.

A developing roller axial end storage unit 251*e*3 is formed below the coupling storage base end 251*e*2. When the coupling covering sleeve 248*a*2 is stored in the coupling storage base end 251*e*2, the developing roller axial end storage unit 251*e*3 can contain the edge of the developing roller driving shaft 244*a*.

With reference to FIG. 19 and FIG. 20, at least the lower half of the alignment collar guide groove 251*a*1 is formed at the width narrower than the coupling covering sleeve guide groove 251*e*1. That is, the alignment collar guide groove 251*a*1 is formed with a width such that the coupling covering sleeve 248*a*2 is not stored in the alignment collar storage base end 251*a*2.

Configuration of Electrical Connection to Developer Roller

Referring to FIG. 19, a relay electrode part (electrical connection part) 258 is mounted on the outer surface of the primary side wall 251*a*. The relay electrode part 258 is made up of a base portion 258*a*, a fixed portion 258*b* and an oscillating portion 258*c*. The relay electrode part 258 is formed as a unit by bending a metal wire.

The base portion 258*a* is formed into 2-3 rolls of coil. The fixed portion 258*b* and the oscillating portion 258*c* are connected to both ends of the base portion 258*a*. The base portion 258*a* and the fixed portion 258*b* are affixed to the corresponding outer side by clinging to the outer side of the primary side wall 251*a*. The fixed portion 258*b* is configured and positioned so as to become electrically connected to the prescribed electrical connection output electrode mounted on the side of the corresponding unit frame 211 when a photosensitive unit 250 is mounted onto the unit frame 211 (see FIG. 12).

The oscillating portion 258*c* is configured to oscillate elastically around the base portion 258*a*. The relay electrode part 258 is positioned in such a way that the oscillating portion 258*c* can protrude into the alignment collar guide groove 251*a*1. This oscillating portion 258*c* is configured to form an electrical contact by pressing against the electrical connection protrusion 247*b* when a developer cartridge 240 is mounted onto the photosensitive unit 250.

Pressing of Developer Cartridge onto Photosensitive Drum

Figures 21A, 21B:
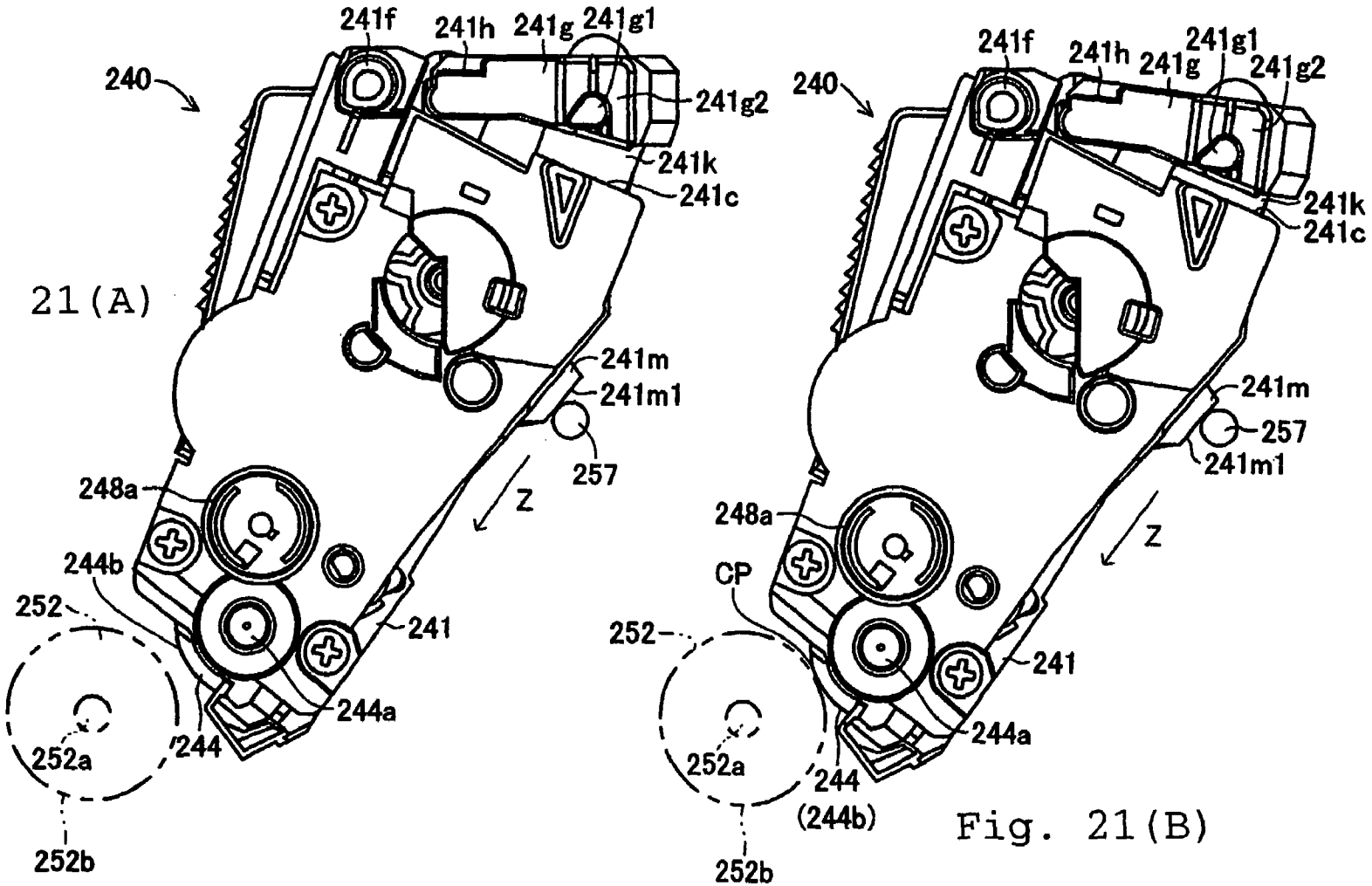
FIGS. 21A and 21B are side views of the developer cartridge shown in FIG. 13in a non-pressed state (retired state), and a pressed state, respectively.
Figure 22B:
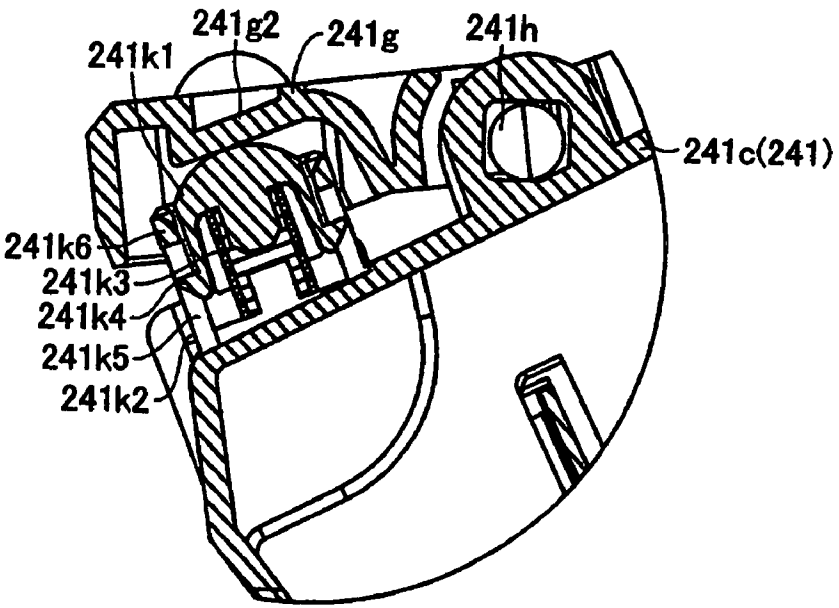
FIGS. 22A and 22B are magnified side cross-sections of the vicinity of the pressing action mechanism shown in FIGS. 21A and 21B in the non-pressed state, and the pressed state, respectively.
Figure 22A:
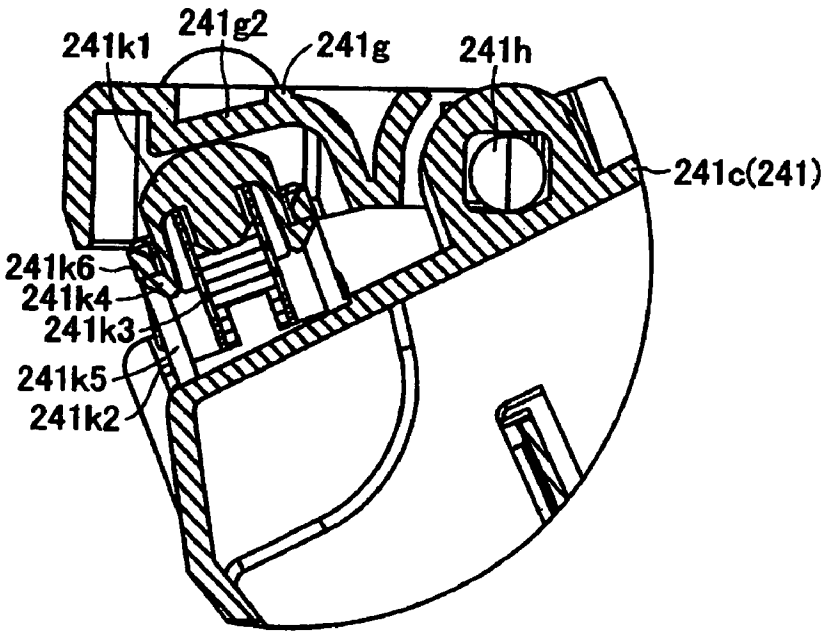

FIGS. 21A and 21B are side views of the developer cartridge 240 shown in FIG. 13. Here, FIG. 21A represents a non-pressed state (wait state), and FIG. 21B represents a pressed state. FIGS. 22A and 22B show enlarged side cross-section views of the vicinity of the urging mechanism 241*k* as viewed from the developer cartridge 240 shown in FIGS. 21A and 21B, and as viewed from the opposite side. Here, FIG. 22A represents a non-pressed state, and FIG. 22B represents a pressed state. FIG. 23A is a side view of the side opposite the developer cartridge 240 in the pressed state shown in FIG. 21B. FIG. 23B is a schematic diagram explaining the force that acts upon the developer cartridge 240 in a pressed state shown in FIG. 23A.

Referring to FIGS. 21A and 21B, the urging mechanism 241*k* is configured to elastically impel the developer cartridge case 241 in the guide direction indicated by arrow Z based on the handle 241*g* being rotated in a clockwise direction around the hinge 241*h*. In short, the urging mechanism 241*k* is configured to convert the descent of the pressing member 241*g*2 due to the downwards pressing of the pressing boss 241*g*1 mounted on the free end of the handle 241*g* into force elastically applied along the guide direction Z for the developer cartridge case 241.

Furthermore, the guide protrusion 241*m* is configured in such a way as to guide the movement of the developer cartridge case 241 along the guide direction Z by having the guide surface 241*m*1 at the tip touch and rotate the developer cartridge insertion guide roller 257.

Referring to FIGS. 22A and 22B, the urging mechanism 241*k* is equipped with a moving part 241*k*1, an urging guide cylinder 241*k*2 and a developer cartridge spring 241*k*3.

The moving part 241*k*1 is housed in the semi-cylindrically shaped urging guide cylinder 241*k*2. This moving part 241*k*1 is positioned to move in a roughly up-down direction along the central axis of the urging guide cylinder 241*k*2.

The developer cartridge spring 241*k*3 is positioned between the moving part 241*k*1 and the ceiling plate 241*c* of the developer cartridge case 241. The developer cartridge spring 241*k*3 is configured to press the moving part 241*k*1 in a roughly upward direction. In other words, the developer cartridge spring 241*k*3 is configured to impel the ceiling plate 241*c* of the developer cartridge case 241 in a roughly downwards direction when the moving part 241*k*1 is pushed in a roughly downwards direction, as shown in FIG. 22B. In this aspect, the pressing action point for this downwards pressing (impelling) action of the ceiling plate 241*c* by the developer cartridge spring 241*k*3 is set to a position that corresponds to the central axis line of the developer cartridge spring 241*k*3 and the bottom end of the corresponding developing cartridge spring 241*k*3.

A hook 241*k*4 is formed on the bottom end of the moving part 241*k*1 so as to protrude on the side. The hook 241*k*4 is formed to move in a roughly up-down direction along the inside of the hook movement guide slit 241*k*5 mounted on the urging guide cylinder 241*k*2. The top end of the hook movement guide slit 241*k*5 is blocked by a hook stopper 241*k*6. In short, the moving part 241*k*1 is prevented from leaving the urging guide cylinder 241*k*2 by the hook 241*k*4 contacting the hook stopper 241*k*6.

Referring to FIGS. 23A and 23B, the guide protrusion 241*m* is formed in such a way that the guide surface 241*m*1 at the tip has a surface that is parallel to the pressing action line Y, that is the straight line that joins the pressing action point, i.e., pressing position PP, to the contact position (developer position) CP. In short, the corresponding pressing action line Y is set to be parallel to the base of the alignment collar housing 251*a*2 (guide direction Z).

Furthermore, in the present embodiment, the guide surface 241*m*1 for the guide protrusion 241*m* is configured so that it is pressed towards the developer guide cartridge insertion guide roller 257 (see FIG. 21) at a prescribed strength by making the angle formed by the developer cartridge pressing direction X at the pressing position PP and the pressing action line Y to roughly 20 degrees.

Furthermore, in the present embodiment, an electrical connection counterpart 258*c*1 having a straight shape is formed at a position opposite the electrical connection protrusion 247*b* at the oscillation portion 258*c* of the relay electrode part 258. Also, the relay electrode part 258 is configured so that the electrical connection counterpart 258*c*1 is parallel to the pressing action line Y and guide direction Z when the developer cartridge 240 is in the pressed status (when the toner bearing surface 244*b* on the developer roller 244 is in contact at the prescribed pressure with the image bearing surface 252*b* on the photosensitive drum 252).

Moreover, in the present embodiment, the relay electrode part 258 is configured so that the electrical connection counterpart 258*c*1 for the oscillating area 258*c* of the relay electrode part 258 presses against the electrical connection protrusion 247*b* of the conductive part 247 in a direction that is partially orthogonal to the pressing action line Y and the guide direction Z. In short, the relay electrode part 258 is configured in such a way that the electrical connection pressing direction S. i.e., the direction in which the electrical connection protrusion 247*b* is pressed by the electrical connection counterpart 258*c*1, is partially orthogonal to the pressing action line Y and the guide direction Z. Concretely, the angle for each is set to roughly 90 degrees (no less than 89.0 degrees, no greater than 91.0 degrees).

Figure 23:
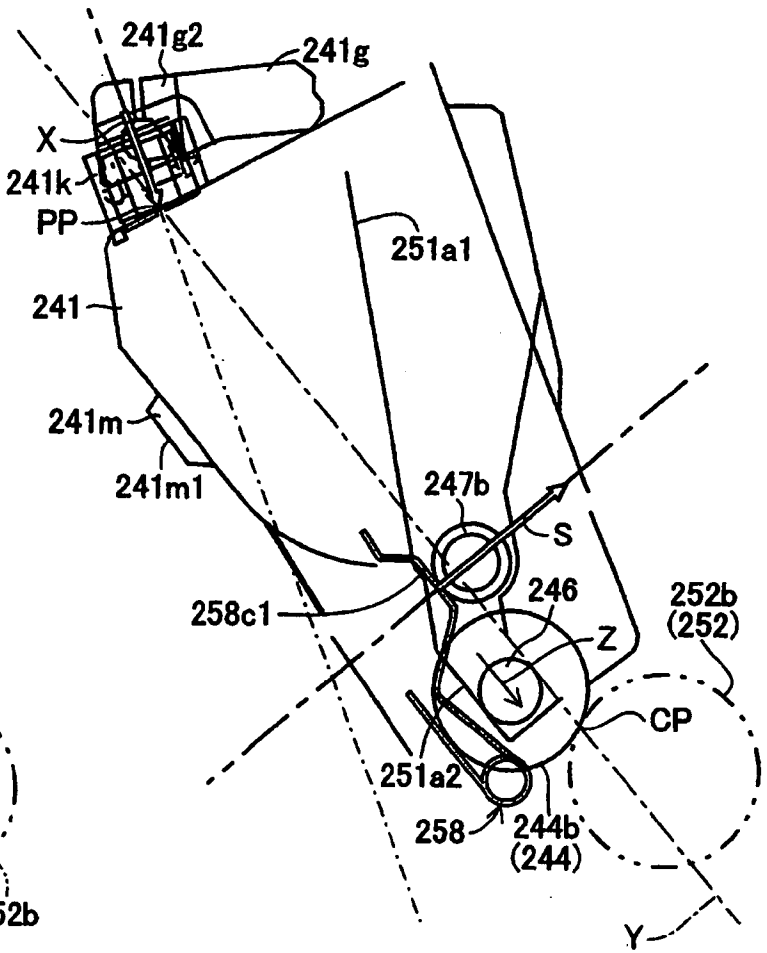
FIG. 23(A) is a side view of the opposite side of the developer cartridge in the pressed state shown in FIG. 21B
FIG. 23(B) is a schematic view illustrating the force acting on the developer cartridge in the pressed state shown in FIG. 23A.
Figure 23:
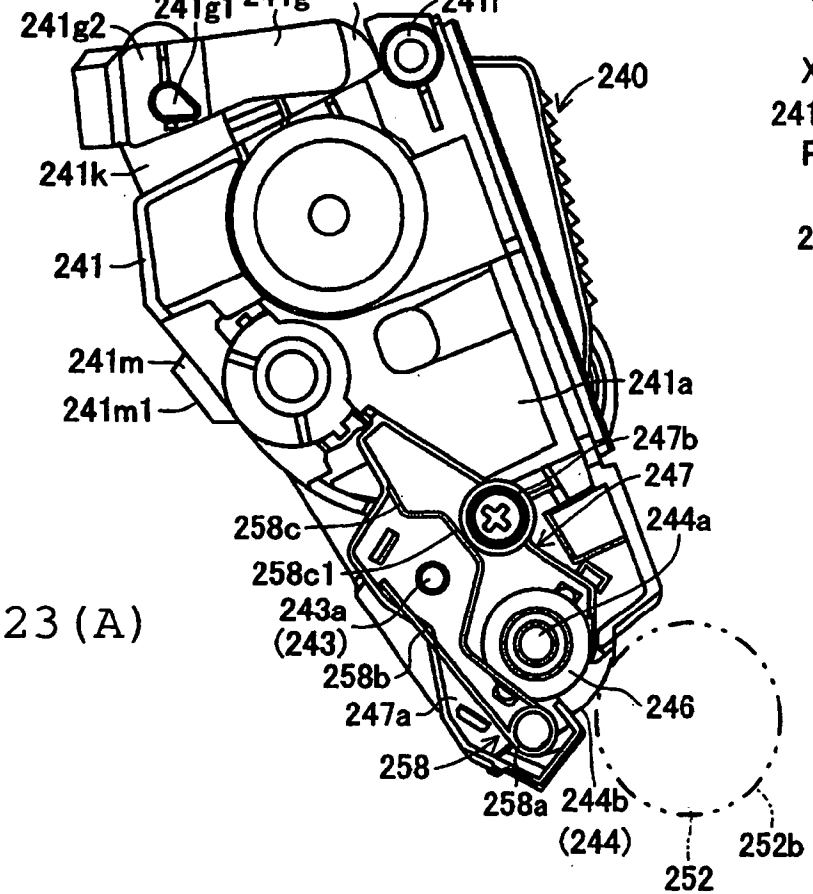
Figure 24:
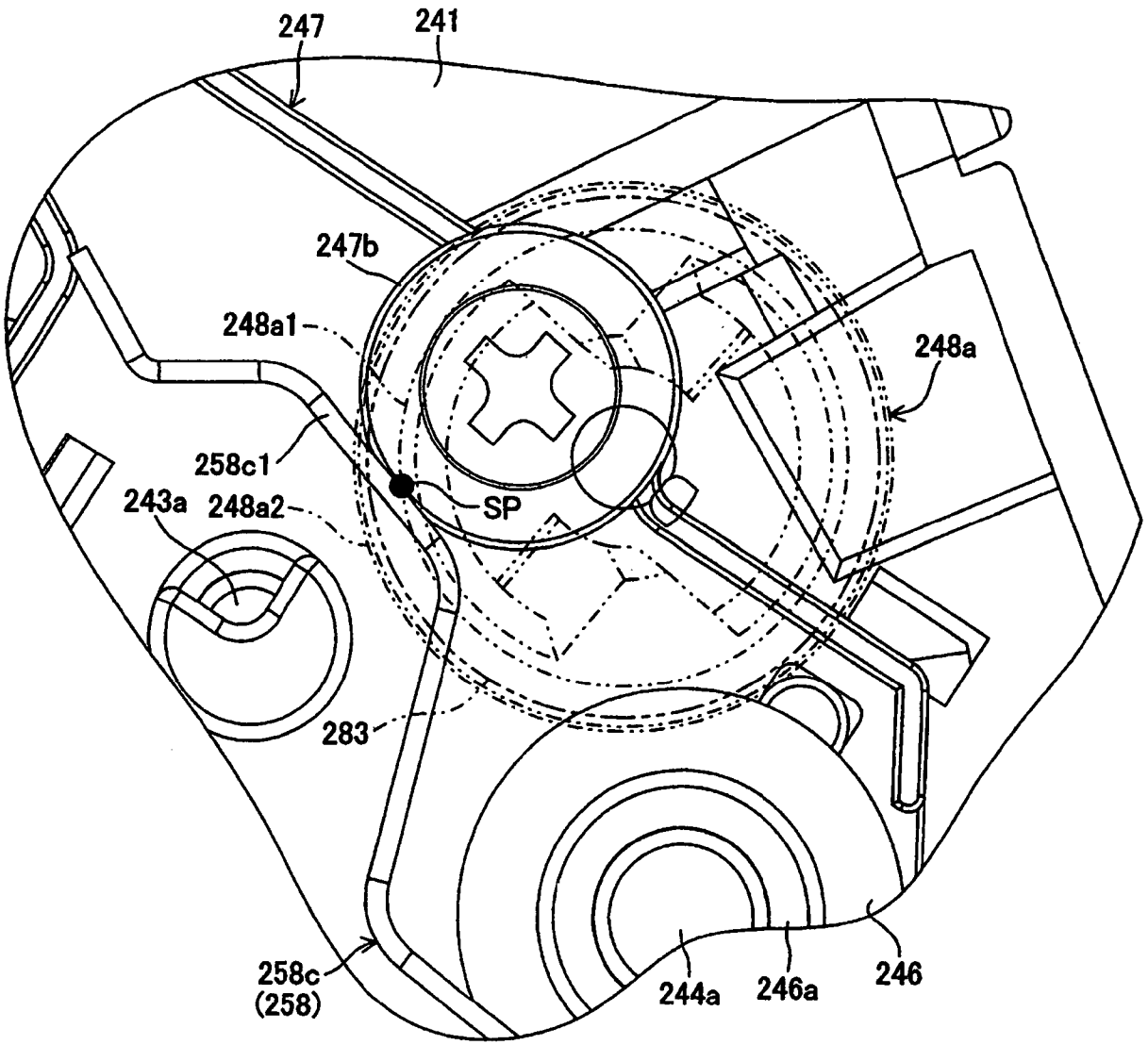
FIG. 24 is a magnified side view of the vicinity of the conductive part shown in FIGS. 23A and 23B.

Here, FIG. 24 is a magnified side view of the area around the conductive part 247*b* indicated in FIG. 23. Note that, in FIG. 24, a dotted line with two dots is used to indicate the side where the corresponding conductive part 247 is mounted and the opposite side where the coupling 248*a* is mounted on the developer cartridge case 241, and where the coupling drive gear 283 is mounted on the same axis as the corresponding coupling 248*a*. The area surrounding this coupling gear 283 is described concretely elsewhere (making reference to FIG. 36 and FIG. 37).

Referring to FIG. 24, the outer diameter of the coupling joint 248*a*1 of the coupling 248*a* is formed to be larger than the outer diameter of the micro diameter 246*a* housed within the alignment collar housing base 251*a*2 (alignment collar storage base end) of the color part (alignment collar) 246 (see FIGS. 23A and 23B) and the electrical connection protrusion 247*b* of the conductive part 247. Also, the outer diameter of the coupling joint 248*a*1 and the coupling drive gear 283 are formed to have a shape that encapsulates the electrical connection pressing position SP when seen laterally along the width direction. The electrical connection pressing position SP is the position at which the electrical connection protrusion 247*b* and electrical connection counterpart 258*c*1 on the oscillating portion 258*c* of the relay electrode part 258 are in contact.

Configuration for Selective Pressing of Several Developer Cartridges

Figure 25:
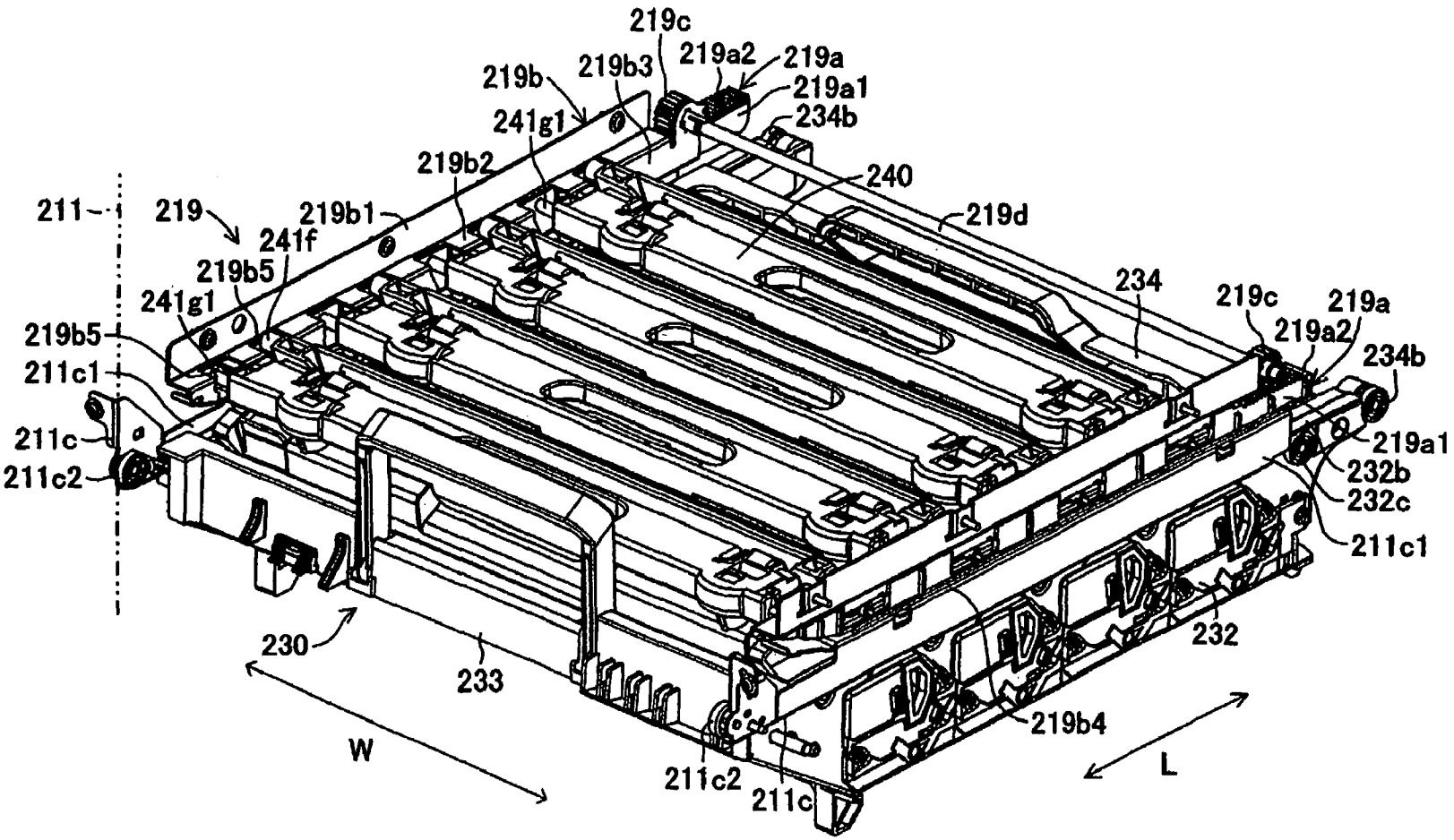
FIG. 25 is a magnified perspective view of the vicinity of the process unit shown in FIG. 12.
Figure 26:
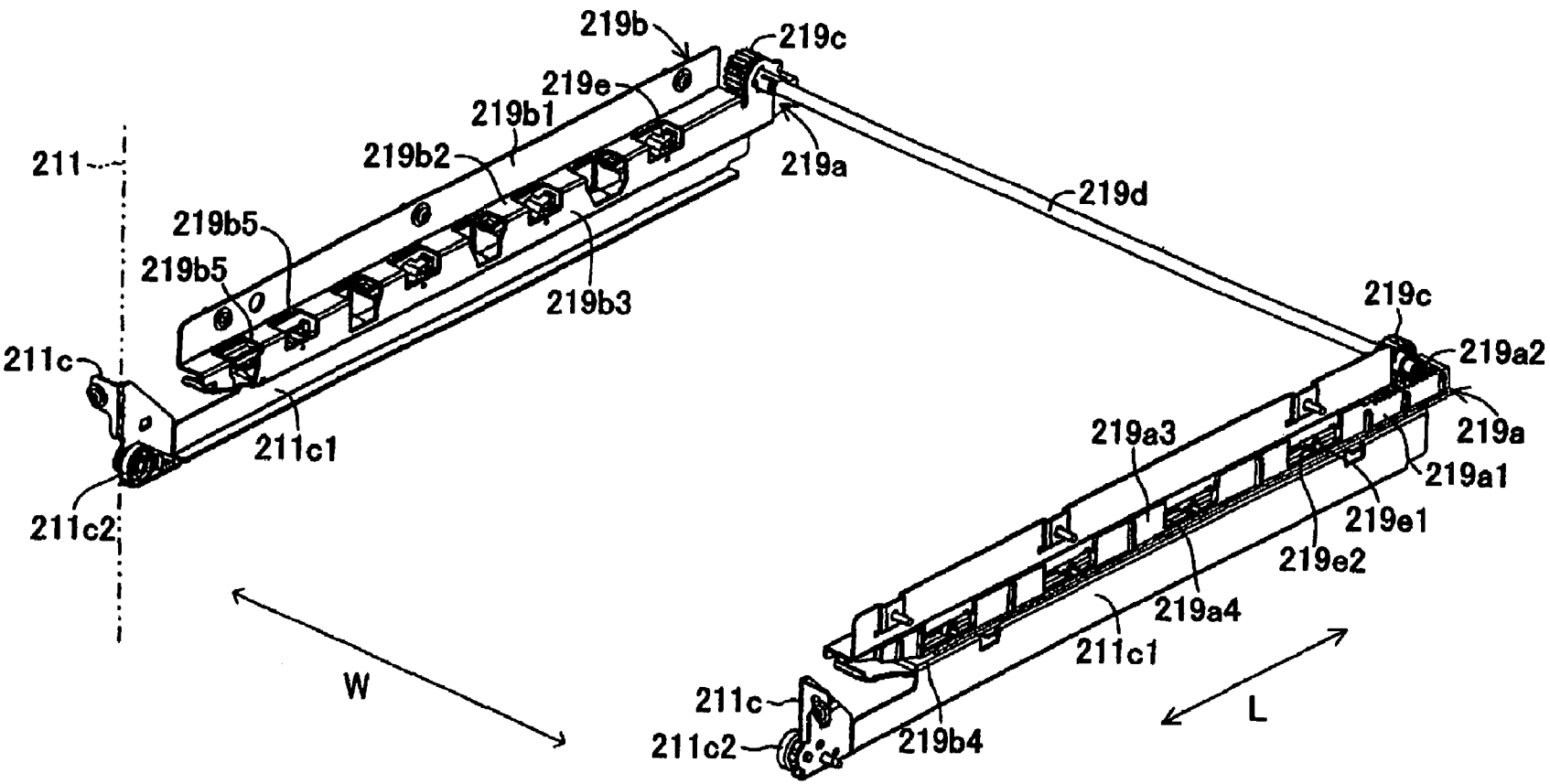
FIG. 26 is a magnified perspective view of the vicinity of a slide guide frame and a linear cam mechanism of the color laser printer shown in FIG. 12.

FIG. 25 is a magnified perspective view of the area around the process unit 240 shown in FIG. 12. FIG. 26 is a magnified perspective view of the area surrounding the slide guide frame 211*c* and the linear cam mechanism 219 shown in FIG. 12. In short, FIG. 26 is the same as FIG. 25 minus the process unit 230.

Referring to FIG. 25, the slide guide frame 211*c* is configured to support both ends of the process unit 230 in the width direction W, as well as the upper end in the height direction. The slide guide frame 211*c* is equipped with a slide rail 211*c*1 and a slide guide roller 211*c*2.

The slide rail 211*c*1 is configured to act as a counterpart when brought close to upper end of the side frame 232 (guide rib 232*b* in FIG. 17) while the process unit 230 is housed within the unit frame 211. In addition, the slide rail 211*c*1 and the slide guide roller 211*c*2 are configured to guide movement along the front-back direction L for the corresponding process unit 230 by working with the side frame 232 (side frame guide roller 232*c* and guide rib 232*b* in FIG. 17) and the rear beam guide roller 234*b* of the process unit 230.

The linear cam mechanism 219 is equipped with a cylindrical cam part 219*a*, a cam support frame 219*b*, a pinion gear 219*c* and a gear axis 219*d*.

The cylindrical cam part 219*a* is formed to have a front-rear direction L and a parallel longitudinal direction, and configured and positioned to perform reciprocal motion along the corresponding front-rear direction L. In short, a rack gear 219*a*2 is formed on the top of the cam base 219*a*1, i.e., the tip of the rear side (top right in the figure) of the cylindrical cam part 219*a*. The rack gear 219*a*2 is configured to mesh with the pinion gear 219*c*.

One pair of pinion gear 219*c* is connected by a gear axis 219*d* so that they do not rotate relative to each other. In addition, one pair of pinion gear 219*c* and the gear axis 219*d* are configured to enable reciprocal motion along the front-rear direction L while synchronizing so that it is in phase (position in front-rear direction L) with the other cylindrical cam part 219*a* in the event that the other cylindrical cam part 219*a* is moved along the front-rear direction L by a drive mounted on the unit frame 211 not shown on the diagram.

(Note that, for the purpose of facilitating the explanation of the fact that the cylindrical cam part 219*a* can move along the front-rear direction, the cylindrical cam part 219 on the left side of the diagram is shown in the rear-most position, and the cylindrical cam part 219*a* on the right side of the diagram is shown in the middle position. However, the linear cam mechanism 219 can be configured so that the movement of both the cam parts is synchronized. Therefore, in reality this situation will never occur.)

The cam support frame 219*b* is composed of a cam support frame base 219*b*1, a cam support frame upper plate 219*b*2, a cam support frame side plate 219*b*3 and a cam support frame floor plate 219*b*4. The cam support frame 219*b* is formed as a unit using a metal plate.

The cam support frame base 219*b*1 is mounted on the cam support frame upper plate vertically from the outer edge in the width direction W. By fixing the cam support frame base 219*b*1 into place on the interior wall of the unit frame 211 using a screw or the like, the corresponding cam support frame 219*b* is supported on the interior of the unit frame 211.

The cam support frame side plate 219*b*3 is mounted vertically from the interior edge of the cam support frame upper plate 219*b*2 in the width direction W. In addition, a cam support frame floor plate 219*b*4 is mounted so that it protrudes towards the exterior in the width direction W from the lower edge of the cam support frame side plate 219*b*3. Finally, the cylindrical cam part 219*a* is housed on the space surrounded by the cam support frame upper plate 219*b*2, the cam support frame side plate 219*b*3 and the cam support frame floor plate 219*b*4.

A boss housing opening 219*b*5 is formed to straddle the cam support frame upper plate 219*b*2 and the cam support frame side plate 219*b*3. The boss housing opening 219*b*5 is configured to face the separator boss 241*f*, the pressing boss 241*g*1 and the cylindrical cam part 219*a* on the developer cartridge 240 when the process unit 230 is housed in the unit frame 211.

Figure 27:
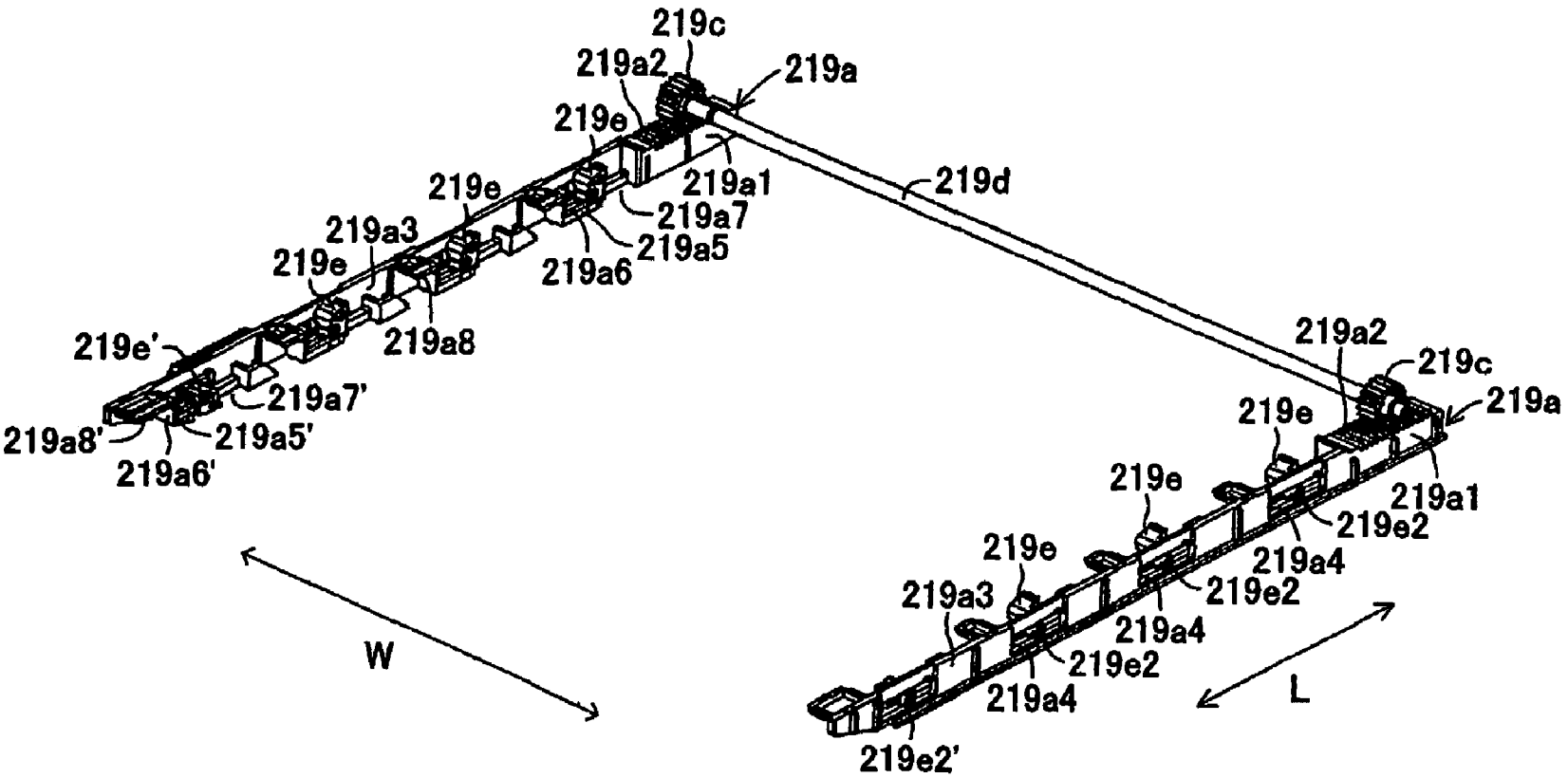
FIG. 27 is a perspective view of one part of the cylindrical cam parts shown in FIG. 26.

FIG. 27 is a perspective view of the pair of cylindrical cam parts 219*a* shown in FIG. 26. Referring to FIG. 26 and FIG. 27, there are several (four) auxiliary cam parts 219*e* for each cylindrical cam part 219*a*.

Referring to FIG. 26, the auxiliary cam part 219*e* is positioned to meet the boss housing opening 219*b*5. The auxiliary cam part 219*e* is configured to rotate freely around the auxiliary cam rotation pin 219*e*, which is parallel to the width direction W. The interior edge of the auxiliary cam rotation pin 219*e*1 in the width direction W is supported by a perforated hole formed directly beneath the boss housing opening 219*b*5 on the cam support frame side plate 219*b*3. In short, the auxiliary cam part 219*e* is supported so that it can move along the front-rear direction L by way of the perforated hole formed on the cam support frame side plate 219*b*3.

Referring to FIG. 27, to facilitate the explanation, a ' symbol has been added to the auxiliary cam part 219*e* that is furthest to the front in the diagram (bottom right in FIG. 27). Nevertheless, apart from instances where this auxiliary cam part 219*e*' moves in a timing that differs from other auxiliary cam parts 219*e* accompanying movement of the cylindrical cam part 219*a* along the front-rear direction L, this auxiliary cam part 219*e*' is configured identically to the other auxiliary cam parts 219*e*. Similarly, a ' sign has been added to the elements of the cylindrical cam part 219*a* farthest to the front in order to establish a correspondence with the auxiliary cam part 219*e*'.

Several (four) slot-shaped auxiliary cam guide holes 219*a*4 having a longitudinal direction parallel to the front-rear direction L are formed on the thin auxiliary cam guide wall 219*a*3, which makes up the outer wall of the cylindrical cam part 219*a* in the width direction W. The auxiliary cam guide holes 219*a*4 are formed into the same shape, and positioned in such a way that they will be arranged in line in the front-rear direction. In addition, the auxiliary cam part 219*e* is equipped with an auxiliary cam rotation protrusion 219*e*2 that protrudes towards the outside of the auxiliary cam part 219*e* in the width direction W. The auxiliary cam rotation protrusion 219*e*2 is inserted into the auxiliary cam guide hole 219*a*4.

In short, the auxiliary cam part 219*e* is supported in such a way that it can rotate by the hole formed on the cam support frame side wall 219*b*3 (see FIG. 26), and by the auxiliary cam guide hole 219*a*4. Furthermore, the auxiliary cam part 219*e* is supported in such a way that it can move relative to the corresponding cylindrical cam part 219*a* and the longitudinal direction of the auxiliary cam guide hole 219*a*4 accompanying reciprocal motion of the cylindrical cam part 219*a* along the front-rear direction L. Here, as shown in FIG. 26 and FIG. 27, the corresponding auxiliary cam guide hole 219*a*4 is formed in such a way that the position in the front-rear direction of the auxiliary cam rotation protrusion 219*e*2 in the auxiliary cam guide hole 219*a*4 will be the same for all four auxiliary cam guide holes 219*a*4. In short, the four auxiliary cam guide holes 219*a*4 and corresponding auxiliary cam guide parts 219*e* are all positioned so that they match one another.

Referring to FIG. 27, an auxiliary cam support 219*a*5 is formed so that it protrudes towards the interior in the width direction W from the bottom edge of the auxiliary cam guide wall 219*a*3 that forms the outer wall of the cylindrical cam part 219*a*. The auxiliary cam support 219*a*5 is configured so that it can support the auxiliary cam part 219*e* from the bottom. The auxiliary cam support 219*a*5 is formed in a position corresponding to the auxiliary cam guide hole 219*a*4.

An auxiliary cam contact wall 219*a*6 is formed to stand upwards from the front (bottom left in FIG. 27) edge of the auxiliary cam support 219*a*5. The auxiliary cam contact wall 219*a*6 is configured in such a way that it will be able to contact the auxiliary cam part 219*e* when the cylindrical cam part 219*a* moves to the rear (upper right in FIG. 27). The position of these four pairs of auxiliary cam contact walls 219*a*6 and auxiliary cam parts 219*e* (auxiliary cam rotation protrusion 219*e*2) relative to one another is also made to match.

An auxiliary cam exposed opening 219*a*7 that opens downwards is formed even further behind the edge of the rear (upper right in FIG. 27) of the auxiliary cam support 219*a*5. In addition, a pressing boss depress area 219*a*8 is formed so that it extends towards the front from the upper edge of the auxiliary cam contact wall 219*a*6. This pressing boss depress area 219*a*8 will be described in detail below, but it is configured so that it can depress the corresponding pressing boss 241*g*1 by joining the pressing boss 241*g*1 (see FIG. 25) when the cylindrical cam part 219*a* moves to the front.

Here, the length along the front-rear direction L of the auxiliary cam support 219*a*5 is set to be shorter than the auxiliary cam guide hole 219*a*4. In short, the tip on the rear of the auxiliary cam guide hole 219*a*4 is formed upwards from the auxiliary cam exposed opening 219*a*7. Moreover, the auxiliary cam support 219*a*5' closest to the front is formed shorter than the other auxiliary cam supports 219*a*5. On the other hand, the pressing boss depressed area 219*a*8' closest to the front is formed longer than the other pressing boss depressed areas 219*a*8.

Figure 28A:
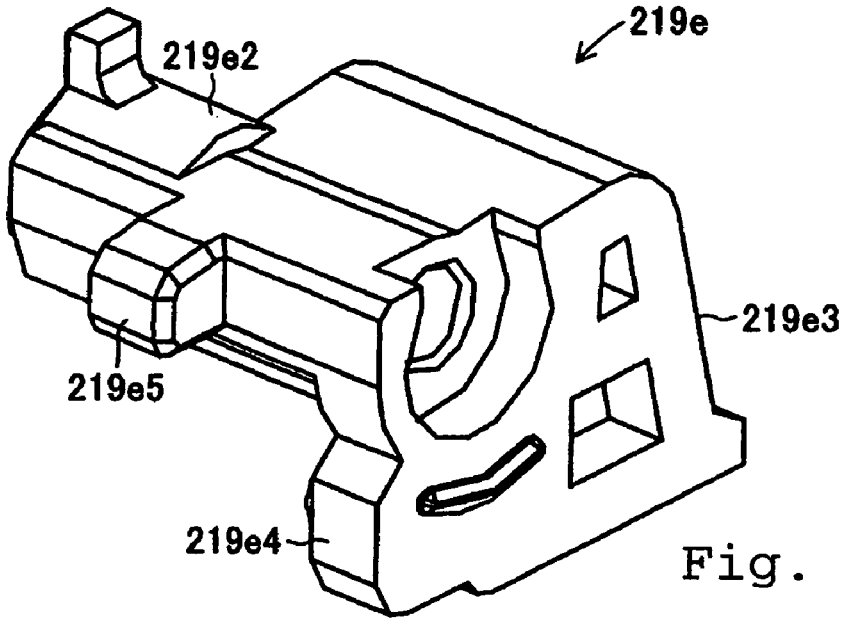
FIGS. 28A and 28B are magnified perspective views of the auxiliary cam part shown in FIG. 27 in which the auxiliary cam part is fallen (fallen state), and the auxiliary cam part is standing (standing state), respectively.
Figure 28B:
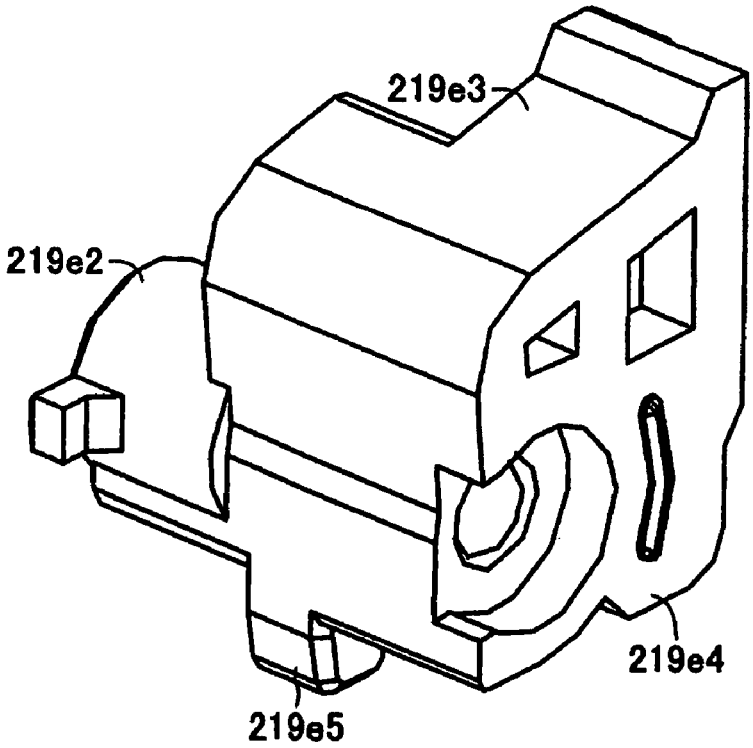

FIG. 28 is a magnified perspective view of the auxiliary cam part 219*e* shown in FIG. 27. Here, FIG. 28A illustrates the auxiliary cam part 219*e* fallen (fallen state), and FIG. 28B illustrates the auxiliary cam part 219*e* standing (standing state). In short, by rotating around the auxiliary cam rotation protrusion 219*e*2, the auxiliary cam part 219*e* can be set to either of two states: the fallen state as shown in FIG. 28A, or the corresponding standing state shown in FIG. 28B.

Referring to FIGS. 28A and 28B, a separator boss mount 219*e*3 having a mild slant is formed on the top edge (tip) of the auxiliary cam part 219*e* in the standing state shown in FIG. 28B. A protrusion is formed on the rear edge (top right edge in FIG. 28B) of the separator boss mount 219*e*3. On the other hand, the front tip of the separator boss mount 219*e*3 is formed to have a smooth slope or a beveled shape so that, when it comes into contact with the separator boss 241*f* (see FIG. 25), the corresponding separator boss 241*f* can easily ride onto the separator boss mount 219*e*3.

A first downward protrusion of the auxiliary cam 219*e*4 and a second downward protrusion of the auxiliary cam 219*e*5 are formed extending downwards on the lower edge of the auxiliary cam part 219*e* in standing state shown in FIG. 28B. The first downward protrusion of the auxiliary cam 219*e*4 and second downward protrusion of the auxiliary cam 219*e*5 are positioned so that they will occupy a different position relative to the width direction, i.e., the direction of the rotation axis (the direction of the central axis of the auxiliary cam rotation protrusion 219*e*2). Concretely, the first downward protrusion of the auxiliary cam 219*e*4 is mounted closer to the interior in the width direction (#down right in FIGS. 28A and 28B; interior in the width direction W in FIG. 27) than the second downward protrusion of the auxiliary cam 219*e*5.

Figure 29A:
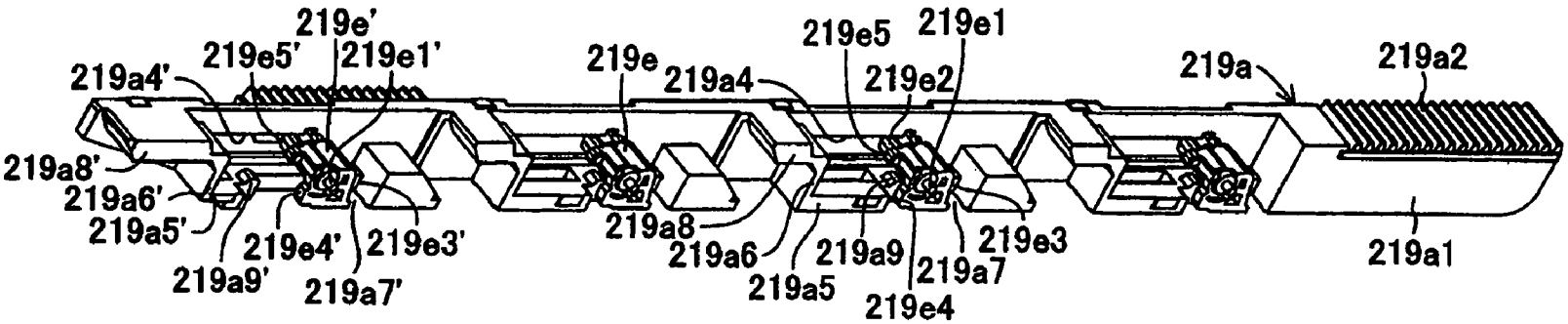
FIGS. 29A and 29B are magnified perspective views of the cylindrical cam part and auxiliary cam part shown in FIG. 27) where the cylindrical cam part is in the foremost position and the cylindrical cam part is in the rearmost position, respectively.
Figure 29B:
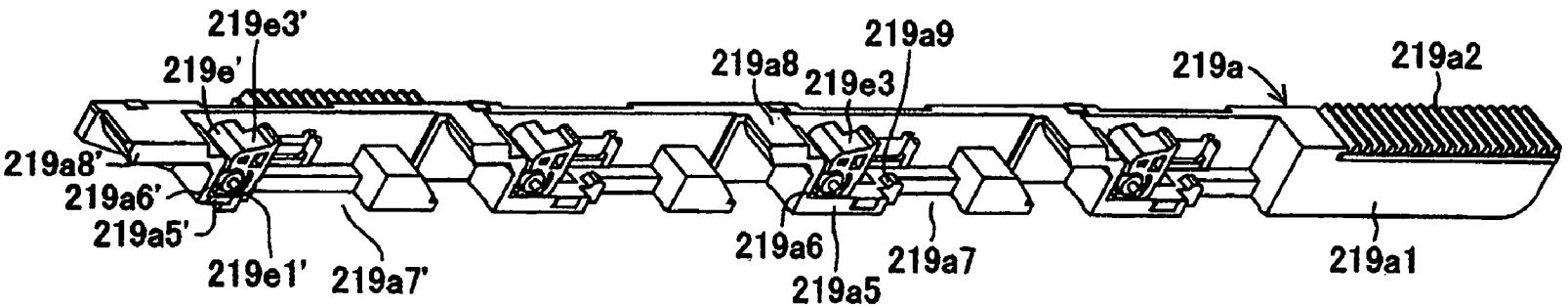

FIGS. 29A and 29B is a magnified perspective view of the cylindrical cam part 219*a* and auxiliary cam part 219*e* shown in FIG. 27. Here, FIG. 29A illustrates the cylindrical cam part 219*a* in its foremost position, and FIG. 29B illustrates the cylindrical cam part 219*a* in its rearmost position. (As stated previously, the position of the auxiliary cam part 219*e* (auxiliary cam rotation pin 219*e*1) in the front-rear direction is fixed, irrespective of the movement of the cylindrical cam part 219*a*.)

Figure 30:
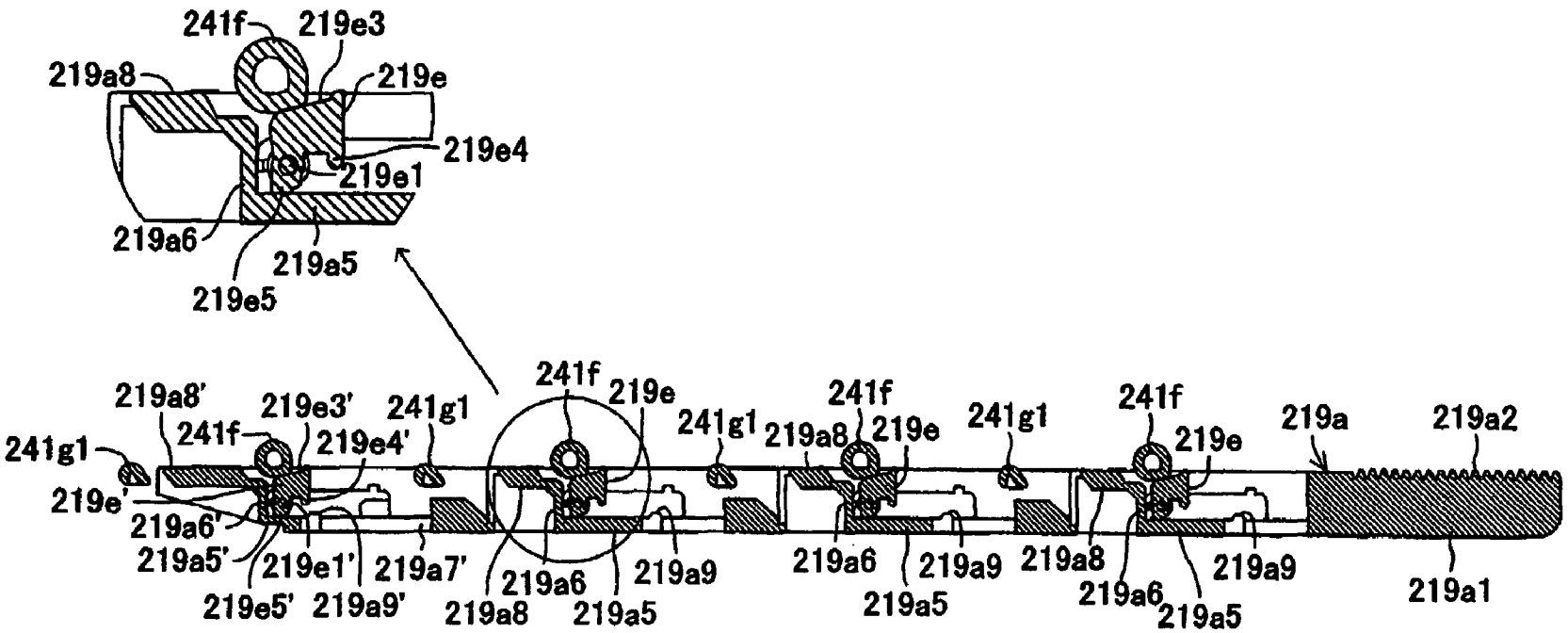
FIG. 30 is a side cross-section of the cylindrical cam part and auxiliary cam part with the cylindrical cam part shown in FIG. 29B.
Figure 31:
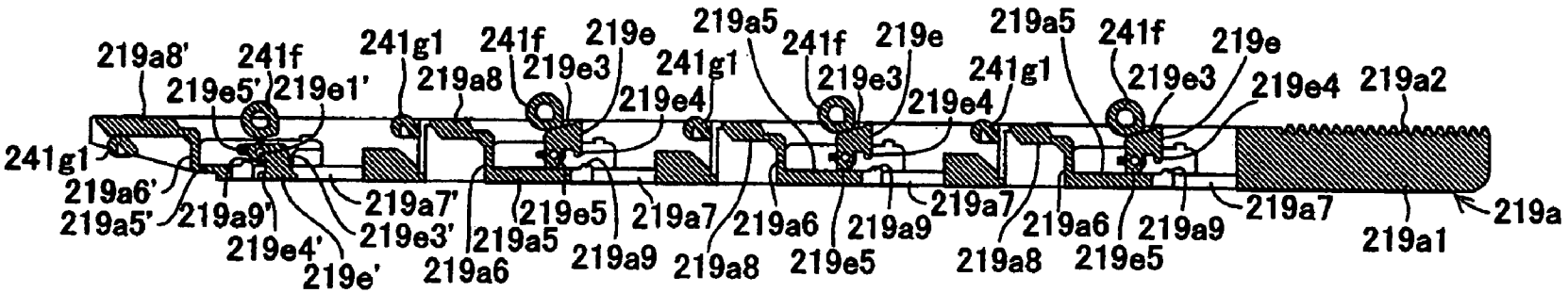
FIG. 31 is a side cross-section of the cylindrical cam part and auxiliary cam part with the cylindrical cam part shown in FIGS. 29A and 29B in an intermediary position.
Figure 32:
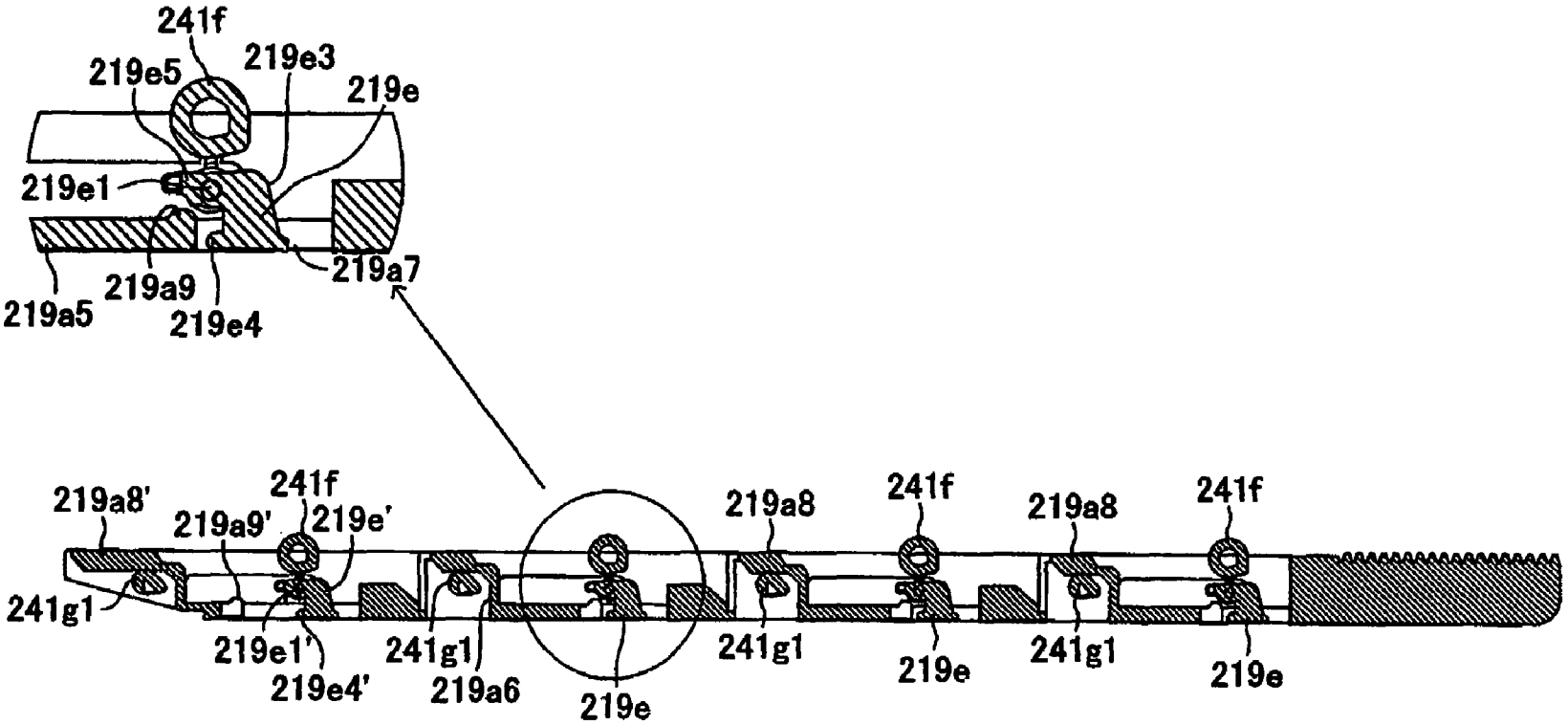
FIG. 32 is a side cross-section of the cylindrical cam part and auxiliary cam part with the cylindrical cam part shown in FIG. 29A.
Figure 33:
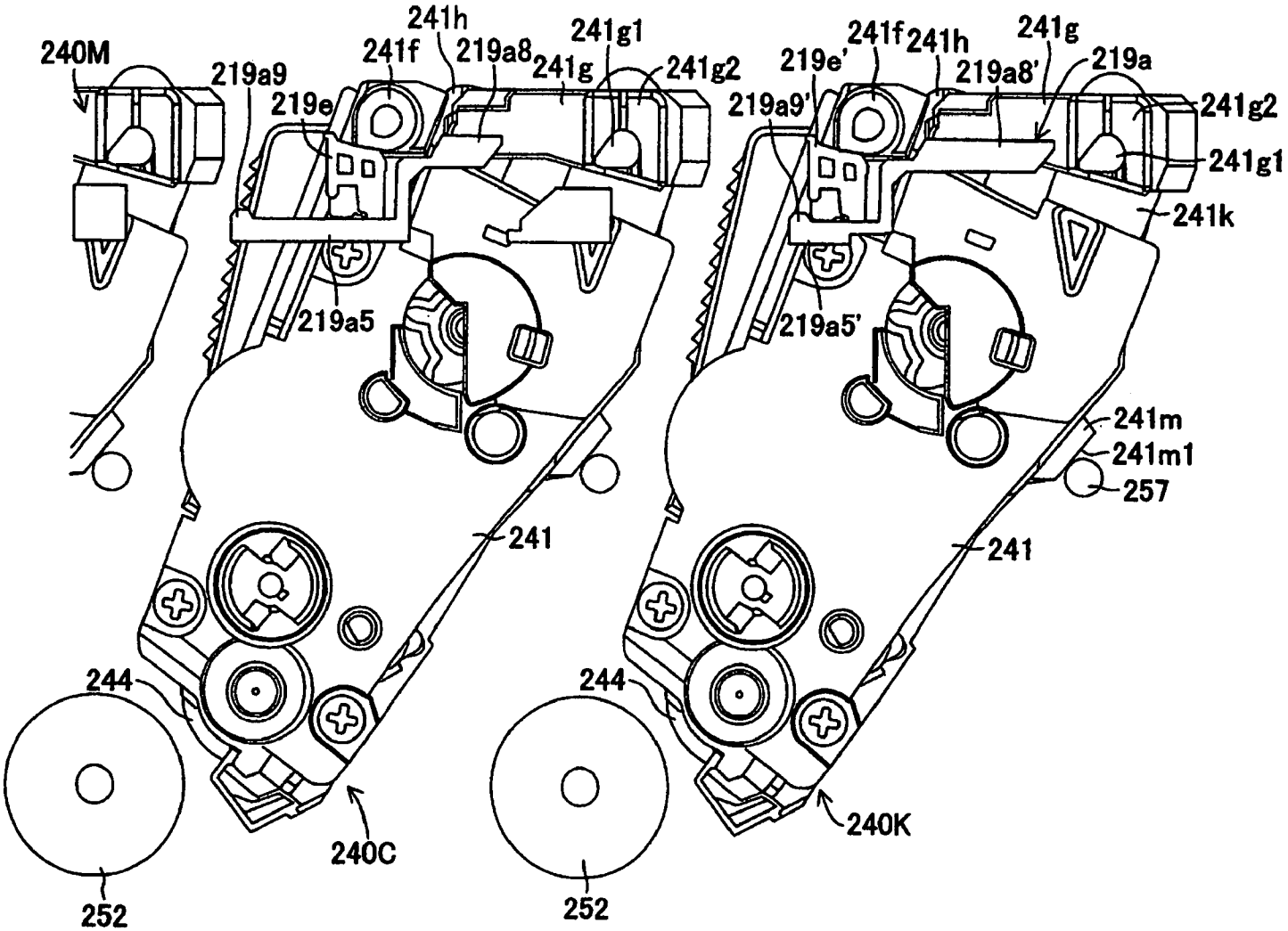
FIG. 33 is a magnified side view of the developer cartridge and linear cam mechanism with the cylindrical cam part of the process unit shown in FIG. 25 moved to the rearmost position.
Figure 34:
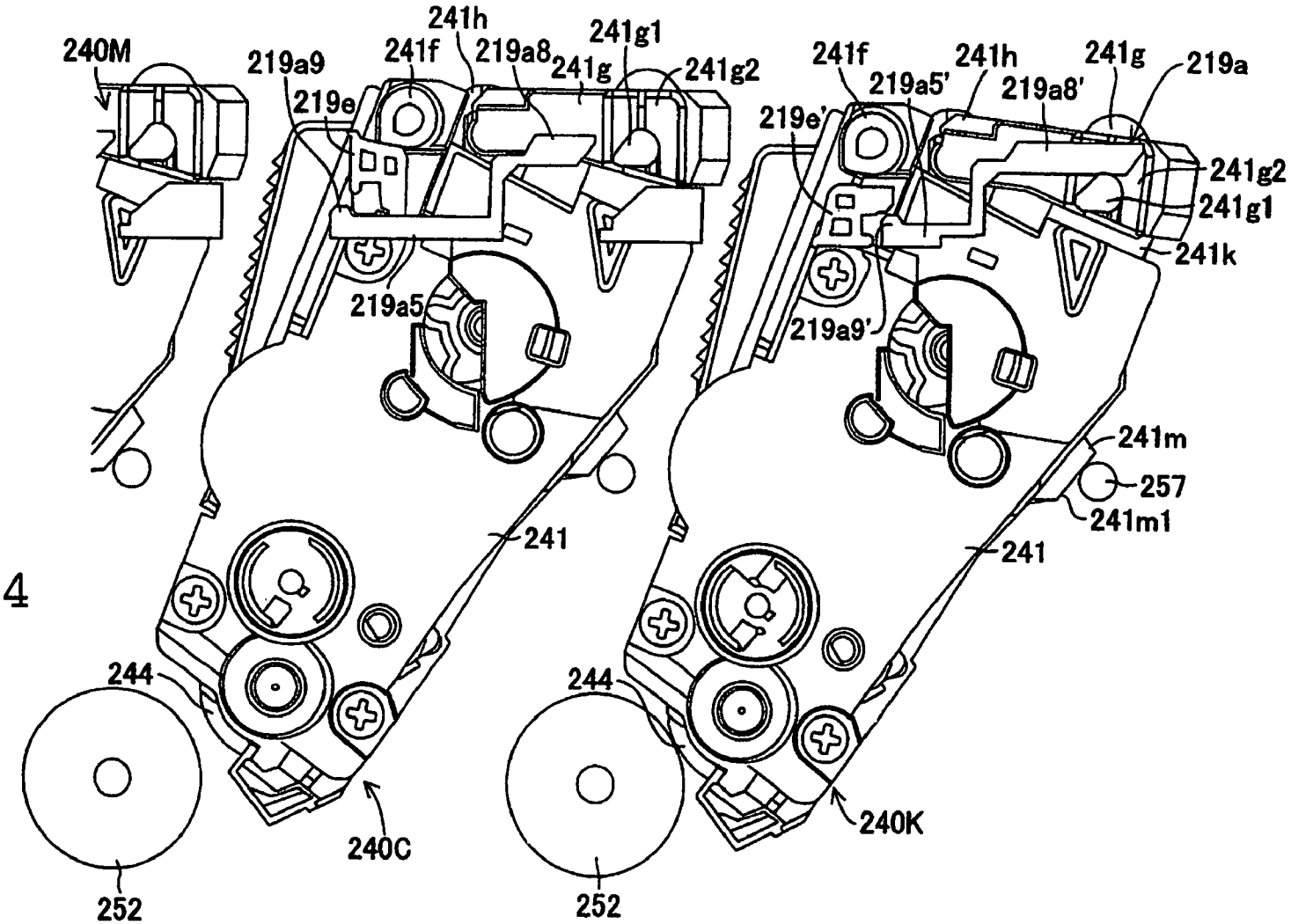
FIG. 34 is a magnified side view of the developer cartridge and linear cam mechanism with the cylindrical cam part of the process unit shown in FIG. 25 in an intermediate position.
Figure 35:
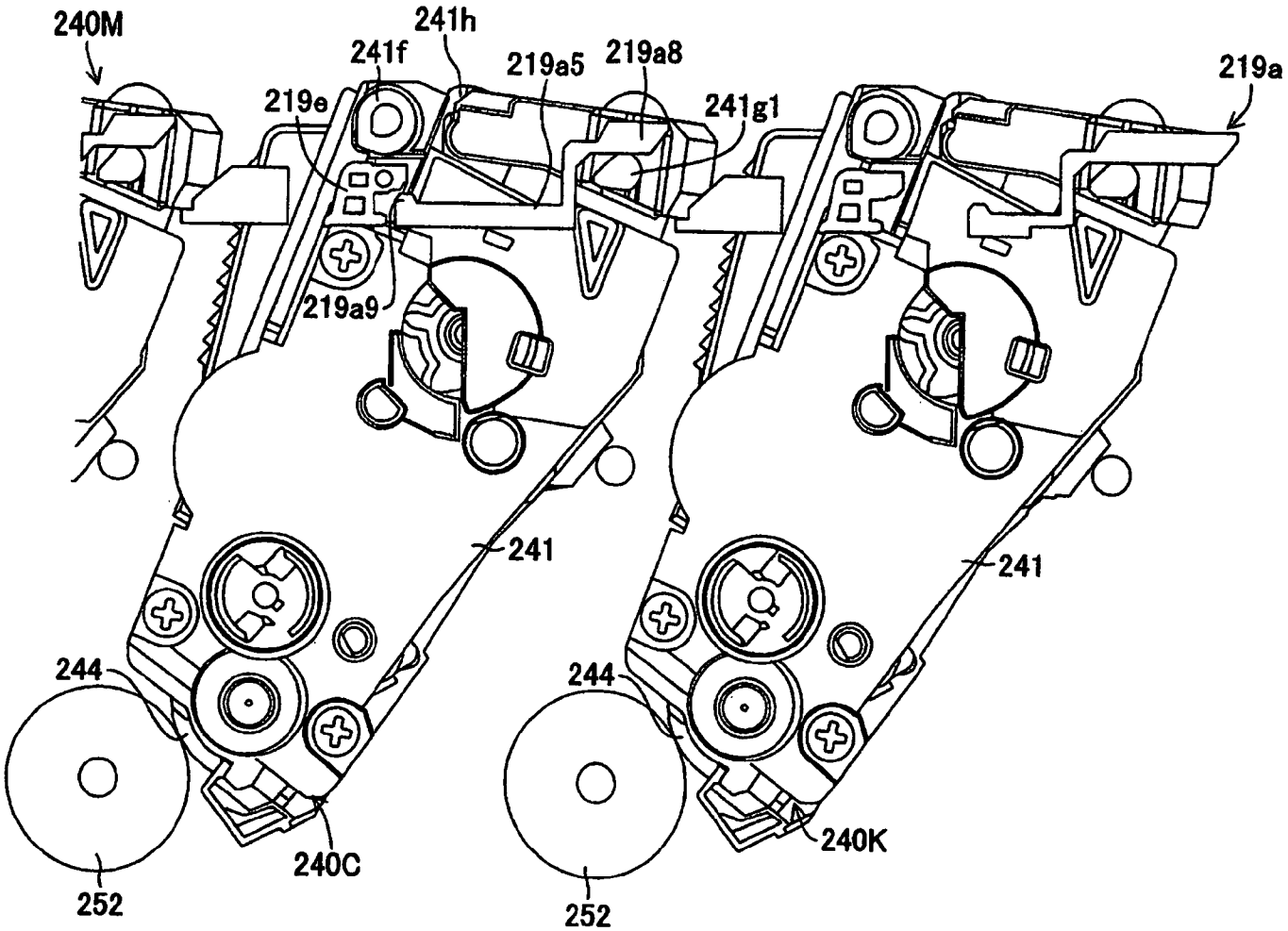
FIG. 35 is a magnified side view of the developer cartridge and linear cam mechanism with the cylindrical cam part of the process unit shown in FIG. 25 moved to the foremost position.

FIG. 30 through FIG. 32 are lateral cross-sections of the cylindrical cam part 219*a* and the auxiliary cam part 219*e* shown in FIGS. 29A and 29B. Here, FIG. 30 illustrates the cylindrical cam part 219*a* in its rearmost position (right side in diagram), FIG. 32 illustrates the cylindrical cam part 219*a* in its foremost position (left side in diagram), and FIG. 31 illustrates the intermediary position. Furthermore, FIG. 33 through FIG. 35 are magnified side views of the developer cartridge 240 and the linear cam mechanism 219 shown in FIG. 25. Note that the front-rear direction is reversed in FIGS. 30 through 32 and FIGS. 33 through 35. In short, FIGS. 30 through 32 are cross-sections of the cylindrical cam part 219*a* etc. seen from the side and the opposite side of the developer cartridge case 241 shown in FIGS. 33 through 35. FIG. 30 corresponds to FIG. 33; FIG. 31 corresponds to FIG. 34; and FIG. 32 corresponds to FIG. 35.

Referring to FIGS. 29A and 29B, the rear edge (right side in diagram) of the auxiliary cam support 219*a*5 is configured in such a way that it contacts the first downward protrusion of the auxiliary cam 219*e*4 on the auxiliary cam part 219*e*. Furthermore, an auxiliary cam rotation protrusion 219*a*9 is formed further to the rear than the rear edge of the auxiliary cam support 219*a*5 and further on the outside of the auxiliary cam part 219*e* in the width direction. The auxiliary cam rotation protrusion 219*a*9 is mounted in such a way that it protrudes upwards from the position in the width direction that corresponds (is able to contact) the second downward protrusion of the auxiliary cam 219*e*5 on the auxiliary cam part 219*e*.

Referring to FIG. 29 through FIG. 32, the cylindrical cam part 219*a* and auxiliary cam part 219*e* are configured in such a way that the auxiliary cam part 219*e* will rotate clockwise in the diagram to fallen state when the cylindrical cam part 219*a* moves to the front side (left side in the diagram) (when the auxiliary cam part 219*e* moves to the rear relative to the cylindrical cam part 219*a*). In short, an auxiliary cam rotation protrusion 219*a*9 is formed in such a way as to make it possible to rotate the auxiliary cam part 219*e* through contact with the second downward protrusion of the auxiliary cam 219*e*5 upon movement of the cylindrical cam part 219*a* to the front. (This concept is easier to understand if the figures are viewed in this order: FIG. 30, FIG. 31, and FIG. 32.) The auxiliary cam part 219*e* in fallen state is positioned on the top of the auxiliary cam exposed opening 219*a*7.

Here, the foremost auxiliary cam rotation protrusion 219*a*9' is formed at roughly the center in the front-rear direction of the foremost auxiliary cam guide hole 219*a*4'. On the other hand, the other auxiliary cam rotation protrusion 219*a*9 is formed close to the edge of the rear of the other auxiliary cam guide hole 219*a*4. In short, the relative position of the foremost auxiliary cam rotation protrusion 219*a*9' to the other auxiliary cam rotation protrusion 219*a*9 is set in such a way that the movement of the cylindrical cam part 219*a* to the front causes the foremost auxiliary cam part 219*e*' to enter fallen state prior to the other auxiliary cam part 219*e*.

Furthermore, as stated above, the pressing boss depress area 219*a*8 is configured in such a way that when the cylindrical cam part 219*a* moves to the front, it rises onto the pressing boss 241*g*1, pressing the corresponding pressing boss 241*g*1 downwards. In short, a slanted surface is formed on the end of the foremost side of the pressing boss depress area 219*a*8 in such a way as to facilitate rising onto the corresponding pressing boss 241*g*1 when contact is made with the pressing boss 241*g*1. Here, the foremost pressing boss depress area 219*a*8' is formed longer than the other pressing boss depress area 219*a*8 in order to make it possible to press the pressing boss 241*g*1 located at the foremost position to be pressed prior to the other pressing boss 241*g* 1.

On the other hand, the cylindrical cam part 219*a* and the auxiliary cam part 219*e* are configured in such a way that the auxiliary cam part 219*e* will rotate counter-clockwise in the figures to standing state when the cylindrical cam part 219*a* moves to the rear (right side in the figure) (when the auxiliary cam part 219*e* moves forward relative to the cylindrical cam part 219*a*). In short, the first downward protrusion of the auxiliary cam 219*e*4 is formed and positioned in such a way as to make it possible for the auxiliary cam part 219*e* to be rotated by contact with the rear end of the auxiliary cam support 219*a*5 upon movement of the cylindrical cam part 219*a* to the rear. (This concept is easier to understand if the figures are viewed in this order: FIG. 32, FIG. 31, and FIG. 30.) The auxiliary cam part 219*e* in standing state is supported by the top part of the auxiliary cam support 219*a*5.

Here, as stated above, the foremost auxiliary cam support 219*a*5' is formed shorter than the other auxiliary cam support 219*a*5. In short, the dimensions of the foremost auxiliary cam support 219*a*5' and the other auxiliary cam support 219*a*5 are set in such a way that the foremost auxiliary cam part 219*e*' reaches a standing state prior to the other auxiliary cam part 219*e* upon the movement to the rear of the cylindrical cam part 219*a*.

Furthermore, as shown in FIG. 33 through FIG. 35, the cylindrical cam part 219*a* is configured in such a way as to impel the black developer cartridge 240K, the cyan developer cartridge 240C and the magenta developer cartridge 240M arranged in the front-rear direction towards the photosensitive drum 252 positioned beneath each by pushing the pressing boss 241*g*1 downwards in response to the state of movement in the front-rear direction. Moreover, the auxiliary cam part 219*e* is configured in such a way as to be able to retain the black developer cartridge 240K, etc., in a prescribed retreated status upwards from the developer roller 244 and the photosensitive drum 252 by pushing the separator boss 241*f* when the standing state is entered in response to movement in the front-rear direction of the cylindrical cam part 219*a*.

Furthermore, the cylindrical cam part 219*a* and the auxiliary cam part 219*e* (auxiliary cam part 219*e*') are configured in such a way as to be able to push only the black developer cartridge 240K towards the photosensitive drum 252 while retaining the cyan developer cartridge 240C, etc., in the retreated status in response to movement in the front-rear direction of the corresponding cylindrical cam part 219*a*.

Structure for Delivering Rotational Driving Electric Potential

Figure 36:
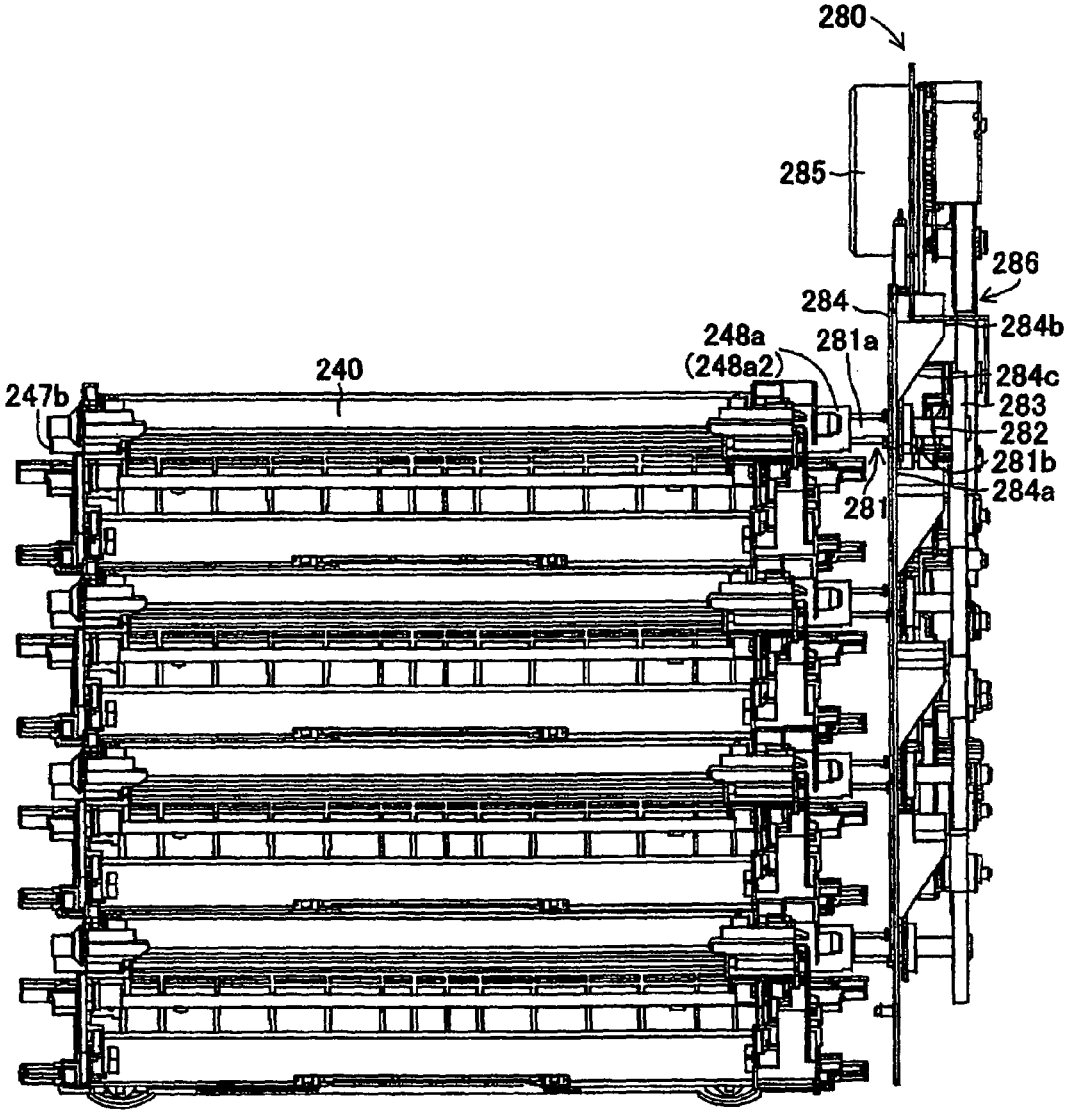
FIG. 36 is a view from the underside of a delivery cartridge mounted on the unit frame shown in the color laser printer of FIG. 12, and a rotational driving force delivery mechanism for delivering rotational driving force to this developer cartridge.
Figure 37:
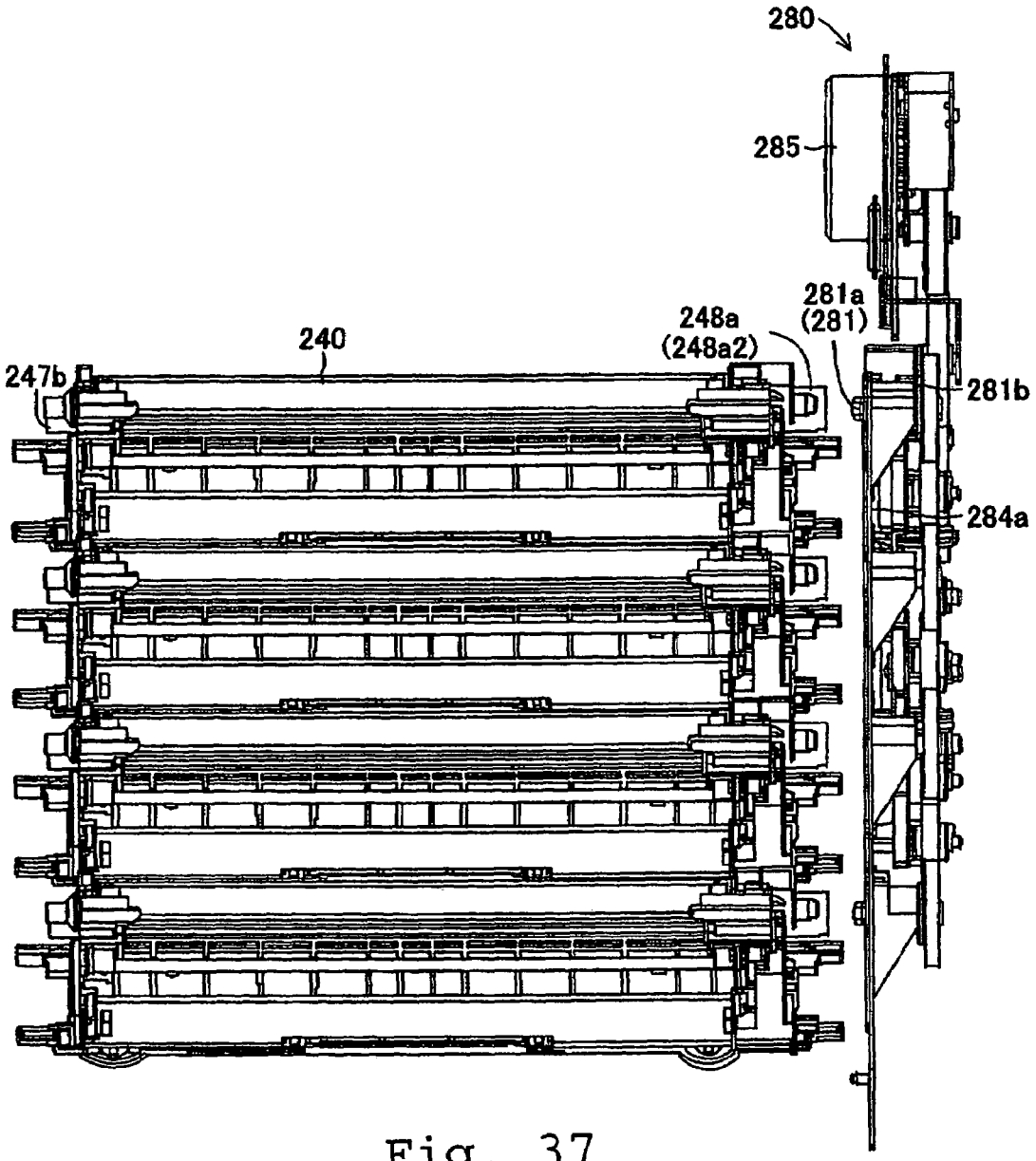
FIG. 37 is a view from the underside of a delivery cartridge mounted on the unit frame shown in the color laser printer of FIG. 12, and a rotational driving force delivery mechanism for delivering rotational driving force to this developer cartridge.

FIG. 36 and FIG. 37 are views from below of the developer cartridge 240 mounted on the unit frame 211 shown in FIG. 12, and of the driving electric potential delivery mechanism for delivering rotational driving electric potential to this developer cartridge 240. Referring to FIG. 36 and FIG. 37, the rotational driving electric potential delivery mechanism 280 is made up of a drive rotation unit 281, a drive rotation unit spring 282, a coupling drive gear 283, a drive rotation unit movement cam 284, a motor 285 and a gear array 286.

The four drive rotation units 281 are arranged along the front-rear direction (the up-down direction in the diagram) to align them with the coupling 248*a* on the four developer cartridges 240. The drive rotation units 281 are equipped with a coupling joint axis 281*a* and a flange 281*b*.

The coupling joint axis 281*a* is configured in such a way as to be able to combine with the corresponding coupling 248*a* when the tip is inserted into the coupling 248*a*. The coupling joint axis 281*a* and the coupling 248*a* are configured in such a way as to be able to deliver rotational drive electric potential from the rotational drive electric potential delivery mechanism 280 to the developer cartridges 240. The flange 281*b* is formed at the base (the right edge in the figure) of the coupling joint axis 281*a*.

The drive rotation unit spring 282 is positioned in such a way that one end contacts the flange 281*b* and the other end contacts the coupling drive gear 283. The drive rotation unit spring 282 is configured in such a way as to push the flange 281*b* (drive rotation unit 281) towards the coupling 248*a*.

The coupling drive gear 283 is configured in such a way as to be able to rotate together with the drive rotation unit 281. In short, by joining the central rotation axis of the coupling drive gear 283 to the joint hole formed inside the central rotation axis of the drive rotation unit 281 (coupling joint axis 281*a*), the drive rotation unit 281 and the coupling drive gear 283 are configured such that both will not be able to rotate in the same direction relative to one another.

Moreover, drive rotation unit 281 and coupling drive gear 283 are configured in such a way as to be able to move relative to one another in the axis direction. In short, the drive rotation unit 281 and the coupling drive gear 283 are configured in such a way as to enable the central rotation axis of the coupling drive gear 283 to slide in the axis direction inside the joint hole formed inside the central rotation axis of the drive rotation unit 281 (coupling joint axis 281*a*).

The drive rotation unit movement cam 284 is configured in such a way as to enable the setting of the position in the axis direction (width direction) of the four drive rotation units 281 arranged in the front-rear direction. Concretely, four pairs of cam floor surface 284*a*, cam peak surface 284*b* and cam slant surface 284*c* are formed on the drive rotation unit movement cam 284.

As shown in FIG. 36, the cam floor surface 284*a* is formed in such a way that it can touch the flange 281*b* of the drive rotation unit 281 positioned to join the coupling 248*a*. Moreover, as shown in FIG. 37, the cam peak surface 284*b* is formed in such a way that it can touch the flange 281*b* of the drive rotation unit 281 positioned away from the coupling 248*a*. The cam slant surface 284*c* is formed in such a way as to allow the cam floor surface 284*a* to connect smoothly with the cam peak surface 284*b*.

In short, the drive rotation unit movement cam 284 is configured in such a way that it can move the flange 281*b* slowly towards the outside (right side in FIG. 36) in the width direction on the cam slanted surface 284*c* in response to the pressing force of the drive rotation unit spring 282 when it is moved from the position shown in FIG. 36 to a position located downwards by a solenoid or other cam mechanism, etc., not shown. The drive rotation unit movement cam 284 is also configured in such a way as to be able to move the drive rotation unit 281 to the retreat position shown in FIG. 37. Furthermore, the drive rotation unit movement cam 284 is configured in such a way as to be able, when moved to a position upwards in the from the position shown in FIG. 37 by a solenoid or the like not shown, to move the drive rotation unit 281 to the joint position shown in FIG. 36 by the pressing force of the drive rotation unit spring 282.

The gear array 286 is configured in such a way as to be able to deliver rotational drive electric potential produced by the motor 285 to the four coupling drive gears 283.

Explanation of Operation Using According to Aspects

Next, we will make reference to diagrams to explain the operation when a process unit 240 is mounted onto/removed from the body 210 of a color laser printer 200 in aspects shown in FIG. 12.

Mounting/Removing a Developer Cartridge

Referring to FIG. 16 and FIG. 17, when a user is mounting or removing a developer cartridge 240 onto the process unit frame 230*a* of the process unit 230, the user grips the center in the width direction of the handle 241*g* mounted on the top end of the developer cartridge 240. Consequent to this, the handle 241*g* enters the standing state shown in FIG. 16. Next, when the user pulls the standing handle 241*g* upwards, the developer cartridge 240 moves roughly upwards, guided by the alignment collar guide groove 251*a*1 and the coupling shield sleeve guide groove 251*e*1 formed on both ends in the width direction of the photosensitive unit frame 251. The developer cartridge 240 is mounted onto or removed from the photosensitive unit 250 in this way.

Mounting of the developer cartridge 240 onto the process unite frame 240*a*, on the other hand, is performed with the handle 241 down, as shown in FIGS. 19A and 19B and FIGS. 20A and 20B. In this case, the developer cartridge 240 the top, i.e., the center in the width direction, is grasped. The alignment collar 246 is inserted into the alignment collar guide groove 251*a*1, as shown in FIG. 19A. Furthermore, the coupling shield sleeve 248*a*2 is inserted into the coupling shield sleeve guide groove 251*e* 1, as shown in FIG. 20A.

If the developer cartridge 240 is pressed further downwards in this state, the alignment collar 246 will be housed inside the alignment collar housing base 251*a*2, as shown in FIG. 19B. Moreover, the coupling shield sleeve 248*a*2 will be housed in the coupling housing base 251*e*2, as shown in FIG. 20B. Furthermore, the end of the developer roller rotation drive axis 244*a*, which does not have an alignment collar 246, will be housed in the developer roller axis end housing 251*e*3.

Here, referring to FIG. 18 and FIGS. 19A and 19*b*, the sliding part 258*c* of the relay electrode part 258 protrudes into the alignment collar guide groove 251*a* 1. Consequently, the sliding part 258*c* contacts the alignment collar 246. As a result of this, the sliding part 258*c* is pushed downwards by the alignment collar 246, sliding temporarily to the left (rotating counterclockwise in the figures). After this, the sliding part 258*c* contacts the electrical connection protrusion 247*b*.

In this way, the sliding part 258*c* protrudes inside the alignment collar guide groove 251*a*1 when a developer cartridge 240 is mounted, touching the electrical connection protrusion 247*b* after being pushed and slid by the alignment collar 246. Consequently, this makes it possible to smoothly form an electrical connection by contact between the electrical connection protrusion 247*b* and the relay electrode part 258 when mounting a developer cartridge 240.

Furthermore, referring to FIG. 18 and FIGS. 19A and 19B, the lower half of the alignment collar guide groove 251*a*1 is formed thinner than the coupling shield sleeve guide groove 251*e*1. Consequently, if an attempt is made to insert the coupling shield sleeve 248*a*2 into the alignment collar guide groove 251*a*1 with the developer cartridge 240 in the wrong position, the corresponding coupling shield sleeve 248*a*2 will be prevented from entering by the top of the alignment collar guide groove 251*a*1. This makes it possible to ensure that the developer cartridge 240 is not mounted incorrectly onto the photosensitive unit 250.

Force/Pressure of Developer Cartridge Towards Photosensitive Drum

Referring to FIGS. 21A and 21B, when the state of the developer cartridge 240 changes from the retreat status shown in FIG. 21A to the pressed status shown in FIG. 21B (ready to draw), the pressing boss 241*g*1 is depressed. Consequently, the handle 241*g* rotates slightly clockwise around the hinge 241*h*. As a result, the pressing member 241*g*2 of the free end of the handle 241*g* moves downward. This produces a force that elastically pushes the developer cartridge case 241 along the guide direction Z by the urging mechanism 241*k* mounted below the pressing member 241*g*2.

In short, referring to FIGS. 22A and 22B, the moving part 241*k* mounted on the urging mechanism 241*k* is depressed by the downward motion of the pressing member 241*g*2. As a result, as shown in FIG. 22B, the developer cartridge spring 241*k*3 becomes more contracted than shown in FIG. 22A. When the developer cartridge spring 241*k*3 is contracted in this manner, energy is produced in the developer cartridge spring 241*k*3. The energy impels the ceiling plate 241*c* of the developer cartridge case 241 downward.

Referring again to FIGS. 21A and 21B, when the ceiling plate 241*c* of the developer cartridge case 241 is impelled downward in this manner, the developer cartridge 240 moves from the retreat position shown in FIG. 21A to the pressed position shown in FIG. 21B. In short, the developer cartridge 240 moves toward the photosensitive drum 252. The direction of this movement, referring to FIGS. 23A and 23B, is the direction in which the alignment collar 246 moves within the alignment collar housing base 251*a*2 (guide direction Z).

Here, referring to FIG. 23B, the pressing action line Y, which is a straight line connecting the pressing position PP pressing action point by the urging mechanism 241*k* with the contact point (development position) CP, is parallel with the guide direction. Consequently, the force produced by the urging mechanism 241*k* enables smooth movement of the developer cartridge 240.

Furthermore, the angle formed by the developer cartridge pressing direction X for the pressed position PP with the pressing action line Y is approximately 20 degrees.

As a result of this, most of the force applied to the corresponding pressed position PP is transmitted to the contact position CP without major loss. Consequently, the prescribed contact state between the toner bearing surface 244*b* on the developer roller 244 and the image bearing surface 252*b* on the photosensitive drum 252 can be reproduced stably. Furthermore, the guide surface 241*m* on the guide protrusion 241*m* is parallel to the guide direction Z. Consequently, referring to FIG. 21A and 21B, the guide surface 241*m*1 of the guide protrusion 241*m* will be pressed appropriately towards the developer cartridge insertion guide roller 257. As a result, the movement of the developer cartridge 240 along the guide direction Z will be guided smoothly by the corresponding developer cartridge insertion guide roller 257.

Moreover, during the movement of the developer cartridge 240 along the guide direction Z from the retired position shown in FIG. 21A to the pressed position shown in FIG. 21B, the electrical connection protrusion 247*b* and the electrical connection counterpart 258*c*1 formed parallel to the pressing action line Y and guide direction Z will slide. Consequently, from the point in time at which the developer roller 244 is at the retired position, developer bias voltage can be applied between the developer roller 244 and photoelectric drum 252 via the relay electrode part 258 and electrical connection protrusion 247*b*.

Moreover, as shown in FIG. 23B, the electrical connection pressing direction S in which the electrical connection protrusion 247*b* is pressed by the electrical connection counterpart 258*c*1 at the contact point between the electrical connection protrusion 247*b* and the electrical connection counterpart 258*c*1 is partially orthogonal with the pressing action line Y and guide direction Z. As a result, almost no elements are generated parallel to the guide direction Z in the electrical connection pressing force from the relay electrode part 258 (electrical connection counterpart 258*c*1). Consequently, the prescribed contact state between the toner bearing surface 244*b* on the developer roller 244 and the image bearing surface 252*b* on the photosensitive drum 252 is stabilized.

Furthermore, the electrical connection counterpart 258*c*1 and the electrical connection pressing direction S are partly orthogonal. As a result, it is possible to reliably produce the state in which the electrical connection pressing direction S is partly orthogonal to the pressing action line Y and the guide direction Z.

Mounting the Process Unit

Referring to FIG. 25, first, the process unit 230 is mounted on the unit frame 211. The mounting is done as follows.

First, the side frame guide roller 232*c* and rear beam guide roller 234*b* are mounted onto the slide rail 211*c*1 by inserting them into the space to the rear of the slide guide roller 211*c*2 that is positioned on the front most end of the slide guide frame 211*c*. In this state, the slide guide roller 211*c*2, the side frame guide roller 232*c* and the rear beam guide roller 234*b* are caught between the guide rib 232*b* of the slide rail 211*c*1 and the side frame 232.

If the process unit 230 is pressed further behind in this state, the slide guide roller 211*c*2, the side frame guide roller 232*c* and the rear beam guide roller 234*b* will rotate while caught between the slide rail 211*c*1 and the guide rib 232*b*. As a result, the process unit 230 will be smoothly guided into the unit frame 211. At this time, the separator boss 241*f* and the pressing boss 241*g*1 mounted on the top end of the developer cartridge 240 will pass above the cam support frame upper plate 219*b*2.

If the process unit 230 is pushed further to the rear, with the side frame guide roller 230 and rear beam guide roller 234*b* passing the slide rail 211*c*1 and the front end of the guide rib 232*b* of the side frame 232 passing the slide guide roller 211*c*2, the process unit will move slightly downward. In this case, the slide rail 211*c*1 and the guide rib 232*b* will be facing each other in close proximity. Moreover, the separator boss 241*f* and the pressing boss 241*g*1 will also descend to be housed in the boss housing opening 219*b*5.

Setting the Position of the Developer Cartridge

Referring to FIG. 25, one of the cylindrical cam parts 219*a* is moved in the front-rear direction by a drive electric potential source (not shown) mounted on the unit casing 211 with the process unit 230 mounted onto the unit frame 211 in this manner. In this case, one of the pinion gears 219*c* meshed with the rack gear 219*a*2 of the cam base 219*a*1 on the appropriate cylindrical cam part 219*a* rotates. The rotation of the pinion gear 219*c* causes the other pinion gear 219*c* meshed with the pinion gear 219*c* through the gear axis 219*d* to rotate as well. The other cylindrical cam part 219*a* meshed with the other pinion gear 219*c* also moves. In this way, one pair of cylindrical cam parts 219*a* moves in sync through one pair of pinion gears 219*c* and the gear axis 219*d*. As a result, the position of the developer cartridge 240 is set to either the retired position or pressed position. Referring to FIG. 26 and FIG. 27, the setting of the position of the developer cartridge 240 can be performed by setting the position in the front-rear direction L of the cylindrical cam part 219*a*.

In short, referring to FIG. 25 and FIG. 26, by setting the position of the cylindrical cam part 219*a* in the front-rear direction L, the auxiliary cam part 219*e* positioned to face the boss housing opening 219*b*5 will be set to either rise or fall. The standing auxiliary cam part 219*e* protrudes towards the boss housing opening 219*b*5. As a result, the separator boss 241*f* is pushed upward. By keeping the auxiliary cam part 219*e* standing, the separator boss 241*f* will be held in the raised position. As a result, the developer cartridge 240 will be held in the retired position.

Moreover, referring to FIG. 25 and FIG. 27, setting the position of the cylindrical cam part 219*a* in the front-rear direction L sets whether the pressing boss 241*g*1 is depressed/not depressed by the pressing boss depress part 219*a*8. Depressing of the pressing boss 241*g*1 by the pressing boss depress part 219*a*8 causes the developer cartridge 240 to be impelled downward, moving it to the pressed position.

Selective Forcing of Multiple Developer Cartridges

Referring to FIG. 25, the multiple (four) developer cartridges 240 arranged along the front-rear direction L are impelled selectively downward in response to the position of the cylindrical cam part 219*a* along the front-rear direction L. The selective forcing is performed as follows.

Action of Linear Cam

First, the action of the linear cam mechanism 219 shown in FIG. 25 will be described using FIG. 29 through FIG. 32.

Referring to FIG. 29B and FIG. 30, when the cylindrical cam part 219*a* is in the rearmost position, the foremost auxiliary cam part 219*e*' and the other auxiliary cam part 219*e* are both in upright position and in contact with the auxiliary cam contact wall 219*a*6. The separator boss 241*f* is also placed on the separator boss mount 219*e*3 (219*e*3') of the upright auxiliary cam part 219*e* (219*e*'). Moreover, both the foremost pressing boss depress area 219*a*8' and the other pressing boss depress area 219*a*8 are positioned to the rear of the pressing boss 241*g*1.

When the cylindrical cam part 219*a* starts to move to the front from the state shown in FIG. 30, the auxiliary cam support 219*a*5 (219*a*5') moves to the front while sliding over the auxiliary cam part 219*e* (219*e*'). At this time, seen relatively, the auxiliary cam part 219*e* (219*e*') appears to be moving to the rear over the auxiliary cam support 219*a*5 (219*a*5'). Note that the auxiliary cam part 219*e* (219*e*') does not move along the front-rear direction. Therefore there is no change in the relative position in the front-rear direction between the auxiliary cam part 219*e* (219*e*') and the separator boss 241*f*. Furthermore, the movement of the cylindrical cam part 219*a* to the front causes the tip of the pressing boss depress area 219*a*8 (219*a*8') to approach the pressing boss 241*g*1.

First, this causes the foremost auxiliary cam rotation protrusion 219*a*9' to collide with the second downward protrusion of the auxiliary cam 219*e*5' on the foremost auxiliary cam part 219*e*'. (At this time, auxiliary cam rotation protrusion 219*a*9 is not yet in contact with the second downward protrusion of the auxiliary cam 219*e*5 on the foremost auxiliary cam part 219*e*.) As a result, the foremost auxiliary cam part 219*e*' rotates counterclockwise. It then moves to the down state, and drops from the auxiliary cam support 219*a*5' to be housed in the auxiliary cam exposed opening 219*a*7' positioned foremost. As a result, the separator boss 241*f* positioned foremost is relieved of the raising force and the separator boss 241*f* descends.

Moreover, referring to FIG. 31, only the tip of the foremost pressing boss depress area 219*a*8' rides up onto the pressing boss 241*g*1 positioned foremost. As a result, only the pressing boss 241*g*1 is selectively depressed downward.

When the cylindrical cam part 219*a* moves further to the front from the state shown in FIG. 31, the other auxiliary cam rotation protrusion 219*a*9 and the second downward protrusion of the auxiliary cam 219*e*5 collide. As a result, the other auxiliary cam part 219*e* also falls. Moreover, the other pressing boss depress area 219*a*8 also rides up onto the other pressing boss 241*g*. In this way, as shown in FIG. 32, all of the separator bosses 241*f* descend, and all of the pressing bosses 241*g*1 are depressed downward.

On the other hand, as shown in FIG. 32, when the cylindrical cam part 219*a* begins to move to the rear from the foremost position, first the first downward protrusion of the auxiliary cam 219*e*4 on the three auxiliary cam parts 219*e* other than the foremost auxiliary cam part 219*e'* collide with the tip of the auxiliary cam support 219*a*5. The three auxiliary cam parts 219*e* then rotate counterclockwise in the figure. As a result of the rotation, the three auxiliary cam parts 219*e* enter standing state, as shown in FIG. 31, and the separator boss mount 219*e*3 at the tip faces the separator boss 241*f*. Moreover, the auxiliary cam part 219*e* rides up onto the auxiliary cam support 219*a*5 in this raised state. As a result, the separator boss 241*f* is pressed upward. At this time, the foremost auxiliary cam part 219*e'* is still lowered. In short, the foremost separator boss 241*f* has not yet been raised up by the foremost auxiliary cam part 219*e'*.

At the same time, the pressing boss depress areas 219*a*8 other than the foremost pressing boss depress area 219*a*8' are released from above the pressing boss 241*g*1. As a result, the pressing boss depress area 219*a*8 is released from the depressive force of the pressing boss 241*g*1. At this time, the foremost pressing boss depress area 219*a*8' is still riding on top of the foremost pressing boss 241*g*1. In short, the foremost pressing boss 241*g*1 is still depressed by the foremost pressing boss depress area 219*a*8'.

When the cylindrical cam part 219*a* moves further to the rear from the position shown in FIG. 31, the foremost auxiliary cam part 219*e'* stands up. Moreover, the foremost pressing boss depress area 219*a*8 is also released from above the foremost pressing boss 241*g*1. In this way, as shown in FIG. 30, all of the separator bosses 241*f* are held above, and the depressive force on all of the pressing bosses 241*g*1 is released.

Selective Impelling Action on the Developer Cartridge

As a result of the foregoing action of the cylindrical cam part 219*a* and the auxiliary cam part 219*e*, the black developer cartridge 240K positioned foremost, the cyan developer cartridge 240C, etc., are differentially impelled downward.

In short, as shown in FIG. 33, depressive force on all of the pressing bosses 241*g*1 is released during actions not involving the formation of an image because all of the pressing boss depress areas 219*a*8 (219*a*8') are released from above the pressing boss 241*g*1. Moreover, during actions not involving the formation of an image, all of the separator bosses 241*f* will be kept raised because all of the auxiliary cam parts 219*e* (219*e'*) stand above the auxiliary cam support 219*a*5 (219*a*5'). As a result, the black developer cartridge 240K, cyan developer cartridge 240C, etc., are all retained at the retired position. Consequently, all of the developer rollers 244 and photosensitive drums 252 are held apart during actions not involving the formation of an image.

Moreover, as shown in FIG. 34, during the formation of images using only black, the foremost pressing boss depress area 219*a'* rides up onto the pressing boss 241*g*1, and the foremost auxiliary cam part 219*e'* falls over. As a result, the pressing boss 241*g*1 is depressed onto the foremost black developer cartridge 240K, and the upwards force on the separator boss 241*f* is released.

In this way, the raising force on the separator boss 241*f* is released from the black developer cartridge 240K, and the pressing boss 241*g*1 descends, causing the handle 241*g* to rotate slightly clockwise in FIG. 34 around the hinge 241*h*, as described above. As a result of the rotation of the handle 241*g*, the pressing member 241*g*2 mounted on the free end moves downward. As a result of the downward movement of the pressing member 241*g*2, the urging mechanism 241*k* is activated, impelling the developer cartridge case 241 downward. Then, only the developer roller 244 on the black developer cartridge 240K comes into contact with the photosensitive drum 252.

In this way, when forming an image using only black, the cyan developer cartridge 240C, etc., are retained in the retired position and only the black developer cartridge 240K used to form the image moves to the pressed position.

Furthermore, as shown in FIG. 35, all of the developer cartridge cases 241 are impelled downward when forming a full color image. As a result, the black developer cartridge 240K, cyan developer cartridge 240C, etc., all move to the pressed position.

Action and Effect of Another Illustrative Aspect

In this aspect, the conductive part 247 is pressed by the relay electrode part 258 in the electrical connection pressing direction S, which is roughly orthogonal to the pressing action line Y, a straight line formed by connecting the contact position CP and pressing position PP. Consequently, the contact between the developer roller 244 (toner bearing surface 244*b*) at the contact position CP with the photosensitive drum 252 (image bearing surface 252*b*) is made more stable. Moreover, electrical connection by the relay electrode part 258 through the conductive part 247 to the developer roller 244 is also conducted more stably. Therefore, this aspect makes it possible to form better images.

Moreover, an electrical connection is formed between the electrical connection protrusion 247*b* and the relay electrode part 258 when the electrical connection counterpart 258*c*1 formed roughly parallel to the pressing action line Y faces and comes into contact with the electrical connection protrusion 247*b*. As a result, it is possible to stably set the normal direction of the electrical connection counterpart 258*c*1 at the contact point between the electrical connection protrusion 247*b* and the electrical connection counterpart 258*c*1, i.e., the electrical connection pressing position SP (see FIG. 24), to a direction roughly orthogonal to the pressing action line Y. Consequently, it is possible to obtain a relay electrode part 258 and conductive part 247 with a simpler device configuration that permits the electrical connection pressing direction S to be roughly orthogonal to the pressing action line Y.

Here, the electrical connection counterpart 258*c*1 is roughly parallel to the alignment collar housing base 251*a*2 (guide direction Z). Therefore, when the alignment collar 246 moves along the pressing action line Y in the alignment collar housing base 251*a*2, the electrical connection counterpart 258*c*1 and electrical connection protrusion 247*b* move relatively along the pressing action line Y and guide direction Z. As a result, the toner bearing surface 244*b* on the developer roller 244 and the image bearing surface 252*b* on the photosensitive drum 252 come into contact in the prescribed state, making it possible to ensure the state of electrical connection to the developer roller 244 from the relay electrode part 258 from the point in time at which positioning for both is complete. Consequently, this reduces the startup time of the color laser printer 200 when forming an image.

Moreover, the electrical connection protrusion 247*b* can extend in a direction orthogonal to the pressing action line Y and electrical connection pressing direction S. Consequently, it is possible to maintain a stable contact state between the developer roller 244 and the photosensitive drum 252 at the contact position CP, while also improving electrical connection provision to the developer roller 244 through the conductive part 247 from the relay electrode part 258.

Moreover, from the width direction W, the position where the conductive part 247 and the relay electrode part 258 come in contact (electrical connection pressing position SP) overlaps with the coupling shield sleeve guide groove 251*e*1 (coupling housing base 251*e*2) that houses the coupling 248*a* (coupling shield sleeve 248*a*2). Furthermore, the electrical connection pressing position SP is within the range of the outer diameter of the coupling shield sleeve 248*a*2.

Consequently, it is possible to stabilize contact between the developer roller 244 and the photosensitive drum 252 at the contact position CP and electrical connection to the developer roller 244 through the conductive part 247 from the relay electrode part 258, while also stably supplying rotational driving force to the developer cartridge 240.

Moreover, in this aspect, when the alignment collar 246 moves along the pressing action line Y within the color housing base 251*a*2, the guide surface 241*m*1 formed roughly parallel to the tip of the guide protrusion 241*m*, i.e., the pressing action line Y, comes into contact with the developer cartridge insertion guide roller 257, which is supported to rotate freely by the floor wall 251*b*.

Consequently, when mounting a developer cartridge 240 onto the process unit frame 230*a* (photosensitive unit frame 251), it is possible to smoothly guide movement of the alignment collar 246 and the electrical connection protrusion 247*b* along the pressing action line Y. Therefore, it is possible to smoothly mount the developer cartridge 240 onto the process unit frame 240*a*, while also providing a good electrical contact between the relay electrode part 258 and the conductive part 247, and a stable contact between toner retaining surface 244*b* and the photosensitive drum 252 at the contact position CP.

Moreover, the angle formed by the developer cartridge pressing direction X and the pressing action line Y is set to roughly 20 degrees. As a result, the guide surface 241*m*1 of the guide protrusion 241*m* is pressed with the prescribed force, neither too strong nor too weak, towards the developer cartridge insertion guide roller 257. Moreover, it is possible to deliver the force from the developer cartridge spring 241*k*3 to the contact position CP without any major loss.

Consequently, the developer cartridge insertion guide roller 257 rotates smoothly while maintaining contact between the developer cartridge insertion guide roller 257 and the guide surface 241*m*1. As a result, the movement of the developer cartridge 240 along the guide direction Z will be guided smoothly into the developer cartridge insertion guide roller 257. Consequently, it is possible to stably and accurately maintain the prescribed state of contact between the toner bearing surface 244*b* on the developer roller 244 and the image bearing surface 252*b* on the photosensitive drum 252.

Moreover, in this aspect, an alignment collar 246 that covers the developer cartridge rotational drive axis 244*a* from the outside is used to position the developer cartridge 240. As a result, positioning of the developer cartridge 240 and the process unit frame 230*a* (photosensitive unit frame 251) will be done in the vicinity of the developer roller rotational drive axis 244*a*. Consequently, it is possible to ensure a better contact using a simpler device configuration for the contact between the developer roller 244 and the photosensitive drum 252 at the contact position CP.

Moreover, when mounting the developer cartridge 240 onto the process unit frame 230*a*, the alignment collar 246 of the developer cartridge 240 is housed in the alignment collar guide groove 251*a*1 on the photosensitive unit frame 251. Following this, the alignment collar 246 reaches the alignment collar housing base 251*a*2 at the bottom end of the alignment collar guide groove 251*a*1. At this time, the alignment collar 246 moves along the pressing action line Y within the alignment collar housing base 251*a*2. When the alignment collar 246 reaches the prescribed position on the alignment collar housing base 251*a*2, positioning is performed for the developer cartridge 240 and the process unit frame 230*a* (photosensitive unit frame 251).

According to the above aspect, when mounting the developer cartridge 240 onto the process unit frame 230*a*, it is possible to perform positioning of both more smoothly and accurately. Consequently, according to this configuration, it is possible to regularly obtain a better electrical connection between the relay electrode part 258 and the conductive part 247, and regularly obtain accurate positioning of the developer roller 244 and the photosensitive drum 252.

Moreover, the conductive part 247 supports the developer roller rotational drive axis 244*a* and the supply roller rotational drive axis 243*a* in such a way as to enable rotation, while electrically connecting the developer roller rotational drive axis 244*a* and the supply roller rotational drive axis 243*a*. As a result, electrical connection to the supply roller 243 and the developer roller 244 is performed via the relay electrode part 258 and the conductive part 247 such that the supply roller 243 and the developer roller 244 will reach roughly the same voltage. Consequently, it is possible to form a prescribed contact between the toner bearing surface 244 on the developer roller 244 and the photosensitive drum at the contact position CP, while also stably supplying electric potential to the supply roller 243 and developer roller 244 such that the supply roller 243 and developer roller 244 reach roughly the same voltage.

Moreover, in this aspect, an alignment collar 246 having a round outer shape seen from the width direction W protrudes from one end of the developer cartridge case 241 in the width direction W, and a coupling 248*a* (coupling shield sleeve 248*a*2) having a larger diameter protrudes on the other side. In addition, the coupling shield sleeve guide groove 251*e*1 is wider than the alignment collar guide groove 251*a*1 to an extent that allows it to house the coupling 248*a*.

Consequently, if an attempt is made to insert the alignment collar 246 into the coupling shield sleeve guide groove 251*e*1, or to insert the coupling 248*a* (coupling shield sleeve 248*a*2) into the alignment collar guide groove 251*a*1, the difference in external diameter will prevent the insertion. Concretely, it is not possible to insert a coupling 248*a* (coupling shield sleeve 248*a*2) with a large diameter into an alignment collar guide groove 251*a*1 with a width adapted to an alignment collar 246 with a small diameter.

Consequently, according to this configuration, it is possible to effectively prevent mis-mounting of the developer cartridge 240 onto the process unit frame 230*a* (photosensitive unit frame 251).

Moreover, according to this configuration, it is possible to reduce the length of the drive rotation unit 281 by an extent equal to the size of the protrusion of the coupling 248*a* (coupling shield sleeve 248*a*2). Consequently, it is possible to reduce the size in the width direction W of the rotational drive force delivery mechanism 280 mounted on the unit frame 211. This makes it possible to further reduce the size of the color laser printer 200.

Moreover, impelling force is applied towards the photosensitive drum 252 on the developer cartridge 240 by the handle 241*g* and urging mechanism 241*k* mounted on the top end of the developer cartridge case 241, i.e., the ceiling plate 241*c*. Consequently, it is possible use a fairly simple device configuration to form the prescribed impelling force towards the contact position CP on the developer roller 244.

Moreover, in this aspect, by moving the cylindrical cam part 219*a* mounted on the linear cam mechanism 219 along the front-rear direction L in which the multiple developer cartridges 240 are arranged, the multiple pressing bosses 241*g*1 and pressing members 241*g*2 will selectively move toward the developer cartridge spring 241*k*3. As a result, only those of the multiple developer cartridges 240 used to form images will be impelled toward the contact position CP. Consequently, it is possible to effectively inhibit deterioration of the developer roller 244, etc., due to long-term continuous friction between the developer roller 244 and the photosensitive drum 252 using a fairly simple device configuration.

Other Suggested Formations

Moreover, as stated previously, the foregoing aspects are merely representative, and the present invention is not restricted to the foregoing aspects, but may be modified in various ways so long as the fundamental aspects of the present invention are not modified.

Below are a few examples of other possible formations, though the invention is not so limited (i) The image formation devices that are the subject of the present invention are not restricted to electro photo types. Moreover, if the subject of the present invention happens to be an electro photo type image formation device, the image formation device is not restricted to laser printers.

(ii) The configurations of the aspects described herein may be exchanged or combined.

(iii) Moreover, the photosensitive unit frame 251 may be omitted from some of the above aspects, with the photosensitive drum 252 supported directly by the process unit frame 230*a* and the developer cartridge 240 directly mounted and removed.

(iv) Moreover, aspects may be configured in such a way that the photosensitive unit 250 can be freely mounted and removed from the process unit frame 230*a*.

(v) Aspects of the invention may be configured in such a way that the process unit frame 230*a* can be pulled out from the front of the unit frame 211 but cannot be easily mounted and removed from the unit frame 211.

(vi) The angle formed by the developer cartridge pressing direction X and the pressing action line Y in some aspects is not restricted to 20 degrees. It is preferable that the angle formed by both be no greater than 25 degrees in order that the guide surface 241*m*1 of the guide protrusion 241*m* be pushed without excessive force towards the developer cartridge insertion guide roller 257. On the other hand, it is preferable that the angle formed by both be no less than 5 degrees in order that the guide surface 241*m*1 of the guide protrusion 241*m* be pushed with sufficient force towards the developer cartridge insertion guide roller 257.

(vii) Certain aspects may be configured in such a way that one of the cylindrical cam parts 219*a* can move in sync by having a drive mechanism not shown drive the rotation of at least one of the pair of pinion gears 219*c* or the gear axis 219*d*.

The invention claimed is:

1. An image forming device comprising:

a developer cartridge that includes a developer carrier configured to carry a developer, a developer cartridge case configured to house the developer carrier, and a conductive member mounted on the developer cartridge case and electrically connected to said developer carrier;

a developer cartridge mounting frame including an image carrier configured to form an image on a recording medium using the developer carried on the developer carrier by contacting the developer carrier at a designated contact position, wherein the developer cartridge is configured to be installed in and removed from the developer cartridge mounting frame;

an urging member configured to urge in a pressing direction a portion of the developer cartridge case at a designated pressing position, and wherein in response to the urging member urging the portion of the developer cartridge case, the developer carrier is pressed against the image forming carrier at the contact position; and an electrical connection member configured to allow the conductive member to receive electric potential when contacting the electrical connection member in a direction perpendicular to a line that connects the contacting position and the pressing position.

2. An image forming device according to claim 1, wherein:

an angle formed by the pressing direction and the line that connects the contacting position and the pressing position is greater than or equal to 0 degrees and less than or equal to 25 degrees.

3. An image forming device according to claim 1, wherein:

the conductive member includes a protrusion configured to be pressed by the electrical connection member;

the electrical connection member includes a portion configured to face the protrusion; and the portion of the electrical connection member is configured to be parallel to the line that connects the contacting position and the pressing position.

4. An image forming device according to claim 1, wherein:

the developer cartridge includes an alignment projection configured to cause the developer cartridge to be aligned with the developer cartridge mounting frame by being guided by a guide formed on the developer cartridge mounting frame; and the guide including an edge portion adjacent to the image carrier, the edge portion configured to allow the alignment projection to move along the line that connects the contacting position and the pressing position.

5. An image forming device according to claim 4, wherein:

the developer carrier includes a driving shaft having a center axis perpendicular to the line that connects the contacting position and the pressing position; and the alignment projection includes the driving shaft of the developer carrier.

6. An image forming device according to claim 5, wherein:

the developer cartridge includes a developer supply member configured to supply developer to the developer carrier;

the developer supply member includes a driving shaft; and the conductive member is configured to electrically connect the driving shaft of the developer supply member and the driving shaft of the developer carrier.

7. An image forming device according to claim 4, wherein:

the developer cartridge mounting frame includes a first wall that the guide is formed on, and a second wall;

the developer cartridge case includes a guiding projection configured to contact the second wall at a contacting portion when the developer cartridge is installed in the developer cartridge mounting frame; and a surface of the contacting portion contacting the second wall is parallel to the line that connects the contacting position and the pressing position.

8. An image forming device according to claim 7, wherein:

a roller configured to roll while being in contact with the contacting portion when the alignment projection moves along the edge portion.

9. An image forming device according to claim 4, further including:

a drive unit configured to apply a driving force to drive the developer carrier; and a frame configured to support the developer cartridge mounting frame, wherein the developer cartridge includes a driving force input portion configured to receive the driving force from the drive unit, wherein the conductive member is arranged on a first end of the developer cartridge case perpendicular to the line that connects the contacting position and the pressing position;

the driving force input portion is arranged to project from a second end of the developer cartridge case, the second end being different from the first end; and a position at which the conductive member and the electrical connection member come into contact with each other overlaps the driving force input portion.

10. An image forming device according to claim 9, wherein:

the alignment projection is formed to project from the first end of the developer cartridge case, wherein the alignment projection is formed to have a first circumference;

the driving input portion has a second circumference different from the first circumference of the alignment projection; and a driving force input opening is formed on the developer cartridge mounting frame, the driving force input opening receiving the driving force input portion, and the driving force input opening having a different width from the guide.

11. An image forming device according to claim 3, wherein:

the protrusion of the conductive member extends in a direction orthogonal to the line that connects the contacting position and the pressing position, the direction being perpendicular to the line that connects the contacting position and the pressing position.

12. An image forming device according to claim 1 further comprising:

a pressing member configured to press the urging member toward the developer cartridge case;

a handle pivotably attached to the developer cartridge case; and an urging member support provided on an upper edge of the developer cartridge case and configured to support the urging member;

wherein the pressing member is provided at an edge away from a pivoting edge of the handle and is configured to press the urging member.

13. An image forming device according to claim 12, wherein:

the developer cartridge mounting frame is configured to allow a plurality of the developer cartridges to be simultaneously installed while each developer cartridge is aligned in parallel with each other developing cartridge, and the pressing member includes a plurality of pressing members corresponding to each developer cartridge.

14. An image forming device according to claim 13, further comprising:

a force applying member configured to apply a force to the plurality of pressing members.

15. An image forming device according to claim 14, wherein:

the force applying member includes a translation cam member configured to move along a front-rear direction.

16. A process cartridge configured to be installed in and removed from a frame of an image forming device, the process cartridge comprising:

a developer cartridge that includes a developer carrier configured to carry a developer, a developer cartridge case configured to house the developer carrier and the developer, and a conductive member provided on the developer cartridge case, the conductive member being electrically connected to the developer carrier, the developer cartridge case including a portion urged in a pressing direction by an urging element at a designated pressing position; and a process cartridge frame that holds an image carrier to which the developer is carried by contacting the developer carrier at a designated contact position, the developer cartridge being configured to be installed in and removed from the process cartridge frame;

wherein the conductive member is configured to be pressed by an electrical connection member in a direction perpendicular to a line that connects the pressing position and the contacting position.

17. A process cartridge according to claim 16, wherein:

an angle formed by the pressing direction and the line that connects the contacting position and the pressing position is greater than or equal to 0 degrees and less than or equal to 25 degrees.

18. A process cartridge according to claim 16, wherein:

the developer cartridge includes an alignment projection configured to cause the developer cartridge to be aligned with the process cartridge frame by being guided by a guide formed on the developer cartridge mounting frame; and the guide including an edge portion adjacent to the image carrier, the edge portion configured to allow the alignment projection to move along the line that connects the contacting position and the pressing position.

19. A process cartridge according to claim 18, wherein:

the developer carrier includes a driving shaft having a center axis perpendicular to the line that connects the contacting position and the pressing position; and the alignment projection includes the driving shaft of the developer carrier.

20. A process cartridge according to claim 19, wherein:

the developer cartridge includes a developer supply member configured to supply developer to the developer carrier;

the developer supply member includes a driving shaft; and the conductive member is configured to electrically connect the driving shaft of the developer supply member and the driving shaft of the developer carrier.

21. A process cartridge according to claim 18, wherein:

the process cartridge frame includes a first wall that the guide is formed on, and a second wall;

the developer cartridge case includes a guiding projection configured to contact the second wall at a contacting portion when the developer cartridge is installed in the process cartridge frame; and a surface of the contacting portion contacting the second wall is parallel to the line that connects the contacting position and the pressing position.

22. A process cartridge according to claim 21, wherein:

a roller is configured to roll while being in contact with the contacting portion when the alignment projection moves along the edge portion.

23. A process cartridge according to claim 18, wherein:

the electrical connection member is configured to allow the conductive member to receive electric potential when contacting the electrical connection member and to include a portion configured to face the protrusion; and the portion of the electrical connection member is configured to be parallel to the line that connects the contacting position and the pressing position.

24. A process cartridge according to claim 23, wherein:

the developer cartridge includes a driving force input portion configured to receive a driving force from a drive unit on the frame;

the conductive member is provided on a first end of the developer cartridge case perpendicular to the line that connects the contacting position and the pressing position;

the driving force input portion is provided to project from a second end of the developer cartridge case, the second end being different from the first end; and a position, where the conductive member and the electrical connection member come in contact with each other, overlaps the driving force input portion.

25. A process cartridge according to claim 24, wherein:

the alignment projection is formed to project from the first end of the developer cartridge case, wherein the alignment projection is formed to have a first circumference;

the driving input portion has a second circumference different from the first circumference of the alignment projection; and a driving force input opening is formed on the developer cartridge mounting frame, the driving force input opening receiving the driving force input portion, and the driving force input opening having a different width from the guide.

26. A process cartridge according to claim 23, wherein:

the protrusion of the conductive member extends in a direction orthogonal to the line that connects the contacting position and the pressing position, the direction being perpendicular to the line that connects the contacting position and the pressing position.

27. A process cartridge according to claim 16, wherein:

the urging member is configured to urge in the pressing direction the portion of the developer cartridge case at the designated pressing position, and wherein in response to the urging member urging the portion of the developer cartridge case, the developer carrier is pressed against the image forming carrier at the contact position; and a pressing member configured to press the urging member toward the developer cartridge case;

a handle pivotably attached to the developer cartridge case; and an urging member support provided on an upper edge of the developer cartridge case and configured to support the urging member;

wherein the pressing member is provided at an edge away from a pivoting edge of the handle and is configured to press the urging member.

28. A process cartridge according to claim 27, wherein:

the process cartridge frame is configured to allow a plurality of the developer cartridges to be simultaneously installed while each developer cartridge is aligned in parallel with each other developing cartridge, and the pressing member includes a plurality of pressing members corresponding to each developer cartridge.

29. A process cartridge according to claim 28 characterized by being further comprised of:

a force applying member configured to apply a force to the plurality of pressing members.

30. A process cartridge according to claim 29, wherein:

the force applying member includes a translation cam member configured to move along a front-rear direction.

31. A developer cartridge for use in an image forming device including an image carrier configured to be supported in a developer cartridge mounting frame, which is configured to be supported inside the image forming device, the developer cartridge being configured to be installed in and removed from the developer cartridge mounting frame, the developer cartridge comprising:

a developer carrier configured to carry the developer;

a developer cartridge case configured to house the developer carrier;

a conductive member mounted on the developer cartridge case and electrically connected to the developer carrier;

wherein the developer cartridge case is configured to allow the developer carrier to be pressed, at a designated pressing position, against the image carrier; and the conductive member is configured to be supplied with electric potential while being pressed by an electrical connection member in a direction perpendicular to a line that connects a contacting position where the developer carrier and the image carrier contact each other, and the designated pressing position.

32. A developer cartridge according to claim 31, wherein:

an angle formed by the pressing direction and the line that connects the contacting position and the pressing position is greater than or equal to 0 degrees and less than or equal to 25 degrees.

33. A developer cartridge according to claim 31, wherein:

the conductive member includes a protrusion.

34. A developer cartridge according to claim 31 further comprising:

an alignment projection configured to cause the developer cartridge to be aligned with the developer cartridge mounting frame by being guided by a guide formed on the developer cartridge mounting frame, the guide including an edge portion adjacent to the image carrier, the edge portion configured to allow the alignment projection to move along the line that connects the contacting position and the pressing position;

the developer carrier includes a driving shaft having a center axis; and the alignment projection includes the driving shaft of the developer carrier.

35. A developer cartridge according to claim 34 further comprising:

a developer supply member configured to supply developer to the developer carrier, the developer supply member including a driving shaft;

wherein the conductive member is configured to connect the driving shaft of the developer supply member and the driving shaft of the developer carrier.

36. A developer cartridge according to claim 34, wherein:

the developer cartridge mounting frame includes a first wall that the guide is formed on, and a second wall;

the developer cartridge case includes a guiding projection configured to contact the second wall at a contacting portion when the developer cartridge is installed in the developer cartridge mounting frame; and a surface of the contacting portion contacting the second wall is parallel to the line that connects the contacting position and the pressing position.

37. A developer cartridge according to claim 36, wherein:

wherein the contacting portion of the guiding projection is configured to contact a roller of the developer cartridge mounting frame when the alignment projection moves along the edge portion.

38. A developer cartridge according to claim 34, further comprising:

a driving force input portion configured to receive a driving force to drive the developer carrier, from a driving unit in the image forming device, wherein the conductive member is provided on a first end of the developer cartridge case, the driving force input portion is provided to project from a second end of the developer cartridge case, the second end being different from the first end, and a position at which electric potential is supplied to the conductive member overlaps the driving force input portion.

39. A developer cartridge according to claim 38, wherein:

the alignment projection is formed to project from the first end of the developer cartridge case, wherein the alignment projection is formed to have a first circumference;

the driving input portion having a second circumference different from the first circumference of the alignment projection.

40. A developer cartridge according to claim 33, wherein:

the protrusion of the conductive member extends in a direction orthogonal to the line that connects the contacting position and the pressing position, the direction being perpendicular to the line that connects the contacting position and the pressing position.

41. A developer cartridge according to claim 31, further comprising:

an urging member configured to urge in the pressing direction the portion of the developer cartridge case at the designated pressing position, and wherein in response to the urging member urging the portion of the developer cartridge case, the developer carrier is pressed against the image forming carrier at the contact position;

a pressing member configured to press the urging member toward the developer cartridge case;

a handle pivotably attached to the developer cartridge case; and an urging member support provided on an upper edge of the developer cartridge case and configured to support the urging member;

wherein the pressing member is provided at an edge away from a pivoting edge of the handle and is configured to press the urging member.

* * * * *